US006083680A

United States Patent [19]

Ito et al.

[11] Patent Number: 6,083,680

[45] Date of Patent: Jul. 4, 2000

[54] PHOTOTHERMOGRAPHIC MATERIAL

[75] Inventors: Tadashi Ito; Kazuki Yamazaki, both of Kanagawa, Japan

[73] Assignee: Fuji Photo Film Co., Ltd., Minami-Ashigara, Japan

[21] Appl. No.: 09/134,373

[22] Filed: Aug. 14, 1998

[30] Foreign Application Priority Data

Aug. 14, 1997 [JP] Japan ..... 9-219656
Aug. 14, 1997 [JP] Japan ..... 9-231874

[51] Int. Cl.[7] ..... G03C 1/498

[52] U.S. Cl. ..... 430/619; 430/264; 430/531; 430/567; 430/603; 430/604; 430/605; 430/617; 430/627

[58] Field of Search ..... 430/619, 617, 430/264, 604, 603, 605, 567, 569, 531, 627

[56] References Cited

U.S. PATENT DOCUMENTS 5,006,451 4/1991 Anderson et al. ..... 430/527
5,563,030 10/1996 Zou et al. ..... 430/619
5,858,637 1/1999 Eshelman et al. ..... 430/569
5,876,905 3/1999 Irving et al. ..... 430/350
5,876,915 3/1999 Deroover et al. ..... 430/619

*Primary Examiner*—Thorl Chea
*Attorney, Agent, or Firm*—Birch, Stewart, Kolasch & Birch, LLP

[57] ABSTRACT

A photothermographic material for a photomechanical process which is high in sensitivity and high in contrast and can provide an image low in Dmin by UV light, comprising a support having provided thereon a light-insensitive organic silver salt, a light-sensitive silver halide formed independently of the light-insensitive organic silver salt, and a binder, wherein the main binder of an image formation layer containing the light-sensitive silver halide is a polymer latex having a glass transition-temperature of 40° C. or less, said image formation layer is formed by applying a coating solution in which 60% by weight or more of a solvent is water, and the light-sensitive silver halide is gold-sensitized silver halide grains having a silver chloride content of 80 mol % or more per silver halide.

17 Claims, 1 Drawing Sheet

PHOTOTHERMOGRAPHIC MATERIAL

FIELD OF THE INVENTION

The present invention relates to a photothermographic material, and particularly to a photothermographic material suitable for a photomechanical process. Specifically, the present invention relates to a light-sensitive material for a scanner or an image setter, and more specifically to a photothermographic material which is high in sensitivity and high in contrast, and can provide an image low in Dmin by UV light.

BACKGROUND OF THE INVENTION

One known method for exposing photographic materials, is an image formation method according to a so-called scanner system which comprises scanning an original drawing, and exposing a silver halide photographic material, based on its image signal, thereby forming a negative image or a positive image corresponding to an image of the original drawing.

Further, in the case of direct printing to a press plate, not passing through a dot to dot work process after output from a scanner to a film, or to a scanner light source having a soft beam profile, a scanner light-sensitive material having super hard characteristics has been desired.

A number of light-sensitive materials have been known which have light-sensitive layers on supports and perform image formation by image exposure. Of these, image formation by heat development is advantageous for environmental preservation and can simplify image formation means.

In recent years, it has been greatly desired to reduce the amount of processing waste fluid, from the viewpoints of environmental preservation and space saving in the field of photomechanical processes. Photothermographic materials for photomechanical processes have therefore been required which can be efficiently exposed with a laser scanner or a laser image setter and which can form sharp black images having high resolution. The photothermographic materials can dispense with the use of processing chemicals of the solution family, and so can provide to customers heat development systems which are simpler and do not damage the environment.

Methods for forming images by heat development are described, for example, in U.S. Pat. Nos. 3,152,904 and 3,457,075, and D. Morgan and B. Shely, *Thermally Processed Silver Systems A* (*Image Processing and Materials*), Neblette, the eighth edition, edited by Sturge, V. Walworth and A. Shepp, page 2 (1969). Such light-sensitive materials contain reducible light-insensitive silver sources (for example, organic silver salts), catalytic active amounts of photocatalysts (for example, silver halides) and reducing agents for silver usually in the state where they are dispersed in organic binder matrixes. The light-sensitive materials are stable at room temperature. However, when they are heated at a high temperature (for example, 80° C. or higher) after exposure, silver is produced by the oxidation-reduction reaction of the reducible silver sources which function as oxidizing agents with the reducing agents. The oxidation-reduction reaction is accelerated by the catalytic action of latent images generated by exposure. Silver produced by the reaction of the reducible silver salts in exposed areas provides black images, which make a contrast with unexposed areas to form images.

The photothermographic materials of this type have hitherto been known. However, many of these light-sensitive materials are applied in the form of coating solutions in which organic solvents such as toluene, methyl ethyl ketone (MEK) and methanol are used as solvents, thereby forming light-sensitive layers. The use of organic solvents as solvents is disadvantageous in terms of not only adverse effects to the human body in manufacturing processes, but also because of a rise in cost due to the recovery of the solvents and the like.

Methods for forming light-sensitive layers by use of aqueous coating solutions having no concerns for such disadvantages (hereinafter also referred to as "aqueous light-sensitive layers") have been proposed. For example, the use of gelatin as a binder is described in JP-A-49-52626 (the term "JP-A" as used herein means an "unexamined published Japanese patent application") and JP-A-53-116144. Further, the use of polyvinyl alcohol as a binder is described in JP-A-50-151138.

Furthermore, an example in which gelatin is used in combination with polyvinyl alcohol is described in JP-A-60-61747. As another example, a light-sensitive layer in which water-soluble polyvinyl alcohol is used as a binder is described in JP-A-58-28737.

Surely, the use of such binders permits the formation of light-sensitive layers using aqueous coating solutions, resulting in high environmental and cost merit.

However, when polymers such as gelatin, polyvinyl alcohol and water-soluble polyacetals are used as binders, not only the compatibility with organic silver salts is poor, which causes a failure to obtain coated products fit for practical applications in respect to the quality of coated surfaces, but also the color tone of silver in developed areas turns brown or yellow, far from black which is considered to be inherently preferred, or the optical density of exposed areas is low and the density of unexposed areas is high, resulting in significant deterioration of commodity value.

Accordingly, techniques have been desired which provide photothermographic materials, aqueous light-sensitive materials excellent in environmental preservation and cost, good in the quality of coated surfaces, showing good color tone of silver in development, and having sufficient photographic characteristics.

Further, the application of techniques used in previously widely known silver halide photographic materials has become possible by the use of the above-mentioned aqueous light-sensitive materials. That is to say, it becomes possible to previously prepare light-sensitive silver halide emulsions having desired characteristics and to mix the resulting emulsions with organic silver salts, which can substantially improve the degree of freedom of design, compared with the preparation of light-sensitive silver halide emulsions by the organic solvent system.

European Patent 762,196 and JP-A-9-90550 disclose that high contrast photographic characteristics can be obtained by adding the group VII or VIII metallic ions or metallic complex ions to light-sensitive silver halide grains used in heat developable image recording materials, and adding hydrazine derivatives to the light-sensitive materials. However, in all of them, silver bromide is used as the light-sensitive silver halide, so that they have the problem that the Dmin in the UV region, the wavelength of a light source used in printing to a press plate, is too high to use for plate making. The Dmin in the UV region can be reduced by increasing the content of silver chloride. However, this has raised the problems that fog is liable to occur, that no hard image is obtained, and that it is difficult to obtain high Dmax.

SUMMARY OF THE INVENTION

It is therefore an object of the present invention to provide a photothermographic material for a photomechanical process, particularly a scanner or an image setter, which is high in contrast and can provide an image low in Dmin by UV light.

This object has been attained by the following means:

(1) A photothermographic material comprising a support having provided thereon a light-insensitive organic silver salt, a light-sensitive silver halide formed independently of the light-insensitive organic silver salt, and a binder, wherein the main binder of an image formation layer containing the light-sensitive silver halide is a polymer latex having a glass transition temperature of 40° C. or less, said image formation layer is formed by applying a coating solution in which 60% by weight or more of a solvent is water, and the light-sensitive silver halide is gold-sensitized silver halide grains having a silver chloride content of 80 mol % or more per silver halide;

(2) A photothermographic material comprising a support having provided thereon a light-insensitive organic silver salt, a light-sensitive silver halide formed independently of the light-insensitive organic silver salt, and a binder, wherein the main binder of an image formation layer containing the light-sensitive silver halide is a polymer latex having a glass transition temperature of 40° C. or less, said image formation layer is formed by applying a coating solution in which 60% by weight or more of a solvent is water, and the light-sensitive silver halide is silver halide grains having a silver chloride content of 80 mol % or more per silver halide and localized phases of silver bromide on surfaces thereof;

(3) The photothermographic material described in (2), wherein the light-sensitive silver halide is gold sensitized;

(4) The photothermographic material described in any one of (1) to (3), wherein the image formation layer or a layer adjacent thereto contains a hydrazine compound;

(5) A photothermographic material comprising a support having provided thereon a light-insensitive organic silver salt, a light-sensitive silver halide formed independently of the light-insensitive organic silver salt, and a binder, wherein the main binder of an image formation layer containing the light-sensitive silver halide is a polymer latex having a glass transition temperature of 40° C. or less, said image formation layer is formed by applying a coating solution in which 60% by weight or more of a solvent is water, the light-sensitive silver halide is added in preparing the coating solution and is silver halide grains having a silver chloride content of 50 mol % or more per silver halide, and at least one metal or metal complex belonging to group VII or VIII in the periodic table is contained in said silver halide grains;

(6) The photothermographic material described in (5), wherein said metal or metal complex contained in the light-sensitive silver halide is selected from the group consisting of rhodium, rhenium, ruthenium, osmium, iridium and complexes thereof;

(7) The photothermographic material described in (5) or (6), wherein the silver chloride content is 70 mol % or more per light-sensitive silver halide;

(8) The photothermographic material described in any one of (5) to (7), wherein the light-sensitive silver halide is chemically sensitized; and (9) The photothermographic material described in any one of (5) to (8), wherein the image formation layer or another layer adjacent thereto contains a hydrazine compound.

DETAILED DESCRIPTION OF THE INVENTION

Figure 1:
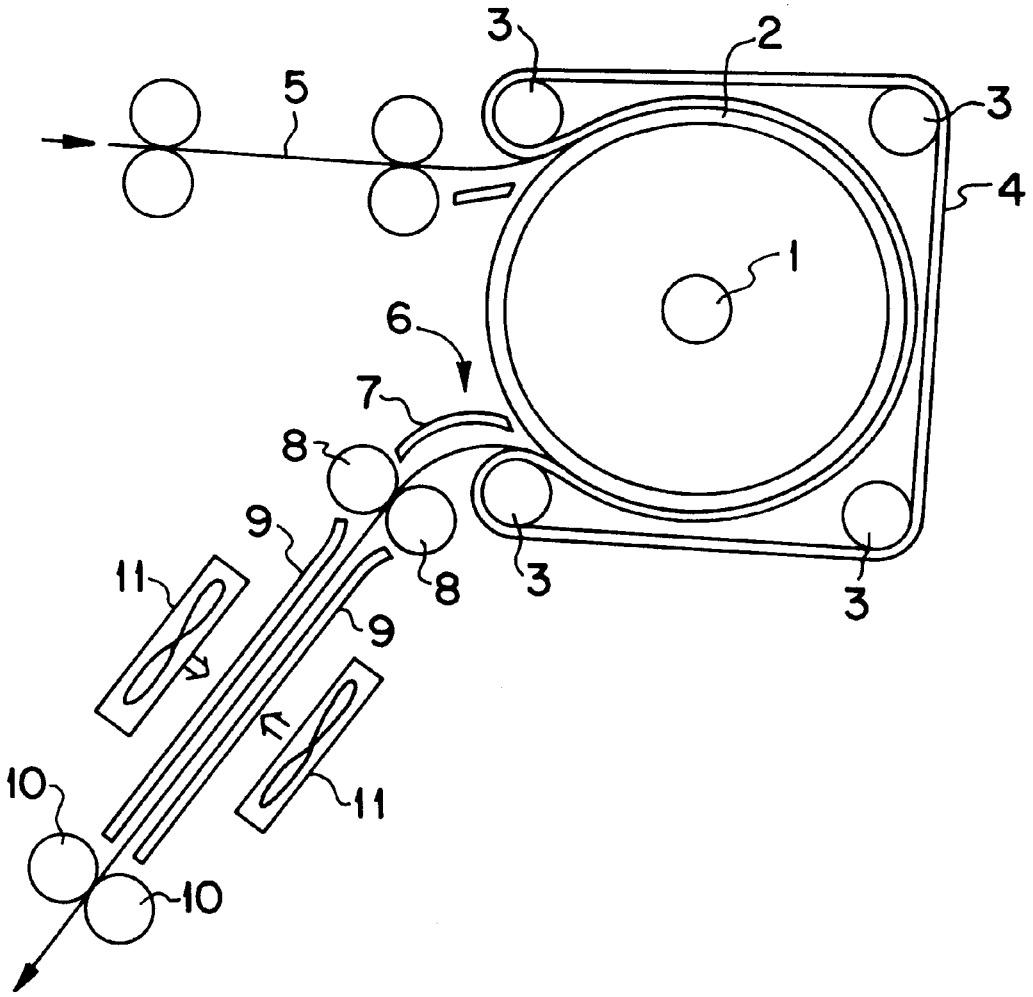
FIG. 1 is a side view showing a developing machine used in Examples.

The present invention will be described below in more detail.

The light-sensitive silver halide used in the first aspect (the above (1) to (4)) of the present invention has a high silver chloride content of 80 mol % or more, preferably 85 mol % or more, and comprises silver chloride, silver chlorobromide and silver iodochlorobromide. The high silver chloride grains used in the present invention are required to be gold sensitized, or to have silver bromide-localized phases on surfaces thereof in a relatively high silver bromide content compared with a substrate, or to have both the characteristics in combination. Preferred examples of the localized structures may be thin grain-like structures, or ones having the localized phases on edges or corners of crystalline surfaces of the grains, or on the crystalline surfaces in the projected form. For the halogen composition of the localized phases, the silver bromide content is from 10 mol % to 95 mol %, preferably from 15 mol % to 90 mol %, and more preferably from 20 mol % to 60 mol %.

These localized phases preferably account for 0.03 mol % to 20 mol % of the silver halides constituting the whole silver halide grains, and more preferably account for 0.1 mol % to 15 mol % thereof. The localized phase is not required to be composed of a single halogen composition. The silver halide grains may have two or more kinds of localized phases clearly different in the silver bromide content. Further, the interface of the localized phase and a phase other than the localized phase may be formed while continuously changing in halogen composition.

The silver bromide-localized phases as described above can be formed by reacting emulsions containing already formed silver halide or high silver chloride grains with water-soluble halogen salts containing water-soluble silver salts and water-soluble bromides by the double jet process to precipitate the silver bromide-localized phases, by partially converting already formed silver halide or high silver chloride grains to silver bromide-rich phases by the so-called halogen conversion process, or by adding fine silver bromide or high silver bromide grains having a grain size equal to or less than that of silver halide or high silver chloride grains, and other slightly soluble silver salts to recrystallize silver bromide on surfaces of the silver chloride or high silver chloride grains.

Such manufacturing methods are also described, for example, in European Patent 273,430.

The silver bromide content of the localized phases can be analyzed by the X-ray diffraction method (for example, described in *Shin Jikken Kagaku Koza* (*New Experimental Chemistry Course*) 6, *Structural Analysis,* edited by The Chemical Society of Japan, Maruzen) or the XPS method (for example, described in *Surface Analysis, IMA,-Application of Auger Electron.Photoelectron Spectroscopy-*, Kodansha). Further, the silver bromide-localized phases can also be known under an electron microscope or by a method described in European Patent 273,430 mentioned above.

Of these manufacturing methods, a particularly useful method for forming silver bromide-localized phases in the present invention is a method of forming silver bromide in grains or on surfaces of high silver chloride grains in chemical ripening. Specifically, in terms of high sensitivity and low fog, it is preferred that fine silver bromide or silver chlorobromide grains having a higher solubility than that of high silver chloride grains are added to form localized phases of silver bromide or silver chlorobromide on the high silver chloride grains.

The light-sensitive silver halide used in the second aspect (the above (5) to (9)) of the present invention has a high silver chloride content of 50 mol % or more, preferably 70 mol % or more, and comprises silver chloride, silver chlorobromide and silver iodochlorobromide. The distribution of the halogen composition in the grain may be uniform, vary stepwise, or vary continuously. Silver chlorobromide or silver iodochlorobromide grains whose insides have a higher silver chloride content can be preferably used. Further, silver halide grains having the core/shell structure can be preferably used. Double to fivefold structure type core/shell grains can be preferably used, and double to fourfold structure type core/shell grains can be more preferably used. Furthermore, silver bromide can be preferably localized on the surfaces of silver chloride or silver chlorobromide grains.

Methods for forming the light-sensitive silver halides of the first and second aspects of the present invention are well known in the art. For example, methods described in *Research Disclosure,* vol. 17029 (June, 1978) and U.S. Pat. No. 3,700,458 can be used. Specific examples of the methods which can be used in the present invention include a method of adding a halogen-containing compound to a prepared organic silver salt, thereby partially converting silver of the organic silver salt to a light-sensitive silver halide and a method comprising preparing light-sensitive silver halide grains by adding a silver supplying compound and a halogen supplying compound to a gelatin solution or another polymer solution, and mixing the resulting silver halide grains with an organic silver salt. In the present invention, the latter method can be preferably used. For inhibiting white turbidity after image formation, it is preferred that the grain size of the light-sensitive silver halide is small. Specifically, the grain size is preferably 0.20 $\mu$m or less, more preferably from 0.01 $\mu$m to 0.15 $\mu$m, and most preferably from 0.02 $\mu$m to 0.12 $\mu$m. The term "grain size" as used herein means the length of an edge of a silver halide grain, when the silver halide grain is a normal crystal such as a cube or octahedron. When the silver halide grain is a tabular grain, the grains size means the diameter of a circle having the same area as a projected area of a main surface. Besides, when the grain is not a normal crystal, such as a spherical or rod-like grain, the grain size means the diameter of a sphere having the same volume as that of the silver halide grain.

The form of the silver halide grains may be cubic, octahedral, tabular, spherical, rod-like or potato-like. In the present invention, however, cubic or tabular grains are particularly preferred. When the tabular silver halide grains are used, the mean aspect ratio thereof is preferably from 100:1 to 2:1, and more preferably from 50:1 to 3:1. Further, silver halide grains having rounded corners can also be preferably used. There is no particular limitation on the index of plane (Miller indices) of outer surfaces of the light-sensitive silver halide grains. However, it is preferred that the ratio of the (100) face is high, said (100) face having high spectral sensitization efficiency when a spectral sensitizing dye is adsorbed thereby. The ratio is preferably 50% or more, more preferably 65% or more, and most preferably 80% or more. The ratio of the (100) face can be determined by a method described in T. Tani, *Imaging Sci.,* 29, 165 (1985), utilizing adsorption dependency of the (111) face and the (100) face in adsorption of a sensitizing dye.

The light-sensitive silver halide grains of the first aspect of the present invention preferably contain a metal of group VII or VIII in the periodic table.

The light-sensitive silver halide grains of the second aspect of the present invention contain a metal or metal complex of group VII or VIII in the periodic table. The metals or main metals of the metal complexes of group VII or VIII in the periodic table are rhodium, rhenium, ruthenium, osmium and iridium. These metal complexes may be used either alone or as a combination of two or more of the same kind or different kinds of complexes. The content thereof is preferably from $10^{-9}$ mol to $10^{-3}$ mol, and more preferably from $10^{-8}$ mol to $10^{-4}$ mol, per mol of silver. As to the specific structures thereof, metal complexes having structures described in JP-A-7-225449 can be used.

In the present invention, water-soluble rhodium compounds can be used as the rhodium compounds. Examples thereof include rhodium (III) halide compounds or rhodium complex salts having halogens, amines, oxalato or the like as ligands, for example, hexachlororhodate (III) complex salts, pentachloroaquorhodate (III) complex salts, tetrachlorodiaquorhodate (III) complex salts, hexabromorhodate (III) complex salts, hexamminerhodate (III) complex salts and trioxalatorhodate (III) complex salts. These rhodium compounds are used by dissolving them in water or appropriate solvents. In order to stabilize the solution of the rhodium compound, a method of adding an aqueous solution of a hydrogen halide (for example, hydrochloric acid, hydrobromic acid or hydrofluoric acid) or an alkali halide (for example, KCl, NaCl, KBr or NaBr), which is generally frequently used, can be used. Instead of use of the water-soluble rhodium, it is also possible to add and dissolve other silver halide grains previously doped with rhodium in preparing the silver halide.

The amount of these rhodium compounds added is preferably from $1\times10^{-8}$ mol to $5\times10^{-6}$ mol, and particularly preferably from $5\times10^{-8}$ mol to $1\times10^{-6}$ mol, per mol of silver halide.

These compounds can be appropriately added in preparing the silver halide emulsion grains and in each stage prior to coating of the emulsions. In particular, the compounds are preferably added in forming the emulsions to incorporate them into the silver halide grains.

Rhenium, ruthenium and osmium which can be used in the present invention are added in the form of water-soluble complex salts described in JP-A-63-2042, JP-A-1-285941, JP-A-2-20852 and JP-A-2-20855. Particularly preferred examples thereof include six-coordinate complexes represented by the following formula:

$$[ML_6]^{n-}$$

wherein M represents Ru, Re or Os, n represents 0, 1, 2, 3 or 4, and L represents a ligand.

In this case, counter ions have no importance, and ammonium or alkali metal ions are used as the counter ions.

Preferred examples of ligands include halide ligands, cyanide ligands, cyanate ligands, nitrosyl ligands and thionitrocyl ligands. Specific examples of the complexes used in the present invention are shown below, but the scope of the invention is not limited thereto.

$[ReCl_6]^{3-}$, $[ReBr_6]^{3-}$, $[ReCl_5(NO)]^{2-}$, $[Re(NS)Br_5]^{2-}$, $[Re(NO)(CN)_5]^{2-}$, $[Re(O)_2(CN)_4]^{3-}$, $[RuCl_6]^{3-}$, $[RuCl_4(H_2O)_2]^{1-}$, $[RuCl_5(H_2O)]^{2-}$, $[RuCl_5(NO)]^{2-}$, $[RuBr_5(NS)]^{2-}$, $[Ru(CO)_3Cl_3]^{2-}$, $[Ru(CO)Cl_5]^{2-}$, $[Ru(CO)Br_5]^{2-}$, $[OSCl_6]^{3-}$, $[OsCl_5(NO)]^{2-}$, $[Os(NO)(CN)_5]^{2-}$, $[Os(NS)Br_5]^{2-}$, $[Os(O)_2(CN)_4]^{4-}$

The amount of these compounds added is preferably from $1\times10^{-9}$ mol to $1\times10^{-5}$ mol, and particularly preferably from $1\times10^{-8}$ mol to $1\times10^{-6}$ mol, per mol of silver halide.

These compounds can be appropriately added in preparing the silver halide emulsion grains and in each stage prior to coating of the emulsions. In particular, the compounds are preferably added in forming the emulsions to incorporate them into the silver halide grains.

Methods for adding these compounds in forming the silver halide grains to incorporate them into the silver halide grains include a method of adding a metal complex powder or an aqueous solution in which the compound is dissolved together with NaCl and KCl to a water-soluble salt or a water-soluble halide solution during grain formation, a method of adding the compound as the third solution, when a silver salt and a halide solution are concurrently mixed, to prepare the silver halide grains by concurrent mixing of three solutions, and a method of putting a necessary amount of an aqueous solution of the metal complex into a reaction vessel during grain formation. In particular, the method of adding the powder or the aqueous solution in which the compound is dissolved together with NaCl and KCl to the water-soluble halide solution is preferred.

For adding the compound to the surfaces of the grains, a necessary amount of an aqueous solution of the metal complex can also be put into a reaction vessel immediately after grain formation, during or at the end of physical ripening, or in chemical ripening.

In the present invention, various iridium compounds can be used. Examples thereof include hexachloroiridium, hexammineiridium, trioxalatoiridium, hexacyanoiridium and pentachloronitrosyl-iridium. These iridium compounds are used by dissolving them in water or appropriate solvents. In order to stabilize the solution of the iridium compound, a method of adding an aqueous solution of a hydrogen halide (for example, hydrochloric acid, hydrobromic acid or hydrofluoric acid) or an alkali halide (for example, KCl, NaCl, KBr or NaBr), which is generally frequently used, can be used. Instead of use of the water-soluble iridium, it is also possible to add and dissolve other silver halide grains previously doped with iridium in preparing the silver halide.

The silver halide grains used in the first and second aspects of the present invention may further contain metal atoms such as cobalt, iron, nickel, chromium, palladium, platinum, gold, thallium, copper and lead. As to compounds of cobalt, iron, chromium and further ruthenium, hexacyano metal complexes can be preferably used. Specific examples thereof include but are not limited to a ferricyanate ion, a ferrocyanate ion, a hexacyanocobaltate ion, a hexacyanochromate ion and a hexacyanoruthenate ion. There is no particular limitation on a metal complex-containing phase in the silver halide grain. The metal complex may be uniformly contained in the grain, or may be contained at a high concentration in a core portion or a shell portion.

The above-mentioned metals are preferably contained in an amount of $1\times10^{-9}$ mol to $1\times10^{-4}$ mol per mol of silver halide. For adding the above-mentioned metals, they can be added as metal salts such as single salts, double salts or complex salts, in preparing the grains.

The light-sensitive silver halide grains can be desalted by washing according to methods known in the art, such as the noodle method and the flocculation method. In the present invention, however, the silver halide grains may be desalted or not.

In gold sensitizers used when the silver halide emulsions of the first aspect of the present invention are subjected to gold sensitization, the oxidation number of gold may be either +I or +III, and gold compounds usually employed as the gold sensitizers can be used. Typical examples thereof include chloroauric acid, potassium chloroaurate, auric trichloride, potassium auric thiocyanate, potassium iodoaurate, tetracyanoauric acid, ammonium aurothiocyanate and pyridyltrichlorogold. Although the amount of the gold sensitizers added vary depending on various conditions, it is from $10^{-7}$ mol to $10^{-3}$ mol, as a guide, and preferably from $10^{-6}$ mol to $5\times10^{-4}$ mol, per mol of silver halide.

When the silver halide emulsions of the first aspect of the present invention are sensitized, gold sensitization is preferably used in combination with different chemical sensitization. As the different chemical sensitization methods, known methods such as sulfur sensitization, selenium sensitization, tellurium sensitization and noble metal sensitization can be used. When they are used in combination with gold sanitization, for example, a combination of sulfur sensitization and gold sensitization, a combination of selenium sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization are preferred.

The silver halide emulsions of the second aspect of the present invention are preferably chemically sensitized. As the chemical sensitization methods, known methods such as sulfur sensitization, selenium sensitization, tellurium sensitization and noble metal sensitization can be used alone or in combination. When they are used in combination, for example, a combination of sulfur-sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization are preferred.

The sulfur sensitization which can be used in the present invention is usually conducted by adding a sulfur sensitizer and stirring an emulsion at a high temperature of 40° C. or more for a definite period of time. As the sulfur sensitizers, known compounds can be used. Examples thereof include various sulfur compounds such as thiosulfates, thiourea compounds, thiazole compounds and rhodanine compounds, as well as sulfur compounds contained in gelatin. Preferred sulfur compounds are thiosulfates and thiourea compounds. Although the amount of the sulfur sensitizers added varies depending on various conditions such as the pH and the temperature in chemical ripening, and the size of silver halide grains, it is from $10^{-7}$ mol to $10^{-2}$ mol, and more preferably from $10^{-5}$ mol to $10^{-3}$ mol, per mol of silver halide.

In the present invention, known selenium compounds can be used as selenium sensitizers. That is, the selenium sensitization is usually conducted by adding an unstable type and/or non-unstable type selenium compound and stirring an emulsion at a high temperature of 40° C. or more for a definite period of time. As the unstable type selenium compounds, compounds described in JP-B-44-15748 (the term "JP-B" as used herein means an "examined Japanese patent publication"), JP-B-43-13489, JP-A-4-25832, JP-A-4-109240 and JP-A-4-324855 can be used. In particular, compounds represented by general formulas (VIII) and (IX) in JP-A-4-324855 are preferably used.

Tellurium sensitizers used in the present invention are compounds producing silver telluride presumed to form a sensitizing nucleus on a surface or in the inside of a silver halide grain. The forming rate of silver telluride in the silver halide emulsion can be tested by a method described in JP-A-5-313284. Examples of the tellurium sensitizers include diacyl tellurides, bis(oxycarbonyl) tellurides, bis (carbamoyl) tellurides, bis(oxycarbonyl) ditellurides, bis (carbamoyl) ditellurides, P=Te bond-containing compounds, tellurocarboxylic acid esters, di(poly)tellurides, tellurides, tellurols, telluroacetals, tellurosulfonates, P-Te bond-containing compounds, Te-containing heterocyclic compounds, tellurocarbonyl compounds, inorganic tellurium compounds and colloidal tellurium. Specifically, compounds can be used which are described in U.S. Pat. Nos. 1,623,499, 3,320,069 and 3,772,031, British Patents 235, 211, 1,121,496, 1,295,462 and 1,396,696, Canadian Patent 800,958, JP-A-4-204640, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), *The Chemistry of Organic Selenium and Tellurium Compounds,* vol. 1, edited by S. Patai (1986) and ibid. vol. 2 (1987). In particular, compounds represented by general formulas (II), (III) and (IV) in JP-A-5-313284 are preferably used.

The amount of the selenium and tellurium sensitizers used in the present invention is generally from $10^{-8}$ mol to $10^{-2}$ mol, and preferably from about $10^{-7}$ mol to about $10^{-3}$ mol, per mol of silver halide, although it varies depending on silver halide grains used and chemical ripening conditions. There is no particular limitation on the conditions of chemical sensitization in the present invention. However, the pH is from 5 to 8, the pAg is from 6 to 11 and preferably from 7 to 10, and the temperature is from 40° C. to 95° C. and preferably from 45° C. to 85° C.

Noble metal sensitizers used in the second aspect of the present invention include gold, platinum, palladium and iridium, and particularly, gold sensitization is preferred. Specific examples of the gold sensitizers used in the present invention include chloroauric acid, potassium chloroaurate, potassium aurithiocyanate and gold sulfide. They can be used in an amount of about $10^{-7}$ mol to about $10^{-2}$ mol per mol of silver halide.

In the course of formation of the silver halide grains and physical ripening, cadmium salts, sulfites, lead salts and thallium salts may be allowed to coexist with the silver halide emulsions used in the first and second aspects of the present invention.

In the present invention, reduction sensitization can be used. Specific examples of compounds which can be used in reduction sensitization include stannous chloride, aminoiminomethanesulfonic acid, hydrazine derivatives, borane compounds, silane compounds and polyamines, as well as ascorbic acid and thiourea dioxide. Further, reduction sensitization can be performed by ripening the emulsions while maintaining the pH of the emulsions at 7 or more, or the pAg thereof at 8.3 or less. Furthermore, reduction sensitization can be conducted by introducing single addition portions of silver ions during grain formation.

Thiosulfonic acid compounds may be added to the silver halide emulsions used in the present invention by a method shown in EP-293,917.

The silver halide emulsions in the light-sensitive materials used in the present invention may be used either alone or as a combination of two or more of them (for example, emulsions different in mean grain size, emulsions different in halogen composition, emulsions different in crystal habit, and emulsions different in the conditions of chemical sensitization).

The amount of the light-sensitive silver halides used in the first and second aspects of the present invention is preferably from 0.01 mol to 0.5 mol, more preferably from 0.02 mol to 0.3 mol, and particularly preferably from 0.03 mol to 0.25 mol, per mol of organic silver salt.

There is no particular limitation on a method and conditions for mixing the light-sensitive silver halide and the organic silver salt separately prepared, as long as the effects of the present invention are sufficiently exhibited. The silver halide grains and the organic silver salt which have each been prepared may be mixed with each other by means of a high-speed stirrer, a ball mill, a sand mill, a colloid mill, a vibrating mill or a homogenizer, or the light-sensitive silver halide which has been prepared may be mixed at any timing during preparation of the organic silver salt to prepare the organic silver salt.

The organic silver salt which can be used in the present invention is relatively stable to light, and is a silver salt forming a silver image when heated to a temperature of 80° C. or more in the presence of an exposed photocatalyst (such as a latent image of the light-sensitive silver halide) and a reducing agent. The organic silver salt may be any organic substance containing a source which can reduce a silver ion. Silver salts of organic acids, particularly silver salts of long-chain aliphatic carboxylic acids (each having 10 to 30 carbon atoms, and preferably 15 to 28 carbon atoms), are preferred. Complexes of organic or inorganic silver salts in which ligands have a complex stabilization constant of 4.0 to 10.0 are also preferred. Silver supplying substances can preferably constitute about 5% to 70% by weight of image formation layers. Preferred examples of the organic silver salts include silver salts of organic compounds having carboxyl groups. Examples thereof include but are not limited to silver salts of aliphatic carboxylic acids and silver salts of aromatic carboxylic acids. Preferred examples of the silver salts of aliphatic carboxylic acids include silver behenate, silver arachidate, silver stearate, silver oleate, silver laurate, silver caproate, silver myristate, silver palmitate, silver maleate, silver fumarate, silver tartrate, silver linoleate, silver butyrate, silver camphorate and mixtures thereof.

Silver salts of compounds having mercapto groups or thione groups, and derivatives thereof can also be utilized. Preferred examples of these compounds include silver salts of 3-mercapto-4-phenyl-1,2,4-triazole, 2-mercaptobenzimidazole, 2-mercapto-5-aminothiazole and 2-(ethylglycolamido)benzo-thiazole, silver salts of thioglycolic acids such as S-alkylthioglycolic acids (wherein alkyl groups each has 12 to 22 carbon atoms), silver salts of dithiocarboxylic acids such as dithioacetic acid, and silver salts of thioamides, 5-carboxyl-1-methyl-2-phenyl-4-thiopyridine, mercaptotriazine and 2-mercaptobenzoxazole, silver salts described in U.S. Pat. No. 4,123,274, for example, silver salts of 1,2,4-mercaptothiazole derivatives such as 3-amino-5-benzylthio-1,2,4-thiazole described in U.S. Pat. No. 3,301,678, and silver salts of thione compounds such as 3-(3-carboxyethyl)-4-methyl-4-thiazoline-2-thione. Further, imino group-containing compounds can also be used. Preferred examples of these compounds include silver salts of benzotriazole and derivatives thereof, for example, silver salts of benzotriazole derivatives such as methylbenzotriazole silver, silver salts of halogen-substituted benzotriazoles such as 5-chlorobenzotriazole silver, silver salts of 1,2,4-triazole and 1-H-tetrazole as described in U.S. Pat. No. 4,220,709, and silver salts of imidazole and imidazole derivatives. For example, various silver acetylide compounds as described in U.S. Pat. Nos. 4,761,361 and 4,775,613 can also be used.

Although there is no particular limitation on the form of the organic silver salts which can be used in the present invention, needle crystals having short and long axes are preferred. In the present invention, a needle crystal having a length of the short axis of 0.01 μm to 0.20 μm and a length of the long axis of 0.10 μm to 5.0 μm is preferred, and a crystal having a length of the short axis of 0.01 μm to 0.15 μm and a length of the long axis of 0.10 μm to 4.0 μm is more preferred. The organic silver salt is preferably monodispersed. The term "monodispersed" means that the percentage of a value of the standard deviation of each length of the short and long axes divided by each the short and long axes is preferably 100% or less, more preferably 80% or less, and most preferably 50% or less. The form of the organic silver salts can be measured by images of organic silver salt dispersions observed under a transmission electron microscope. As another method for measuring the monodispersibility, there is a method of determining the standard deviation of volume weighted average diameters of the organic silver salt. The percentage (coefficient of variation) of values divided by volume weighted average diameters is preferably 100% or less, more preferably 80% or less, and most preferably 50% or less. This can be determined, for example, from particle sizes (volume weighted average diameters) determined by irradiating laser light to the organic silver salt dispersed in a solution and determining the autocorrelation function to changes in fluctuation of its scattered light with time.

The organic silver salts which can be used in the present invention can be preferably desalted. There is no particular limitation on desalting methods, and known methods can be used. Known filtration methods such as centrifugal filtration, suction filtration, ultrafiltration and flocculation washing by aggregation can be preferably used.

For obtaining small-sized fine particles with no coagulation, the organic silver salts which can be used in the present invention are dispersed by use of dispersing aids to form fine solid particle dispersions. The fine solid particles of the organic silver salts can be mechanically dispersed by known means for dispersing fine particles (for example, ball mills, vibrating ball mills, planetary ball mills, sand mills, colloid mills, jet mills and roller mills) in the presence of dispersing aids.

When the organic silver salts are dispersed by use of the dispersing agents to form fine solid particles, the dispersing aids can be used which are appropriately selected from synthetic anionic polymers such as polyacrylic acid, acrylic copolymers, maleic copolymers, maleic monoester copolymers and acryloylmethylpropanesulfonic acid copolymers, semi-synthetic anionic polymers such as carboxymethyl starch and carboxymethyl cellulose, anionic polymers such as alginic acid and pectic acid, anionic surfactants described in JP-A-52-92716 and W088/04794, compounds described in Japanese Patent Application No. 7-350753, known anionic, nonionic and cationic surfactants, known polymers such as polyvinyl alcohol, polyvinyl pyrrolidone, carboxymethyl cellulose, hydroxypropyl cellulose and hydroxypropylmethyl cellulose, and naturally occurring polymer compounds such as gelatin.

The dispersing aid is generally mixed with a powder or a wet cake of the organic silver salt before dispersion, and the resulting mixture is supplied to a dispersing device. However, the organic silver salt with the dispersing aid previously mixed therewith may be heat treated or treated with a solvent to form a powder or a wet cake of the organic silver salt. The pH may be controlled with an appropriate pH adjusting agent before, after or during dispersion.

In addition to mechanical dispersion, the organic silver salt may be roughly dispersed in a solvent by pH control, and then, the pH may be changed in the presence of the dispersing aid to form finely divided particles. In this case, an organic solvent may be used for dispersion, and usually removed after formation of the finely divided particles.

The dispersions thus prepared can be stored with stirring or in a high viscous state using hydrophilic colloids (for example, in a jelly-like state using gelatin), for inhibiting precipitation of the fine particles in storage. Further, in order to prevent the propagation of bacteria in storage, preservatives can also be added.

In the present invention, the organic silver salts can be used in a desired amount. However, they are used preferably in an amount of 0.1 $g/m^2$ to 5 $g/m^2$, and more preferably in an amount of 1 $g/m^2$ to 3 $g/m^2$, in terms of silver.

It is preferred that the heat image forming materials of the present invention contain reducing agents for the organic silver salts. The reducing agents for the organic silver salts may be any substances for reducing a silver ion to metallic silver, and preferably organic substances. Although conventional photographic developing agents such as phenidone, hydroquinone and cathecol are useful, hindered phenol reducing agents are preferred. The reducing agent is contained preferably in an amount of 5 mol % to 50 mol %, and more preferably in an amount of 10 mol % to 40 mol %, per mol of silver of a face having an image formation layer. The reducing agent may be added to any layers of the face having the image formation layer. When the reducing agent is added to a layer other than the image formation layer, it is preferably used in such a larger amount as 10 mol % to 50 mol % per mol of silver. Further, the reducing agent may be a so-called precursor which is derived so as to effectively function only in development.

A wide variety of reducing agents used in the photothermographic materials employing the organic silver salts are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent 2,321,328 and European Patent 692,732. Examples thereof include amidooximes such as phenylamido-oxime, 2-thienylamidooxime and p-phenoxyphenylamidooxime; azines such as 4-hydroxy-3,5-dimethoxybenzaldehydeazine; combinations of aliphatic carboxylic acid arylhydrazides and ascorbic acid such as a combination of 2,2'-bis(hydroxy-methyl)propionyl-β-phenylhydrazine and ascorbic acid; combinations of polyhydroxybenzene and hydroxylamine compounds, reductones and/or hydrazines (for example, a combination of hydroquinone and bis(ethoxyethyl)hydroxyl-amine, piperidinohexosereductone or formyl-4-methylphenyl-hydrazine); hydroxamic acids such as phenylhydroxamic acid, p-hydroxyphenylhydroxamic acid and β-anilinehydroxamic acid; combinations of azines and sulfonamidophenols (for example, a combination of phenothiazine and 2,6-dichloro-4-benzene-sulfonamidophenol); α-cyanophenylacetic acid derivatives such as ethyl-α-cyano-2-methylphenyl acetate and ethyl-α-cyanophenyl acetate; bis-β-naphthols such as 2,2'-dihydroxy-1,1'-bisnaphthyl, 6,6'-dibromo-2,2'-dihydroxy-1,1'-binaphthyl and bis(2-hydroxy-1-naphthyl) methane; combinations of bis-β-naphthols and 1,3-dihydroxybenzene derivatives (for example, 2,4-dihydroxybenzophenone or 2',4'-dihydroxyacetophenone); 5-pyrazolone derivatives such as 3-methyl-1-phenyl-5-pyrazolone; reductones such as dimethylaminohexosereductone, anhydrodihydroaminohexosereductone and anhydrodihydropiperidonehexosereductone; sulfonamidophenol reducing agents such as 2,6-dichloro-4-benzenesulfonamidophenol and p-benzenesulfonamidophenol; 2-phenylindane-1,3-dione; chroman derivatives such as 2,2-dimethyl-7-t-butyl-6-hydroxychroman; 1,4-dihydropyridine derivatives such as 2,6-dimethoxy-3,5-dicarboethoxy-1,4-dihydropyridine; bisphenols (for example, bis(2-hydroxy-3-t-butyl-5-methylphenyl)methane, 2,2-bis(4-hydroxy-3-methylphenyl) propane, 4,4-ethylidene-bis(2-t-butyl-6-methylphenol), 1,1-bis(2-hydroxy-3,5-dimethylphenyl)-3,5,5-trimethylhexane and 2,2-bis(3,5-dimethyl-4-hydroxyphenyl)-propane); ascorbic acid derivatives (for example, 1-ascorbyl palmitate and ascorbyl stearate); aldehydes and ketones of benzyl and biacetyl; 3-pyrazolidone and some kind of indane-1,3-dione; and chromanols (such as tocopherol). Bisphenols and chromanols are particularly preferred.

The reducing agents used in the present invention may be added in any forms such as solutions, powders or fine solid particle dispersions. The fine solid particles are dispersed by known finely dividing means (for example, ball mills, vibrating ball mills, sand mills, colloid mills, jet mills and roller mills). Further, dispersing aids may be used in dispersing the fine solid particles.

When an additive known as a "color toning agent" for improving an image is contained, the optical density is sometimes increased. Further, the color toning agent also becomes advantageous for forming a black silver image in some cases. The color toning agent is contained in a face having the image formation layer preferably in an amount of 0.1 mol % to 50 mol %, and more preferably in an amount of 0.5 mol % to 20 mol %, per mol of silver. The color toning agent may be a precursor which is derived so as to effectively function only in development.

A wide variety of color toning agents used in the photothermographic materials employing the organic silver salts are disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent 1,380,795 and Belgian Patent 841,910. Examples of the color toning agents include phthalimide and N-hydroxyphthalimide; cyclic imides such as succinimide, pyrazoline-5-one, 1-phenylurazole, quinazoline and 2,4-thiazolidinedione; naphthalimides (for example, N-hydroxy-1,8-naphthalimide); cobalt complexes (for example, cobalthexamine trifluoroacetate); mercaptans (3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides (for example, (N,N-dimethylaminomethyl)phthalimide and N,N-(dimethylamino-methyl)naphthalene-2,3-dicarboxyimide);blocked pyrazole, isothiuronium derivatives, and some kinds of light fading agents (for example, N,N'-hexamethylenebis(1-carbamoyl-3,5-dimethylpyrazole), 1,8-(3,6-diazaoctane)bis(isothiuronium trifluoroacetate) and 2-tribromomethylsulfonyl(benzothiazole)); 3-ethyl-5-[(3-ethyl-2-benzothiazolinylidene)-1-methylethylidene]-2-thio-2,4-oxazolidinedione; phthalazinone, phthalazinone derivatives such as 4-(1-naphthyl)-phthalazinone, 6-chloro-phthalazinone, 5,7-dimethoxy-phthalazinone and 2,3-dihydro-1,4-phthalazinedione, or metal salts thereof; combinations of phthalazinone and phthalic acid derivatives (for example, phthalic acid, 4-methyl-phthalic acid, 4-nitrophthalic acid and tetrachlorophthalic anhydride); phthalazine, phthalazine derivatives such as 4-(1-naphthyl)phthalazine, 6-chlorophthalazine, 5,7-dimethoxy-phthalazine and 2,3-dihydrophthalazine, or metal salts thereof, combinations of phthalazine and phthalic acid derivatives (for example, phthalic acid, 4-methylphthalic acid, 4-nitrophthalic acid and tetrachlorophthalic anhydride); quinazolinedione, benzoxazine or naphthoxazine derivatives; rhodium complexes which function not only as the color toning agents, but also as sources of halide ions for silver halide formation, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-dione derivatives such as 1,3-benzoxazine-2,4-dione, 8-methyl-1,3-benzoxazine-2,4-dione and 6-nitro-1,3-benzoxazine-2,4-dione; pyrimidine and asymmetric triazine derivatives (for example, 2,4-dihydroxypyrimidine and 2-hydroxy-4-aminopyrimidine); and azauracil and tetraaza-pentalene derivatives (for example, 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraaza-pentalene).

The color toning agents used in the present invention may be added in any forms such as solutions, powders or fine solid particle dispersions. The fine solid particles are dispersed by known finely dividing means (for example, ball mills, vibrating ball mills, sand mills, colloid mills, jet mills and roller mills). Further, dispersing aids may be used in dispersing the fine solid particles.

It is preferred that at least one layer of the image formation layers of the present invention contains a polymer latex described below in an amount of 50% by weight or more based on the total binder (this image formation layer is hereinafter referred to as an "image formation layer of the present invention", and the polymer latex used in the binder is hereinafter referred to as a "polymer latex of the present invention"). The polymer latex may be used not only in the image formation layer, but also in a protective layer or a back layer. In particular, when the photothermographic material of the present invention is used for printing application in which changes in dimension cause trouble, it is necessary to use the polymer latex also in the protective layer or the back layer. The term "polymer latex" as used herein means a latex in which a water-insoluble hydrophobic polymer is dispersed in a water-soluble dispersion medium as fine particles.

The latex may be dispersed in any state, such as a state in which the polymer is dispersed in the dispersing medium, an emulsion-polymerized state, a micelle-dispersed state or a state in which the polymer molecule partly has a hydrophilic structure and a molecular chain itself is molecularly dispersed. The latexes of the present invention are described in *Synthetic Resin Emulsions,* edited by Taira Okuda and Hiroshi Inagaki, published by Kobunshi Kankokai (1978), *Application of Synthetic Latexes,* edited by Takaaki Sugimura, Yasuo Kataoka, Soichi Suzuki and Keiji Kasahara, published by Kobunshi Kankokai (1993) and Soichi Muroi, *Chemistry of Synthetic Latexes,* published by Kobunshi Kankokai (1970).

The average particle size of the dispersed particles is preferably from 1 nm to 50,000 nm, and more preferably from about 5 nm to about 1,000 nm. There is no particular limitation on the particle size distribution of the dispersed particles, and they may have either a wide particle size distribution or a monodisperse particle size distribution.

The latex may be a so-called core/shell type latex, as well as a conventional latex having an uniform structure. In this case, it is sometimes preferred that the core component differs from the shell component in the glass transition temperature.

The polymer latexes used in the binders of the present invention for the protective layers and the back layers differ from those for the image formation layers in the preferred range of their glass transition temperature (Tg). For the image formation layers, the glass transition temperature is preferably 40° C. or less, and more preferably from −30° C. to 40° C., for enhancing diffusion of photographic useful materials in heat development. When the latexes are used in the protective layers and the back layers, the glass transition temperature thereof is preferably from 25° C. to 70° C., because the layers come into contact with various instruments.

The minimum film forming (filming) temperature (MFT) of the polymer latexes of the present invention is preferably from −30° C. to 90° C., and more preferably from 0° C. to 70° C.. For controlling the minimum film forming temperature, film forming assistants may be added. The film forming assistants are also called plasticizers, and organic compounds (usually, organic solvents) lowering the minimum film forming temperature of the polymer latexes. Examples thereof are described in "Soichi Muroi, *Chemistry of Synthetic Latexes,* published by Kobunshi Kankokai (1970)" mentioned above.

Examples of polymers used in the polymer latexes of the present invention include acrylic resins, vinyl acetate resins, polyester resins, polyurethane resins, rubber resins, vinyl chloride resins, vinylidene chloride resins, polyolefin resins and copolymers thereof. The polymer may be either a straight chain polymer or a branched polymer, and may be crosslinked. Further, the polymer may be either a so-called homopolymer in which a single monomer is polymerized, or a copolymer in which two or more kinds of monomers are polymerized. The copolymer may be either a random copolymer or a block copolymer. The number average molecular weight of the polymer is preferably from 5,000 to 1,000,000, and more preferably from about 10,000 to about 100,000. Too low a molecular weight unfavorably results in insufficient mechanical strength of the image formation layer, whereas too high a molecular weight causes poor film forming properties.

Specific examples of the polymer latexes used as the binders for the image formation layers of the photothermographic materials of the present invention include latexes of methyl methacrylate/ethyl acrylate/methacrylic acid copolymers, latexes of methyl methacrylate/2-ethylhexyl acrylate/styrene/acrylic acid copolymers, latexes of styrene/butadiene/acrylic acid copolymers, latexes of styrene/butadiene/divinylbenzene/meth-acrylic acid copolymers, latexes of methyl methacrylate/vinyl chloride/acrylic acid copolymers and latexes of vinylidene chloride/ethyl acrylate/acrylonitrile/methacrylic acid copolymers. Such polymers are commercially available, and the following polymers can be utilized. For example, the acrylic acid resins include Cevian A-4635, 46583 and 4601 manufactured by Daicel Chemical Industries, Ltd. and Nipol Lx 811, 814, 821, 820 and 857 manufactured by Nippon Zeon Co., Ltd., the polyester resins include FINETEX ES 650, 611, 675 and 850 manufactured by Dainippon Ink & Chemicals, Inc. and WD-size and WMS manufactured by Eastman Chemical Co., the polyurethane resins include HYDRAN AP 10, 20, 30 and 40 manufactured by Dainippon Ink & Chemicals, Inc., the rubber resins include LACSTAR 7310K, 3307B, 4700H and 7132C manufactured by Dainippon Ink & Chemicals, Inc. and Nipol Lx 416, 410, 438C and 2507 manufactured by Nippon Zeon Co., Ltd., the vinyl chloride resins include G351 and G576 manufactured by Nippon Zeon Co., Ltd., the vinylidene chloride resins include L502 and L513 manufactured by Asahi Chemical Industry Co., Ltd., and the polyolefin resins include Chemipearl S120 and SA100 manufactured by Mitsui Petrochemical Industries, Ltd. These polymers may be used either alone or as a mixture of two or more of them as required.

In the image formation layer of the present invention, the above-mentioned latex occupies 50% by weight or more, and preferably 70% by weight or more, of the total binder.

This image formation layer may further contain a hydrophilic polymer such as gelatin, polyvinyl alcohol, methyl cellulose, hydroxypropyl cellulose, carboxymethyl cellulose or hydroxypropylmethyl cellulose in an amount of 50% by weight or less, preferably 10% by weight or less, of the total binder. The amount of the hydrophilic polymer added is preferably 30% by weight or less, and more preferably 5% by weight, of the total binder of the image formation layer.

The image formation layer of the present invention is preferably prepared by applying an aqueous coating solution and drying it. The term "aqueous" as used herein means that 60% by weight or more of a solvent (dispersion medium) of the coating solution is water. Components other than water which can be used in the coating solution include water-miscible organic solvents such as methyl alcohol, ethyl alcohol, isopropyl alcohol, methyl cellosolve, ethyl cellosolve, dimethylformamide and ethyl acetate. Specific examples of solvent compositions include water/methanol=90/10, water/methanol=70/30, water/ethanol=90/10, water/isopropanol=90/10, water/dimethylformamide=95/5, water/methanol/dimethyl-formamide=80/15/5 and water/methanol/dimethylformamide=90/5/5 (wherein the numerals represent percentages by weight.

The total binder amount of the image formation layers of the present invention is preferably from 0.2 g/m$^2$ to 30 g/m$^2$, and more preferably from 1 g/m$^2$ to 15 g/m$^2$. The image formation layers of the present invention may contain crosslinking agents for crosslinking and surfactants for improving coating properties.

It is preferred that the photothermographic materials of the present invention contain hydrazine derivatives. The hydrazine derivatives used in the present invention are preferably compounds represented-by the following general formula (H):

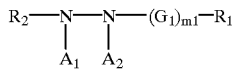

(H)

wherein $R_1$ represents a hydrogen atom or a block group; $R_2$ represents an aliphatic group, an aromatic group or a heterocyclic group; $G_1$ represents —CO—, —COCO—, —C═S—, —$SO_2$—, —SO—, —PO($R_3$)— (wherein $R_3$ is selected from the same groups as defined for $R_1$ and may be different from $R_1$), a thiocarbonyl group or an iminomethylene group; $A_1$ and $A_2$ are both hydrogen atoms, or one represents a hydrogen atom and the other represents a substituted or unsubstituted alkylsulfonyl groups, a substituted or unsubstituted arylsulfonyl group, or a substituted or unsubstituted acyl group; $m_1$ is 0 or 1; and when $m_1$ is 0, $R_1$ represents an aliphatic group, an aromatic group or a heterocyclic group.

In general formula (H), the aliphatic group represented by $R_2$ is preferably a substituted or unsubstituted, straight chain, branched or cyclic alkyl, alkenyl or alkynyl group having 1 to 30 carbon atoms.

In general formula (H), the aromatic group represented by $R_2$ is a monocyclic or condensed cyclic aryl group, and for example, a benzene ring or a naphthalene group. The heterocyclic group represented by $R_2$ is a monocyclic or condensed cyclic, saturated or unsaturated, aromatic or non-aromatic heterocyclic group. Examples thereof include pyridine, pyrimidine, imidazole, pyrazole, quinoline, isoquinoline, benzimidazole, thiazole, benzothiazole, piperidine, triazine, morpholino and piperazine rings.

$R_2$ is preferably an aryl group or an alkyl group.

$R_2$ may be substituted, and typical examples of the substituent groups include halogen atoms (fluorine, chlorine, bromine and iodine), alkyl (including aralkyl, cycloalkyl and active methine), alkenyl, alkynyl, aryl, heterocyclic, quaternized nitrogen atom-containing heterocyclic (for example, pyridinio), acyl, alkoxycarbonyl, aryloxycarbonyl, carbamoyl, carboxyl or salts thereof, sulfonylcarbamoyl, acylcarbamoyl, sulfamoylcarbamoyl, carbazoyl, oxalyl, oxamoyl, cyano, thiocarbamoyl, hydroxyl, alkoxyl (including groups repeatedly containing ethyleneoxy group or propyleneoxy group units), aryloxy, heterocyclic oxy, acyloxy, (alkoxy or aryloxy)carbonyloxy, carbamoyloxy, sulfonyloxy, amino, (alkyl, aryl or heterocyclic) amino, N-substituted nitrogen-containing heterocyclic, acylamino, sulfonamido, ureido, thioureido, imido, (alkoxy or aryloxy) carbonylamino, sulfamoylamino, semicarbazido, thiosemicarbazido, hydrazino, quaternary ammonio, oxamoylamino, (alkyl or aryl)sulfonylureido, acylureido, acylsulfamoylamino, nitro, mercapto, (alkyl, aryl or heterocyclic) thio, (alkyl or aryl)sulfonyl, (alkyl or aryl) sulfinyl, sulfo or salts thereof, sulfamoyl, acylsulfamoyl, sulfonylsulfamoyl or salts thereof, groups each having a phosphoric acid amide or phosphoric ester structure.

These substituent groups may be further substituted by these substituent groups.

When $R_2$ represents the aromatic group or the heterocyclic group, preferred examples of the substituent groups which $R_2$ may have include alkyl (including active methylene), aralkyl, heterocyclic, substituted amino, acylamino, sulfonamido, ureido, sulfamoylamino, imido, thioureido, phosphoric acid amido, hydroxyl, alkoxyl, aryloxy, acyloxy, acyl, alkoxycarbonyl, aryloxycarbonyl, carbamoyl, carboxyl (including salts thereof), (alkyl, aryl or heterocyclic) thio, sulfo (including salts thereof), sulfamoyl, halogen atoms, cyano and nitro.

When $R_2$ represents the aliphatic group, preferred examples of the substituent groups include alkyl, aryl, heterocyclic, amino, acylamino, sulfonamido, ureido, sulfamoylamino, imido, thioureido, phosphoric acid amido, hydroxyl, alkoxyl, aryloxy, acyloxy, acyl, alkoxycarbonyl, aryloxycarbonyl, carbamoyl, carboxyl (including salts thereof), (alkyl, aryl or heterocyclic) thio, sulfo (including salts thereof), sulfamoyl, halogen atoms, cyano and nitro.

In general formula (H), $R_1$ represents a hydrogen atom or a block group, and specifically, the block group represents an aliphatic group (specifically, alkyl, alkenyl or alkynyl), an aromatic group (monocyclic or condensed cyclic aryl), a heterocyclic group, an alkoxyl group, an aryloxy group, an amino group or a hydrazino group.

The alkyl group represented by $R_1$ is preferably a substituted or unsubstituted alkyl group having 1 to 10 carbon atoms, and examples thereof include methyl, ethyl, trifluoromethyl, difluoromethyl, 2-carboxytetrafluoroethyl, pyridiniomethyl, difluoromethoxymethyl, difluorocarboxymethyl, 3-hydroxypropyl, 3-methanesulfonamidopropyl, phenylsulfonylmethyl, o-hydroxybenzyl, methoxymethyl, phenoxymethyl, 4-ethylphenoxymethyl, phenylthiomethyl, t-butyl, dicyanomethyl, diphenylmethyl, triphenylmethyl, methoxycarbonyldiphenylmethyl, cyanodiphenylmethyl and methylthiodiphenylmethyl. The alkenyl group is preferably an alkenyl group having 1 to 10 carbon atoms, and examples thereof include vinyl, 2-ethoxycarbonylvinyl and 2-trifluoro-2-methoxycarbonylvinyl. The alkynyl group is preferably an alkynyl group having 1 to 10 carbon atoms, and examples thereof include ethynyl and 2-methoxycarbonylethynyl. The aryl group is preferably a monocyclic or condensed cyclic aryl group, and a benzene ring-containing group is particularly preferred. Examples thereof include phenyl, perfluorophenyl, 3,5-dichlorophenyl, 2-methanesulfonamido-phenyl, 2-carbamoylphenyl, 4,5-dicyanophenyl, 2-hydroxymethylphenyl, 2,6-dichloro-4-cyanophenyl and 2-chloro-5-octylsulfamoylphenyl.

The heterocyclic group is preferably a 5- or 6-membered saturated or unsaturated, monocyclic or condensed cyclic heterocyclic group containing at least one of nitrogen, oxygen and sulfur atoms. Examples thereof include morpholino, piperidino (N-substituted), imidazolyl, indazolyl (4-nitroindazolyl), pyrazolyl, triazolyl, benzoimidazolyl, tetrazolyl, pyridyl, pyridinio (N-methyl-3-pyridinio), quinolinio and quinolyl.

The alkoxyl group is preferably an alkoxyl group having 1 to 8 carbon atoms, and examples thereof include methoxy, 2-hydroxyethoxy, benzyloxy and t-butoxy. The aryloxy group is preferably a substituted or unsubstituted phenoxy group, and the amino group is preferably an unsubstituted amino group, or an alkylamino, arylamino or substituted or unsubstituted heterocyclic amino group (including a quaternized nitrogen atom-containing heterocyclic amino group) having 1 to 10 carbon atoms. Examples of the amino groups include 2,2,6,6-tetramethylpiperidine-4-ylamino, propylamino, 2-hydroxyethyl-amino, anilino, o-hydroxyanilino, 5-benzotriazolylamino and N-benzyl-3-pyridinioamino). As the hydrazino group, a substituted or unsubstituted hydrazino group or a substituted or unsubstituted phenylhydrazino group (4-benzenesulfonamidophenylhydrazino) is particularly preferred.

The group represented by $R_1$ may be substituted, and examples of the substituent groups are the same as shown as the substituent groups for $R_2$.

In general formula (H), $R_1$ may be a group which cleaves the $G_1$-$R_1$ moiety from the residual molecule to induce the cyclization reaction for forming a cyclic structure containing atoms of the -$G_1$-$R_1$ moiety, and examples thereof include groups described in JP-A-63-29751.

An adsorbent group for adsorbing a silver halide may be incorporated into the hydrazine derivative represented by general formula (H). Such adsorbent groups include alkylthio, arylthio, thiourea, thioamido, mercapto heterocyclic and triazole groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. These adsorbent groups to the silver halides may be precursors thereof. Such precursors include groups described in JP-A-2-285344.

A ballast group or a polymer which is usually used in an immobile photographic additive such as a coupler may be incorporated into $R_1$ or $R_2$ of general formula (H). The ballast group is a group having 8 or more carbon atoms which is relatively inactive to photographic properties, and can be selected, for example, from alkyl, aralkyl, alkoxyl, phenyl, alkylphenyl, phenoxy and alkylphenoxy groups. Examples of the polymers include ones described in JP-A-1-100530.

$R_1$ or $R_2$ of general formula (H) may contain a plurality of hydrazino groups as substituent groups. In this case, the compound represented by general formula (H) indicates a polymer with respect to the hydrazino groups. Specific examples thereof include compounds described in JP-A-64-86134, JP-A-4-16938, JP-A-5-197091, W095-32452, W095-32453, Japanese Patent Application Nos. 7-351132, 7-351269, 7-351168, 7-351287 and 7-351279.

$R_1$ or $R_2$ of general formula (H) may contain a cationic group (specifically, a quaternary ammonio group-containing group or a quaternized nitrogen atom-containing heterocyclic group), a group containing repeating units of ethyleneoxy or propyleneoxy groups, an (alkyl, aryl or heterocyclic) thio group, or a dissociative group which can be dissociated with a base (carboxyl, sulfo, acylsulfamoyl or carbamoyl-sulfamoyl). These groups are contained, for example, in compounds described in JP-A-7-234471, JP-A-5-333466, JP-A-6-19032, JP-A-6-19031, JP-A-5-45761, U.S. Pat. Nos. 4,994,365 and 4,988,604, JP-A-3-259240, JP-A-7-5610, JP-A-7-244348 and German Patent 4,006,032.

In general formula (H), $A_1$ and $A_2$ each represents a hydrogen atom, an alkyl or arylsulfonyl group (preferably, phenylsulfonyl or phenylsulfonyl substituted so that the sum of Hammett substituent constants becomes −0.5 or more), or an acyl group having 20 or less carbon atoms (preferably, benzoyl, or benzoyl substituted so that the sum of Hammett substituent constants becomes −0.5 or more, or a straight chain, branched or cyclic, substituted or unsubstituted aliphatic acyl group (wherein examples of the substituent groups include halogen atoms, ether, sulfonamido, carbonamido, hydroxyl, carboxyl and sulfo groups)).

$A_1$ and $A_2$ are most preferably hydrogen atoms.

Hydrazine derivatives particularly preferred in the present invention are described below.

$R_2$ is preferably a phenyl group or a substituted alkyl group having 1 to 3 carbon atoms.

When $R_2$ represents a phenyl group, preferred examples of the substituent groups thereof include nitro, alkoxyl, alkyl, acylamino, ureido, sulfonamido, thioureido, carbamoyl, sulfamoyl, carboxyl (or salts thereof), sulfo (or salts thereof), alkoxycarbonyl and chlorine.

When $R_2$ represents a substituted phenyl group, the substituent group preferably has at least one of a ballast group, an adsorbent group to a silver halide, a quaternary ammonio group-containing group, a quaternized nitrogen atom-containing heterocyclic group, a group containing repeating units of ethyleneoxy groups, (alkyl, aryl or heterocyclic) thio, nitro, alkoxyl, acylamino, sulfonamido, a dissociative group (carboxyl, sulfo, acylsulfamoyl or carbamoylsulfamoyl) and hydrazino (a group represented by $-NHNH-G_1-R_1$) which can form a polymer, as a substituent group, directly or through a connecting group.

When $R_2$ represents a substituted alkyl group having 1 to 3 carbon atoms, $R_2$ is preferably a substituted methyl group, and more preferably a di-substituted or tri-substituted methyl group. Specifically, the substituent groups thereof are preferably methyl, phenyl, cyano, (alkyl, aryl or heterocyclic) thio, alkoxyl, aryloxy, chlorine, heterocyclic, alkoxycarbonyl, aryloxycarbonyl, carbamoyl, sulfamoyl, amino, acylamino and sulfonamido groups, and particularly, a substituted or unsubstituted phenyl group is preferred.

When $R_2$ represents a substituted methyl group, more preferred examples of the substituent groups include t-butyl, dicyanomethyl, dicyanophenylmethyl, triphenylmethyl (trityl), diphenylmethyl, methoxycarbonyldiphenylmethyl, cyanodiphenyl-methyl, methylthiodiphenylmethyl and cyclopropyldiphenyl-methyl, and trityl is most preferred among others.

In general formula (H), $R_2$ is most preferably a substituted phenyl group.

In general formula (H), ml represents 1 or 0. When $m_1$ is 0, $R_1$ represents an aliphatic group, an aromatic group or a heterocyclic group. When $m_1$ is 0, $R_1$ is particularly preferably a phenyl group or a substituted alkyl group having 1 to 3 carbon atoms. Examples of the substituent groups thereof are the same as shown as the preferred examples of the substituent groups for $R_2$.

$m_1$ is preferably 1.

When $R_2$ represents a phenyl group and $G_1$ is a —CO— group, the group represented by $R_1$ is preferably a hydrogen atom, an alkyl group, an alkenyl group, an alkynyl group, an aryl group or a heterocyclic group, more preferably a hydrogen atom, an alkyl group or an aryl group, and most preferably a hydrogen atom or an alkyl group. When $R_1$ represents an alkyl group, particularly preferred as the substituent group thereof is a halogen atom, an alkoxyl group, an aryloxy group, an alkylthio group, an arylthio group or a carboxyl group.

When $R_2$ represents a substituted methyl group and $G_1$ is a —CO— group, $R_1$ is preferably a hydrogen atom, an alkyl group, an aryl group, a heterocyclic group, an alkoxyl group or an amino group (unsubstituted amino, alkylamino, arylamino or heterocyclic amino), and more preferably a hydrogen atom, an alkyl group, an aryl group, a heterocyclic group, an alkoxyl group, an alkylamino group, an arylamino group or a heterocyclic amino group. When $G_1$ is a —COCO— group, $R_1$ is preferably an alkoxyl group, an aryloxy group or an amino group, and particularly preferably a substituted amino group, particularly, alkylamino, arylamino or saturated or unsaturated heterocyclic amino, regardless of $R_2$.

When $G_1$ is a $—SO_2—$ group, $R_1$ is preferably an alkyl group, an aryl group or a substituted amino group, regardless of $R_2$.

In general formula (H), $G_1$ is preferably a —CO— group or a —COCO— group, and particularly preferably a —CO— group.

Specific examples of the compounds represented by general formula (H) are enumerated below, but the present invention is not limited thereto.

TABLE 1

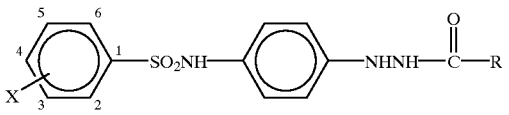

| | X = | R = —H | $C_2F_4$—COOH (or $-C_2F_4-COO^{\ominus}K^{\oplus}$) | 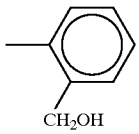 | 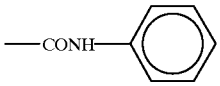 |
|---|---|---|---|---|---|
| 1 | 3-NHCO-$C_9H_{19}$(n) | 1a | 1b | 1c | 1d |
| 2 | 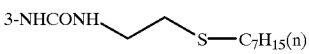 | 2a | 2b | 2c | 2d |

TABLE 1-continued
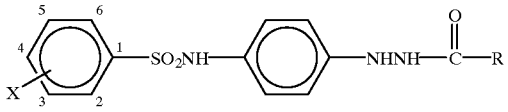
| | X = | R = —H | $C_2F_4$—COOH (or $-C_2F_4$—$COO^{\ominus}K^{\oplus}$) | 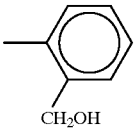 | 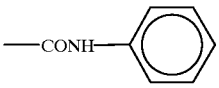 |
|---|---|---|---|---|---|
| 3 | 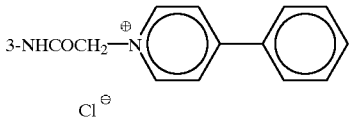 | 3a | 3b | 3c | 3d |
| 4 | 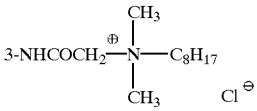 | 4a | 4b | 4c | 4d |
| 5 | 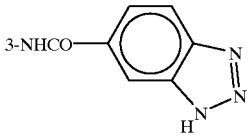 | 5a | 5b | 5c | 5d |
| 6 | 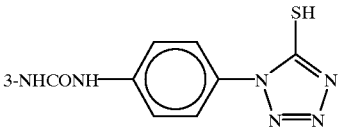 | 6a | 6b | 6c | 6d |
| 7 | 2,4—$(CH_3)_2$-3-$SC_2H_4$—$(OC_2H_4)_4$—$OC_8H_{17}$ | 7a | 7b | 7c | 7d |
TABLE 2
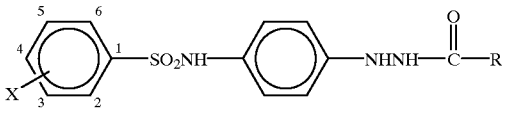
| | X = | R = —H | —$CF_2H$ | 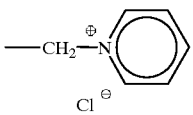 | 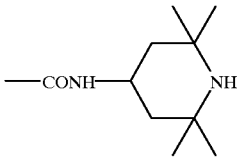 |
|---|---|---|---|---|---|
| 8 | 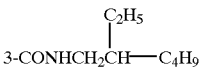 | 8a | 8e | 8f | 8g |
| 9 | 6-$OCH_3$-3-$C_5H_{11}$(t) | 9a | 9e | 9f | 9g |

TABLE 2-continued
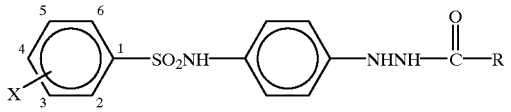
| | X = | R = —H | —$CF_2H$ | —$CH_2$—$N^{\oplus}$(C6H5)$Cl^{\ominus}$ | —CONH—(2,2,6,6-tetramethylpiperidyl)NH |
|---|---|---|---|---|---|
| 10 | 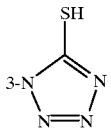 | 10a | 10e | 10f | 10g |
| 11 | 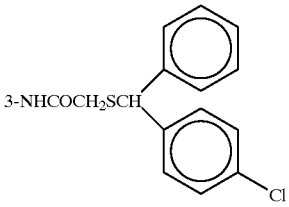 | 11a | 11e | 11f | 11g |
| 12 | 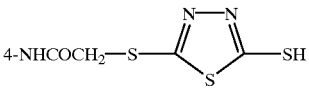 | 12a | 12e | 12f | 12g |
| 13 | 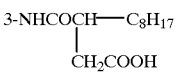 | 13a | 13e | 13f | 13g |
| 14 | 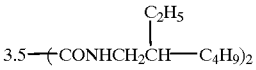 | 14a | 14e | 14f | 14g |
TABLE 3
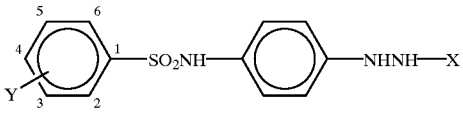
| | Y = | X = —CHO | —$COCF_3$ | —$SO_2CH_3$ | —P(=O)$(OC_2H_5)_2$ |
|---|---|---|---|---|---|
| 15 | 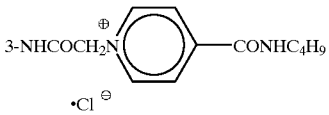 | 15a | 15h | 15i | 15j |

TABLE 3-continued
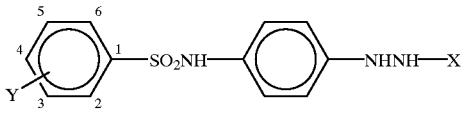
| | Y = | X = —CHO | —$COCF_3$ | —$SO_2CH_3$ | —P(=O)$(OC_2H_5)_2$ |
|---|---|---|---|---|---|
| 16 | 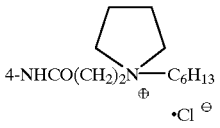 | 16a | 16h | 16i | 16j |
| 17 | 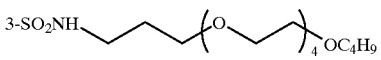 | 17a | 17h | 17i | 17j |
| 18 | 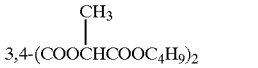 | 18a | 18h | 18i | 18j |
| 19 | 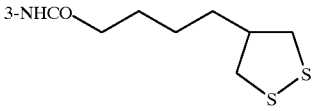 | 19a | 19h | 19i | 19j |
| 20 | 3-$NHSO_2NH$—$C_8H_{17}$ | 20a | 20h | 20i | 20j |
| 21 | 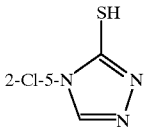 | 21a | 21h | 21i | 21j |
TABLE 4
| | | R = —H | —$CF_3$ |
|---|---|---|---|
| 22 | 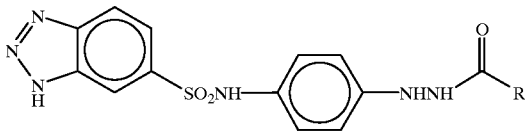 | 22a | 22h |
| 23 | 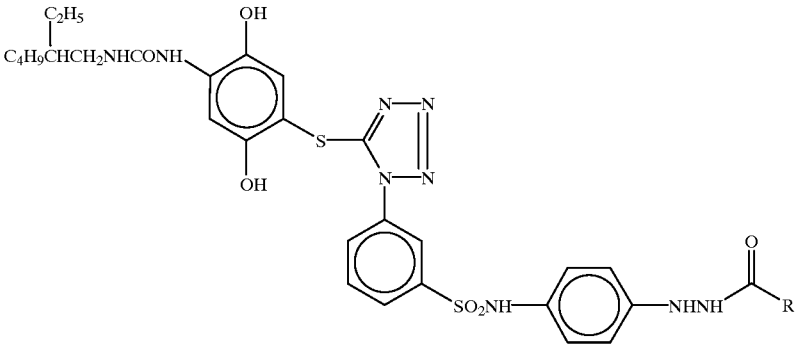 | 23a | 23h |

TABLE 4-continued
24
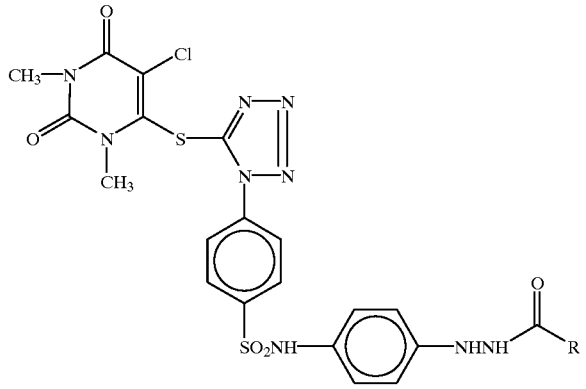
24a 24h
25
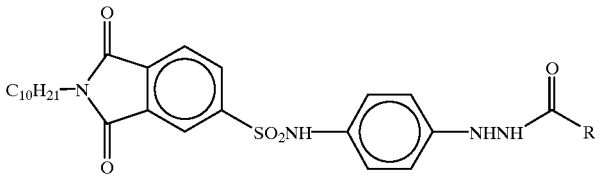
25a 25h
| | R = | |
|---|---|---|
| | 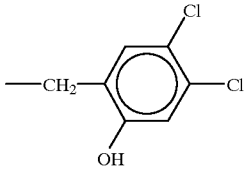 | 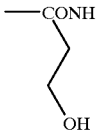 |
| 22 | 22k | 22l |
| 23 | 23k | 23l |
| 24 | 24k | 24l |
| 25 | 25k | 25l |
TABLE 5
26
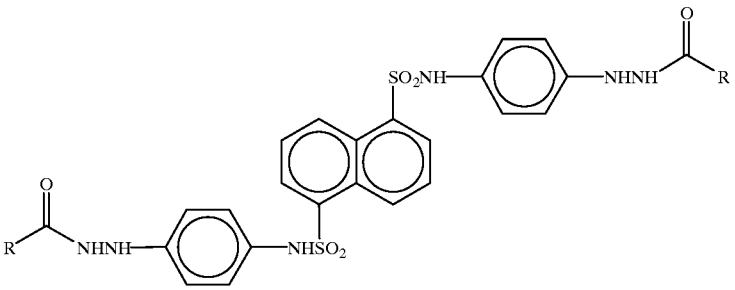
26a 26h 26k 26l
27
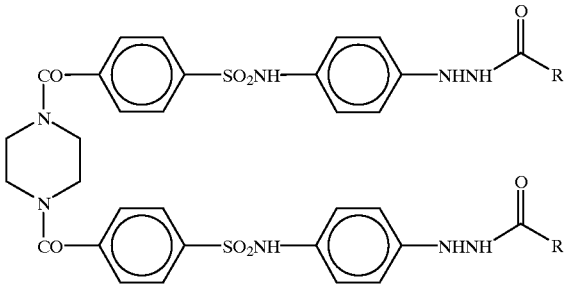
27a 27h 27k 27l TABLE 5-continued
| | | | | | |
|---|---|---|---|---|---|
| 28 | 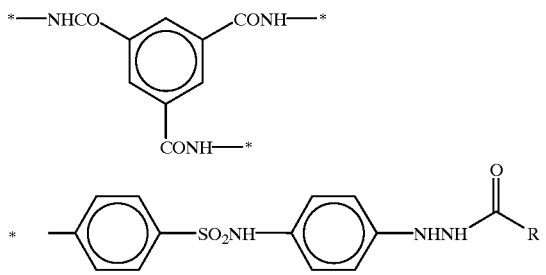 | 28a | 28h | 28k | 28l |
TABLE 6
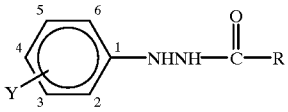
| | | R = | | | |
|---|---|---|---|---|---|
| | Y = | —H | —$CH_2OCH_3$ | 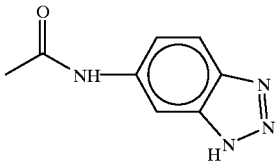 | 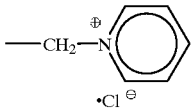 |
| 29 | 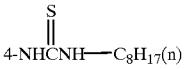 | 29a | 29m | 29n | 29f |
| 30 | 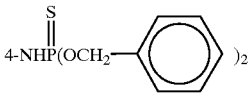 | 30a | 30m | 30n | 30f |
| 31 | 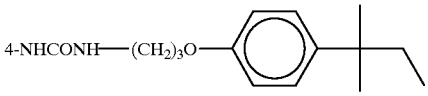 | 31a | 31m | 31n | 31f |
| 32 | 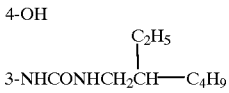 | 32a | 32m | 32n | 32f |
| 33 | 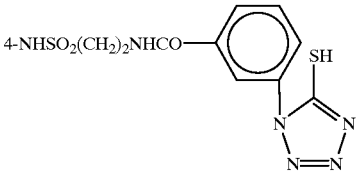 | 33a | 33m | 33n | 33f |
| 34 | 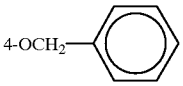 | 34a | 34m | 34n | 34f |
| 35 | 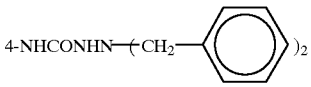 | 35a | 35m | 35n | 35f |

TABLE 7
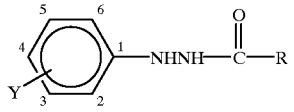
| | | R = | | | |
|---|---|---|---|---|---|
| | Y = | —H | —$CF_2SCH_3$ | —$CONHCH_3$ | 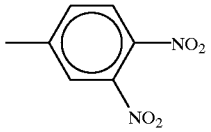 |
| 36 | 2-$NHSO_2CH_3$— <br> 4-NHCONH$(CH_2)_3$S— 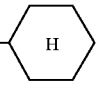 | 36a | 36o | 36p | 36q |
| 37 | 2-$OCH_3$— <br> 4-$NHSO_2C_{12}H_{25}$ | 37a | 37o | 37p | 37q |
| 38 | 3-$NHCOC_{11}H_{23}$— <br> 4-$NHSO_2CF_3$ | 38a | 38o | 38p | 38q |
| 39 | 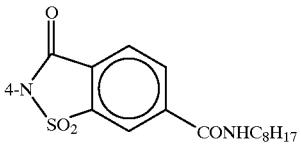 | 39a | 39o | 39p | 39q |
| 40 | 4-$OCO(CH_2)_2COOC_6H_{13}$ | 40a | 40o | 40p | 40q |
| 41 | 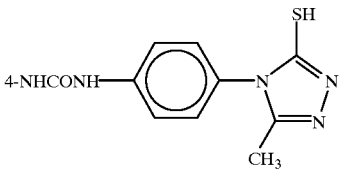 | 41a | 41o | 41p | 41q |
| 42 | 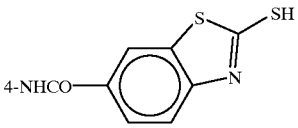 | 42a | 42o | 42p | 42q |
TABLE 8
43
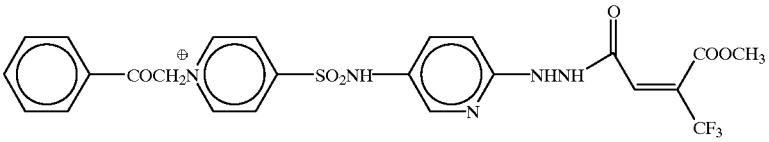
44
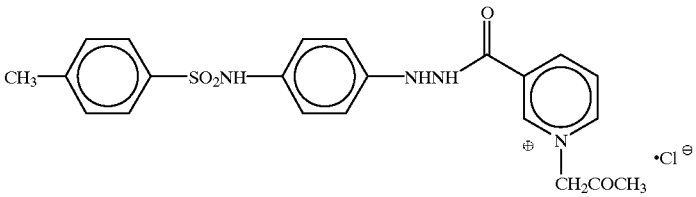

TABLE 8-continued
45
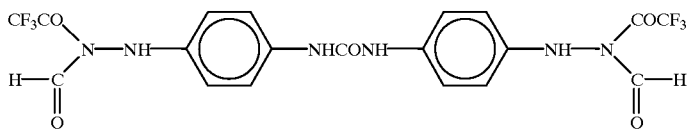
46
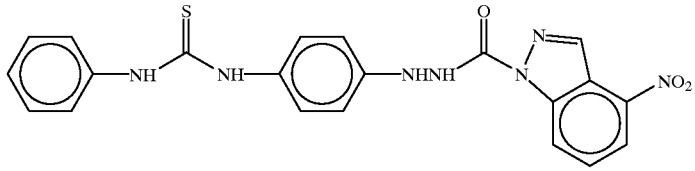
47
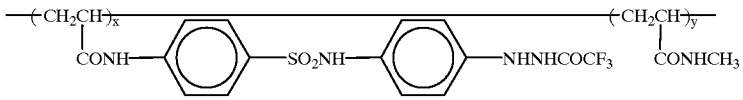
x:y = 3:97
average molecular weight ≒ 100,000
48
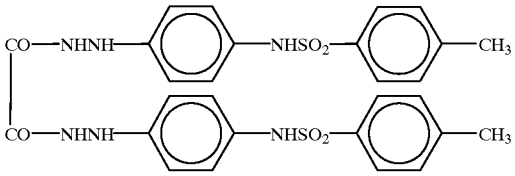
49
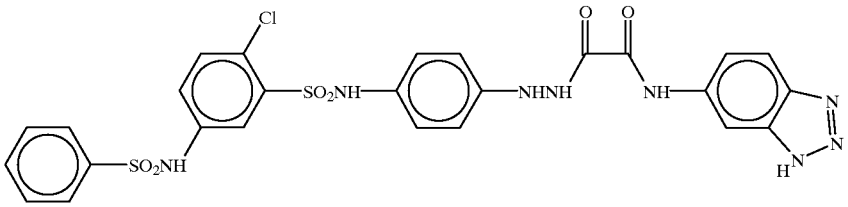
50
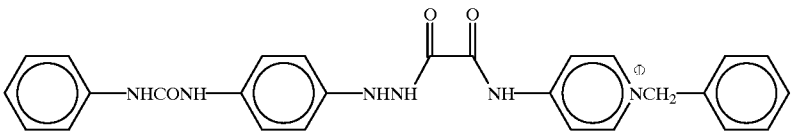
TABLE 9
51
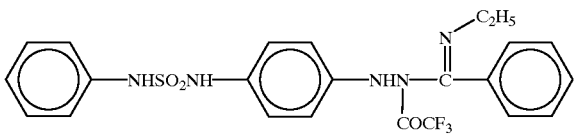
52
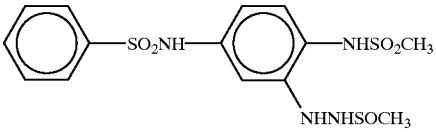

TABLE 9-continued
| | |
|---|---|
| 53 | 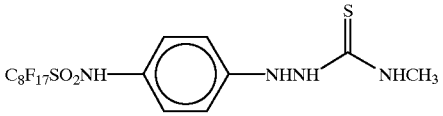 |
TABLE 10
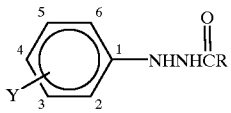
| | | R = | | | |
|---|---|---|---|---|---|
| | Y = | —H | —$CH_2OCH_3$ | —$CH_2O$— 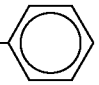 | —$CONHC_3H_7$ |
| 54 | 2-$OCH_3$ | 54a | 54m | 54r | 54s |
| 55 | 2-$OCH_3$ 5-$C_8H_{17}$(t) | 55a | 55m | 55r | 55s |
| 56 | 4-$NO_2$ | 56a | 56m | 56r | 56s |
| 57 | 4-$CH_3$ | 57a | 57m | 57r | 57s |
| 58 | 4-NHCO— 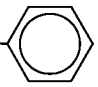 | 58a | 58m | 58r | 58s |
| 59 | 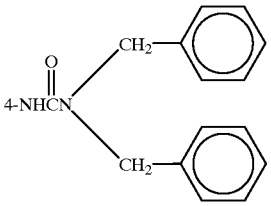 | 59a | 59m | 59r | 59s |
TABLE 11
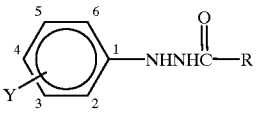
| | | R = | | | |
|---|---|---|---|---|---|
| | Y = | —H | 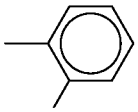 | —$CH_2$—$N^+$ 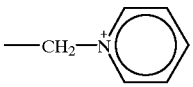 •$Cl^-$ | —CONH— 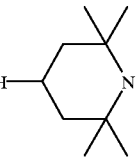 |
| 60 | 2-$OCH_3$ 5-$OCH_3$ | 60a | 60c | 60f | 60g |
| 61 | 4-$C_8H_{17}$(t) | 61a | 61c | 61f | 61g |

TABLE 11-continued
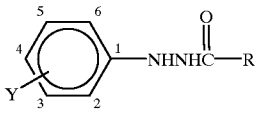
| | | R = | | | |
|---|---|---|---|---|---|
| | Y = | —H | 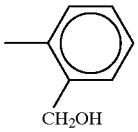 | 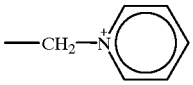 | 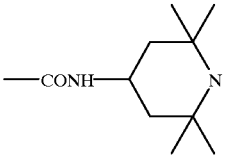 |
| 62 | 4-$OCH_3$ | 62a | 62c | 62f | 62g |
| 63 | 3-$NO_2$ | 63a | 63c | 63f | 63g |
| 64 | 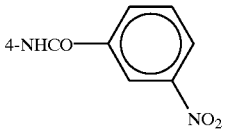 | 64a | 64c | 64f | 64g |
| 65 | 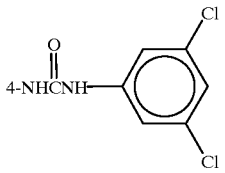 | 65a | 65c | 65f | 65g |
TABLE 12
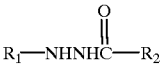
| | | $R_2$ = | | | |
|---|---|---|---|---|---|
| | $R_1$ = | —H | 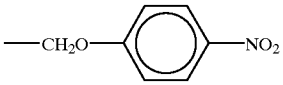 | 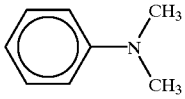 | 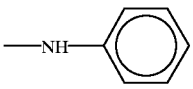 |
| 66 | 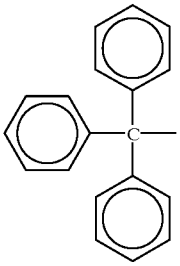 | 66a | 66u | 66v | 66t |

TABLE 12-continued
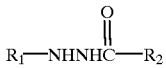
| | | R2 = | | | |
|---|---|---|---|---|---|
| | R1 = | —H | —CH2O—⟨⟩—NO2 | ⟨⟩—N(CH3)2 | —NH—⟨⟩ |
| 67 | 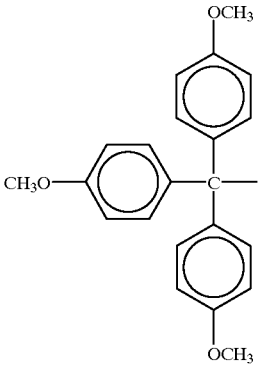 | 67a | 67u | 67v | 67t |
| 68 | 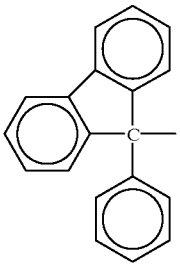 | 68a | 68u | 68v | 68t |
| 69 | 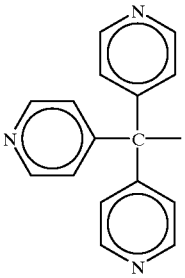 | 69a | 69u | 69v | 69t |

TABLE 12-continued
| | | $R_1$—NHNHC(=O)—$R_2$ | | | |
|---|---|---|---|---|---|
| | | $R_2$ = | | | |
| | $R_1$ = | —H | —$CH_2O$—$C_6H_4$—$NO_2$ | —$C_6H_4$—N($CH_3$)$_2$ | —NH—$C_6H_5$ |
| 70 | 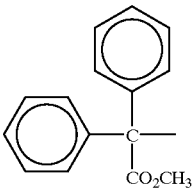 | 70a | 70u | 70v | 70t |
| 71 | 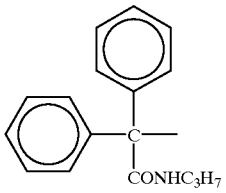 | 71a | 71u | 71v | 71t |
TABLE 13
| | | $R_1$—NHNHC(=O)—$R_2$ | | | |
|---|---|---|---|---|---|
| | | $R_2$ = | | | |
| | $R_1$ = | —C(=O)NH$C_3H_7$ | —C(=O)O—$C_4H_9$(t) | —O$C_4H_9$(t) | —$C_5H_4N$ |
| 72 | 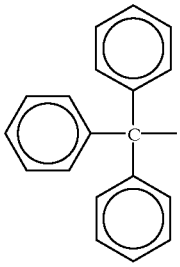 | 72s | 72x | 72y | 72w |

TABLE 13-continued
| | | $R_1$—NHNHC(=O)—$R_2$ | | | |
|---|---|---|---|---|---|
| | | $R_2$ = | | | |
| | $R_1$ = | —C(=O)NHC$_3$H$_7$ | —C(=O)CO—C$_4$H$_9$(t) | —OC$_4$H$_9$(t) | 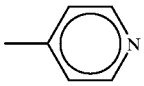 |
| 73 | 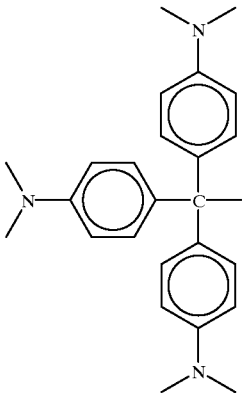 | 73s | 73x | 73y | 73w |
| 74 | 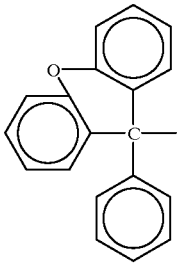 | 74s | 74x | 74y | 74w |
| 75 | 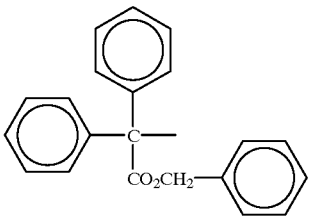 | 75s | 75x | 75y | 75w |
| 76 | 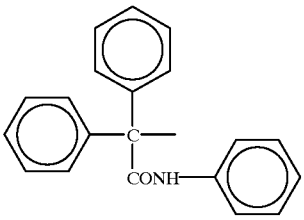 | 76s | 76x | 76y | 76w |

TABLE 14
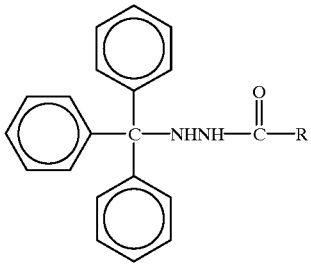
R =
77
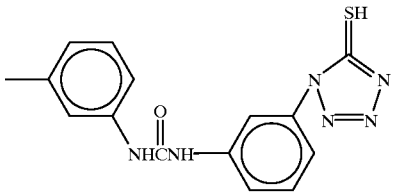
78
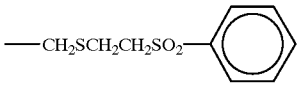
79 —$CH_2OCH_2CH_2SCH_2CH_2OCH_3$
80 —$CF_2CF_2COOH$
81
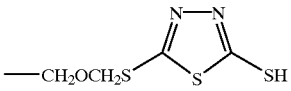
82
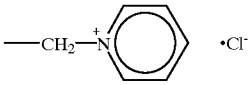
TABLE 15
83
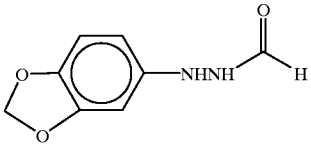
84
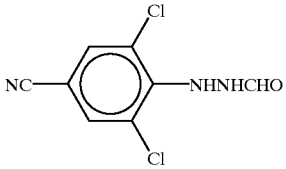
85
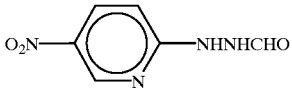
86
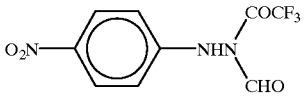
87
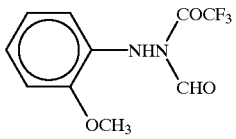
88
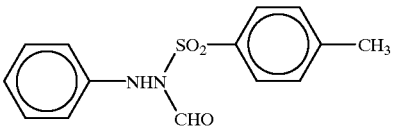
TABLE 16
89
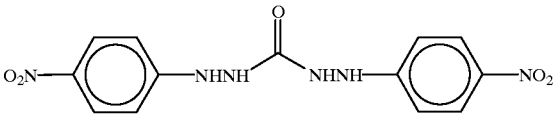
90
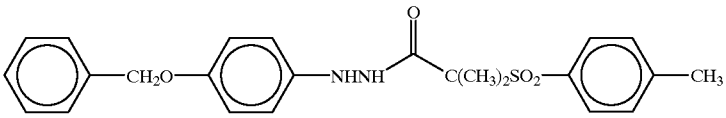
91
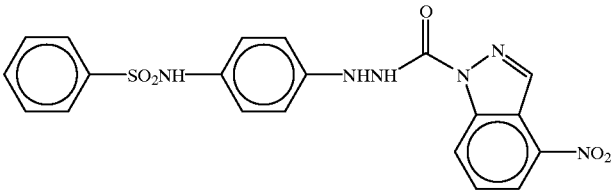

TABLE 16-continued
| | |
|---|---|
| 92 | 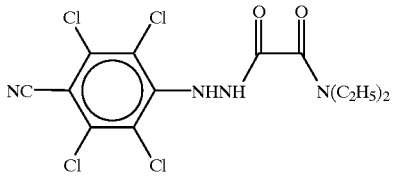 |
| 93 | 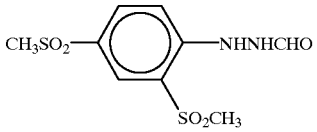 |
| 94 | 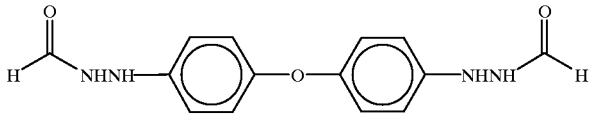 |
TABLE 17
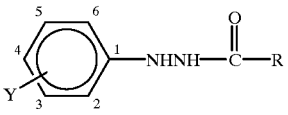
| | Y = | R = 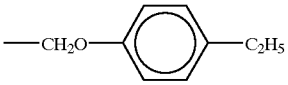 | R = 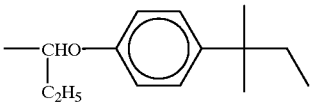 |
|---|---|---|---|
| 95 | 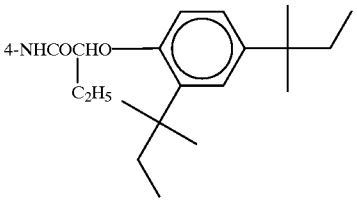 | 95-1 | 95-2 |
| 96 | 4-COOH | 96-1 | 96-2 |
| 97 | 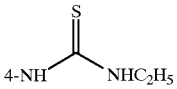 | 97-1 | 97-2 |
| 98 | 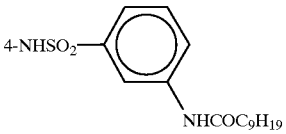 | 98-1 | 98-2 |

TABLE 17-continued
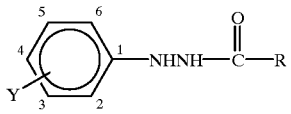
| | | | |
|---|---|---|---|
| 99 | 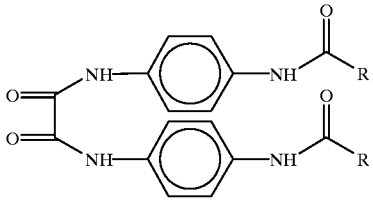 | 99-1 | 99-2 |
| 100 | 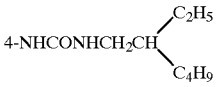 | 100-1 | 100-2 |
| | | R = | |
|---|---|---|---|
| | Y = | 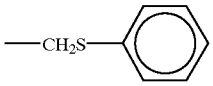 | —$CH_2$—Cl |
| 95 | 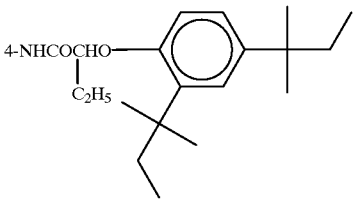 | 95-3 | 95-4 |
| 96 | 4-COOH | 96-3 | 96-4 |
| 97 | 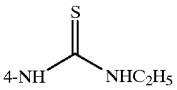 | 97-3 | 97-4 |
| 98 | 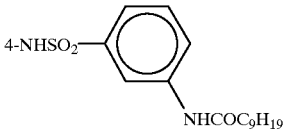 | 98-3 | 98-4 |
| 99 | 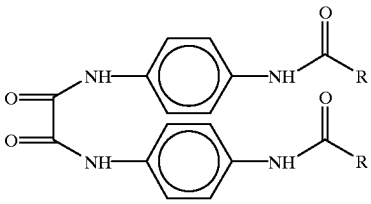 | 99-3 | 99-4 |
| 100 | 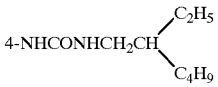 | 100-3 | 100-4 |

TABLE 18
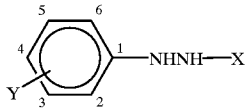
| | | X = | |
|---|---|---|---|
| | Y = | 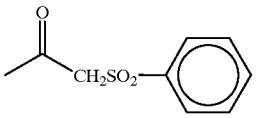 | 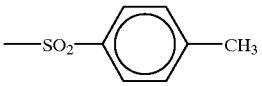 |
| 101 | 4-$NO_2$ | 101-5 | 101-6 |
| 102 | 2,4-$OCH_3$ | 102-5 | 102-6 |
| 103 | 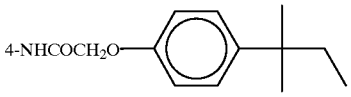 | 103-5 | 103-6 |
| | | X = | |
|---|---|---|---|
| | Y = | 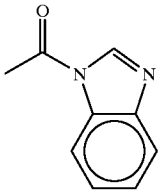 | 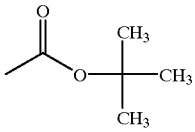 |
| 101 | 4-$NO_2$ | 101-7 | 101y |
| 102 | 2,4-$OCH_3$ | 102-7 | 102y |
| 103 | 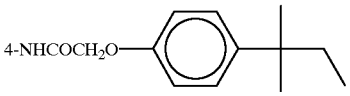 | 103-7 | 103y |
| | | X = | |
|---|---|---|---|
| | Y = | 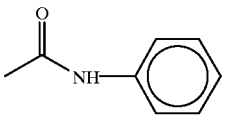 | 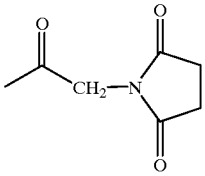 |
| 104 | 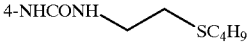 | 104-8 | 104-9 |
| 105 | 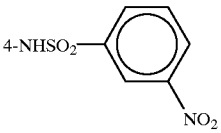 | 105-8 | 105-9 |

TABLE 18-continued
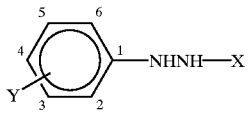
| | Y = | X = 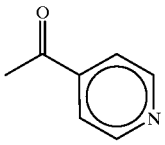 | X = 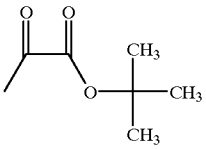 |
|---|---|---|---|
| 104 | 4-NHCONH 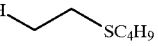 $SC_4H_9$ | 104w' | 103x |
| 105 | 4-$NHSO_2$ 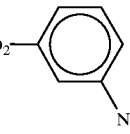 $NO_2$ | 105w' | 105x |
TABLE 19
Y—NHNH—X
| | Y = | X = 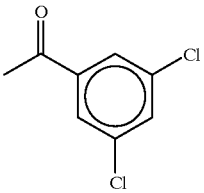 | 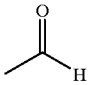 | 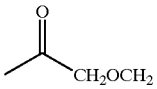 | 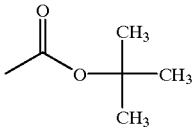 |
|---|---|---|---|---|---|
| 106 | 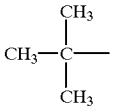 | 106-10 | 106a | 106m | 106y |
| 107 | 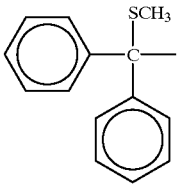 | 107-10 | 107a | 107m | 107y |
| 108 | 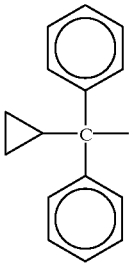 | 108-10 | 108a | 108m | 108y |

TABLE 19-continued
| Y—NHNH—X | | | | | |
|---|---|---|---|---|---|
| | | X = | | | |
| | Y = | 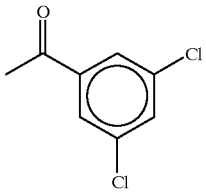 | 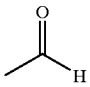 | 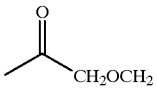 | 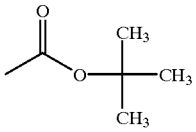 |
| 109 | 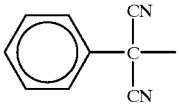 | 109-10 | 109a | 109m | 109y |
| 110 | 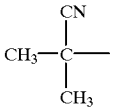 | 110-10 | 110a | 110m | 110y |
| 111 | 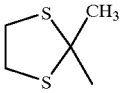 | 111-10 | 111a | 111m | 111y |
TABLE 20
| Y-NHNH-X | | | | |
|---|---|---|---|---|
| | | X = | | |
| | Y = | 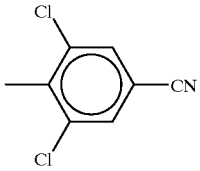 | 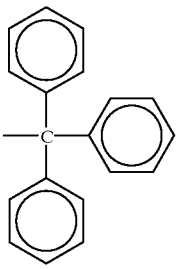 | 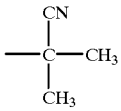 |
| 112 | 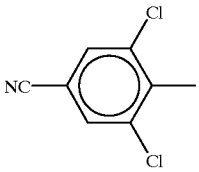 | 112-11 | 112-12 | 112-13 |
| 113 | 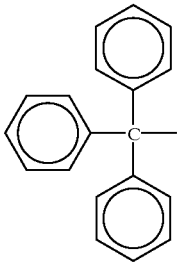 | 113-11 | 113-12 | 113-13 |

TABLE 20-continued
| Y-NHNH-X | | | | |
|---|---|---|---|---|
| 114 | 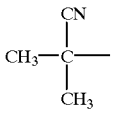 | 114-11 | 114-12 | 114-13 |
| 115 | 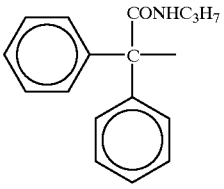 | 115-11 | 115-12 | 115-13 |
| 116 | 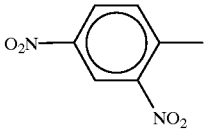 | 116-11 | 116-12 | 116-13 |
| 117 | 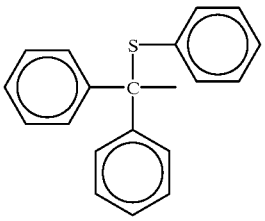 | 117-11 | 117-12 | 117-13 |
| | | X = |
|---|---|---|
| | Y = | 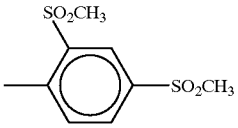 |
| 112 | 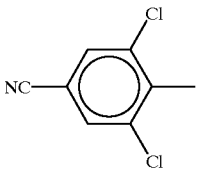 | 112-14 |
| 113 | 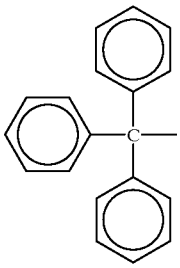 | 113-14 |
| 114 | 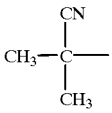 | 114-14 |

TABLE 20-continued
| Y-NHNH-X | | |
|---|---|---|
| 115 | 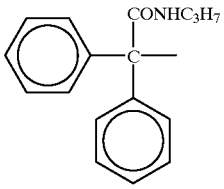 | 115-14 |
| 116 | 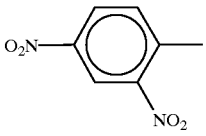 | 116-14 |
| 117 | 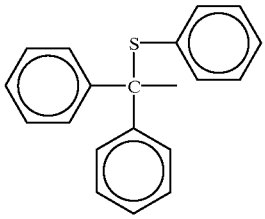 | 117-14 |
TABLE 21
118
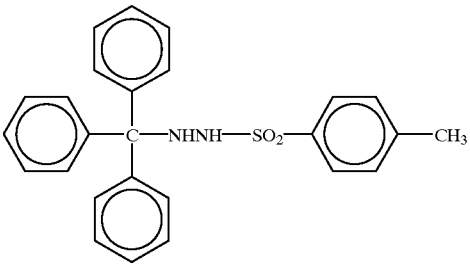
119
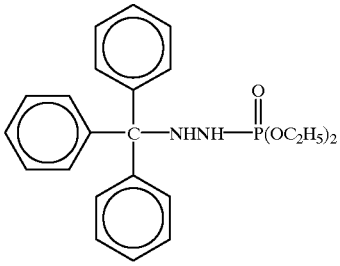
120
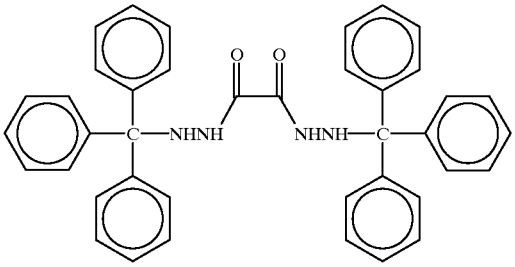

TABLE 21-continued
121
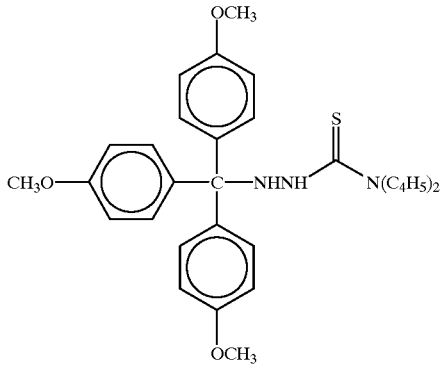
122
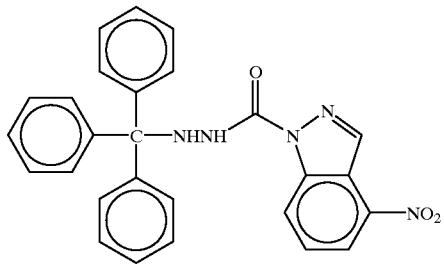
123
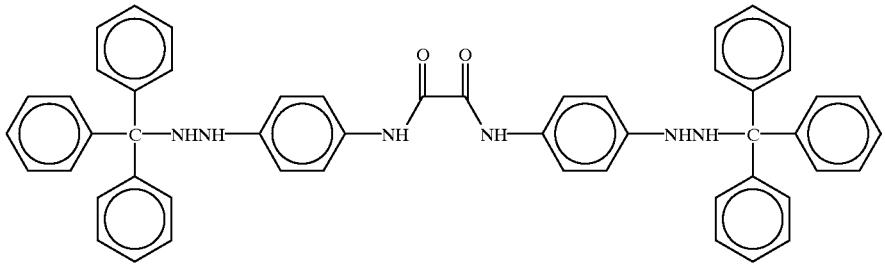
TABLE 22
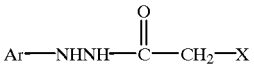
| Ar = | X = —OH | —SH | —NHCOCF$_3$ | —NHSO$_2$CH$_3$ | —NHSO$_2$ph | —N(CH$_3$)$_2$ |
|---|---|---|---|---|---|---|
| 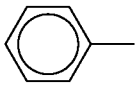 | 124a | 124b | 124c | 124d | 124e | 124f |
| 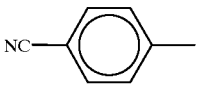  | 125a | 125b | 125c | 125d | 125e | 125f |
| 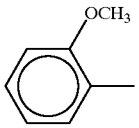  | 126a | 126b | 126c | 126d | 126e | 126f |

TABLE 22-continued
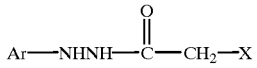
| Ar = | X = —OH | —SH | —NHCOCF$_3$ | —NHSO$_2$CH$_3$ | —NHSO$_2$ph | —N(CH$_3$)$_2$ |
|---|---|---|---|---|---|---|
| 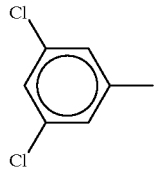 | 127a | 127b | 127c | 127d | 127e | 127f |
| 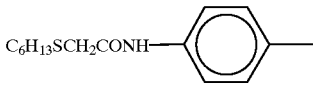 | 128a | 128b | 128c | 128d | 128e | 128f |
| 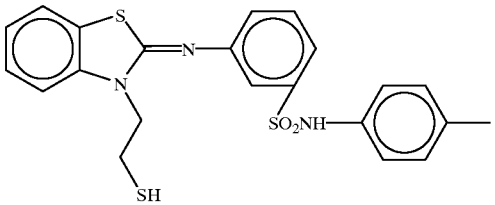 | 129a | 129b | 129c | 129d | 129e | 129f |
| 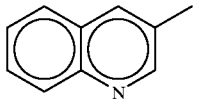 | 130a | 130b | 130c | 130d | 130e | 130f |
| 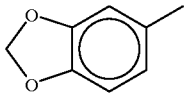 | 131a | 131b | 131c | 131d | 131e | 131f |
| 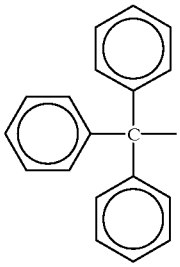 | 132a | 132b | 132c | 132d | 132e | 132f |
| 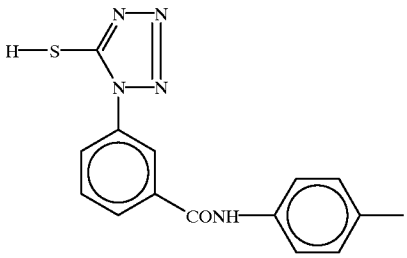 | 133a | 133b | 133c | 133d | 133e | 133f |

TABLE 22-continued

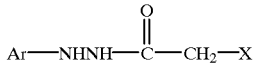

| Ar = | X = —OH | —SH | —NHCOCF$_3$ | —NHSO$_2$CH$_3$ | —NHSO$_2$ph | —N(CH$_3$)$_2$ |
|---|---|---|---|---|---|---|
| 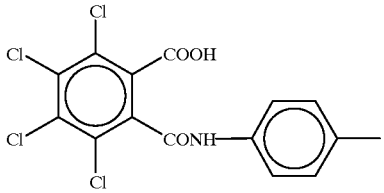 | 134a | 134b | 134c | 134d | 134e | 134f |

TABLE 23

| | |
|---|---|
| 135 | 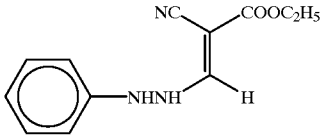 |
| 136 | 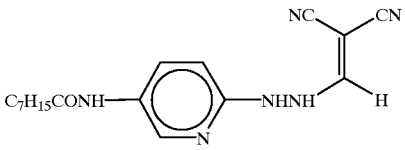 |
| 137 | 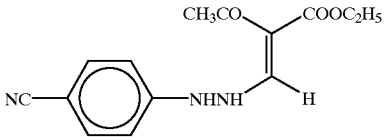 |

In addition to the above-mentioned hydrazine derivatives, the following hydrazine derivatives are also preferably used in the present invention. In some cases, they can also be used in combination. The hydrazine derivatives used in the present invention can be synthesized by various methods described in the following patents.

Namely, compounds represented by (KA 1) described in JP-B-6-77138, specifically, compounds described on pages 3 and 4 thereof; compounds represented by general formula (I) described in JP-B-6-93082, specifically, compounds 1 to 38 described on pages 8 to 18 thereof; compounds represented by general formulas (4), (5) and (6) described in JP-A-6-230497, specifically, compounds 4-1 to 4-10 described on pages 25 and 26 thereof, compounds 5-1 to 5-42 described on pages 28 to 36 and compounds 6-1 to 6-7 described on pages 39 and 40; compounds represented by general formulas (1) and (2) described in JP-A-6-289520, specifically, compounds 1-1) to 1-17) and 2-1) described on pages 5 to 7 thereof; compounds represented by (KA 2) and (KA 3) described in JP-A-6-313936, specifically, compounds described on pages 6 to 19 thereof; compounds represented by (KA 1) described in JP-A-6-313951, specifically, compounds described on pages 3 to 5 thereof; compounds represented by general-formula (I) described in JP-A-7-5610, specifically, compounds I-1 to I-38 described on pages 5 to 10 thereof; compounds represented by general formula (II) described in JP-A-7-77783, specifically, compounds II-1 to II-102 described on pages 10 to 27 thereof; compounds represented by general formulas (H) and (Ha) described in JP-A-7-104426, specifically, compounds H-1 to H-44 described on pages 8 to 15 thereof; compounds each having an anionic group or a nonionic group forming an intermolecular hydrogen bond with a hydrogen atom of hydrazine, in the vicinity of a hydrazine group, described in Japanese Patent Application No. 7-191007, particularly, compounds represented by general formulas (A), (B), (C), (D), (E) and (F), specifically, compounds N-1 to N-30 described therein; compounds represented by general formula (1) described in Japanese Patent Application No. 7-191007, specifically, compounds D-1 to D-55 described therein; various hydrazine derivatives described in *Kouchi Gijutsu* (*Known Art*) (pages 1 to 207), published by Aztech Co. (Mar. 22, 1991), pages 25 to 34; and compounds D-2 to D-39 described in JP-A-62-86354 (pages 6 and 7).

In the present invention, the hydrazine nucleating agents can be used by dissolving them in appropriate solvents such as alcohols (methanol, ethanol, propanol and fluorinate alcohols), ketones (acetone), dimethylformamide, dimethyl sulfoxide and methyl cellosolve.

Further, they can be used by dissolving them using oils such as dibutyl phthalate, tricresyl phosphate, glyceryl triacetate and diethyl phthalate, or auxiliary solvents such as ethyl acetate and cyclohexanone by the emulsifying dispersion methods already well known to mechanically prepare emulsified dispersions. Alternatively, the hydrazine derivatives can be used by dispersing the powder thereof in water in a ball mill or a colloid mill, or with ultrasonic waves by methods known as the solid dispersion methods.

The hydrazine nucleating agent used in the present invention may be added to any of an image formation layer on the image formation layer side with respect to a support and other binder layers. However, the hydrazine nucleating agent is preferably added to the image formation layer or the hydrophilic colloidal layer adjacent thereto.

In the present invention, the amount of the nucleating agent added is preferably $1\times10^{-6}$ mol to $1\times10^{-2}$ mol, more preferably $1\times10^{-5}$ mol to $5\times10^{-3}$ mol, and most preferably $2\times10^{-5}$ mol to $5\times10^{-3}$ mol. per mol of silver halide.

In the present invention, for formation of super hard images, super hard gradation accelerators can be used in combination with super hard gradation enhancers. For example, amine compounds described in U.S. Pat. No. 5,545,505, specifically, AM-1 to AM-5, hydroxamic acids described in U.S. Pat. No. 5,545,507, specifically, HA-1 to HA-11, acrylonitrile compounds described in U.S. Pat. No. 5,545,507, specifically, CN-1 to CN-13, hydrazine compounds described in U.S. Pat. No. 5,558,983, specifically, CA-1 to CA-6, onium salts described in Japanese Patent Application No. 8-132836, specifically, A-1 to A-42, B-1 to B-27 and C-1 to C-14 can be used.

Synthesis and addition of these super hard gradation enhancers and super hard gradation accelerators can be performed according to the descriptions of the above-mentioned cited patents, and the amounts of the enhancers and the accelerators added can be determined according to them.

Sensitizing dyes used in the present invention may be any as long as they can spectrally sensitize the silver halide grains in a desired wavelength region when adsorbed by the silver halide grains. The sensitizing dyes which can be used include cyanine dyes, merocyanine dyes, complex cyanine dyes, complex merocyanine dyes, holopolar cyanine dyes, styryl dyes, hemicyanine dyes, oxonol dyes and hemioxonol dyes. Useful sensitizing dyes used in the present invention are described, for example, in *Research Disclosure*, Item 17643 IV-A, page 23 (December, 1978), *ibid*., Item 1831 X, page 437 (August, 1979), and literatures cited therein. In particular, sensitizing dyes having spectral sensitivity suitable for spectral characteristics of light sources of various laser imagers, scanners, image setters and process cameras can be advantageously selected.

As examples of the spectral sensitizing agents to red light, compounds I-1 to I-38 described in JP-A-54-18726, compounds I-1 to I-35 described in JP-A-6-75322, compounds I-1 to I-34 described in JP-A-7-287338, dyes 1 to 20 described in JP-B-55-39818 and compounds I-1 to I-37 described in JP-A-62-284343 are advantageously selected for so-called red light sources such as He-Ne lasers, red semiconductor lasers and LEDs.

For a semiconductor laser light source having a wavelength region of 750 nm to 1400 nm, the silver halide grains can be spectrally advantageously sensitized with various known dyes including cyanine, merocyanine, styryl, hemicyanine, oxonol, hemioxonol and xanthene dyes. Examples of the useful cyanine dyes include cyanine dyes having basic nuclei such as thiazoline, oxazoline, pyrroline, pyridine, oxazole, thiazole, selenazole and imidazole nuclei. Preferred examples of the useful merocyanine dyes include merocyanine dyes having acidic nuclei such as thiohydantoin, rhodanine, oxazolidinedione, thiazolinedione, barbituric acid, thiazolinone, malononitrile and pyrazolone nuclei, as well as the above-mentioned basic nuclei. In the above-mentioned cyanine and merocyanine dyes, dyes having imino groups or carboxyl groups are particularly effective. For example, they may be appropriately selected from known dyes as described in U.S. Pat. Nos. 3,761,279, 3,719,495 and 3,877,943, British Patents 1,466,201, 1,469,117 and 1,422,057, JP-B-3-10391, JP-B-6-52387, JP-A-5-341432, JP-A-6-194781 and JP-A-6-301141.

Structurally preferred examples of the dyes used in the present invention include cyanine dyes having thioether bond-containing substituent groups (for example, dyes described in JP-A-62-58239, 3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-7-500926 (the term "JP-W" as used herein means an "unexamined published international patent application") and U.S. Pat. No. 5,281,515.

Further, J-band formable dyes are disclosed in U.S. Pat. No. 5,510,236, example 5 of U.S. Pat. No. 3,871,887, JP-A-2-96131 and JP-A-59-48753, and they can be preferably used in the present invention.

These sensitizing dyes may be used alone or as a combination of two or more of them. Combinations of the sensitizing dyes are often used particularly for supersensitization. The emulsions may contain dyes having no spectral sensitizing function for themselves, or substances which do not substantially absorb visible light and exhibit supersensitization, together with the sensitizing dyes.

The useful sensitizing dyes, the combinations of the dyes showing supersensitization, and the substances exhibiting supersensitization are described in *Research Disclosure,* 176, 17643 IV-J, page 23 (December, 1978) or JP-B-49-25500, JP-B-43-4933, JP-A-59-19032 and JP-A-59-192242.

When the sensitizing dyes are added to the silver halide emulsions, they may be directly dispersed in the emulsions, or may be dissolved in single or mixed solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol and N,N-dimethylformamide, and added to the emulsions as solutions.

Further, methods which can be used in the present invention include a method of dissolving a dye in a volatile organic solvent, dispersing the resulting solution into water or a hydrophilic colloid, and adding the resulting dispersion to an emulsion, as described in U.S. Pat. No. 3,469,987; a method of dissolving a dye in an acid, and adding the resulting solution to an emulsion, or dissolving a dye in water in the presence of an acid or a base, and adding the resulting aqueous solution to an emulsion, as described in JP-B-44-23389, JP-B-44-27555 and JP-B-57-22091; a method of dissolving or dispersing a dye into water in the presence of a surfactant, and adding the resulting aqueous solution or colloidal dispersion to an emulsion, as described in U.S. Pat. Nos. 3,822,135 and 4,006,025; a method of directly dispersing a dye into a hydrophilic colloid, and adding the resulting dispersion to an emulsion, as described in JP-A-53-102733 and JP-A-58-105141; and a method of dissolving a dye by the use of a compound for red-shifting, and adding the resulting solution to an emulsion, as described in JP-A-51-74624. Further, ultrasonic waves can also be applied to the solution.

The sensitizing dyes used in the present invention may be added at any stages of the preparation of the silver halide emulsions which have hitherto been accepted to be useful. For example, they may be added at a silver halide grain formation stage and/or before salt removal, during a silver removal stage and/or from after salt removal to before the start of chemical ripening, as described in U.S. Pat. Nos. 2,735,766, 3,628,960, 4,183,756 and 4,225,666, JP-A-58-184142 and JP-A-60-196749, or at any time and stage before the coating of emulsions, such as immediately before or during chemical ripening, or from after chemical ripening to the coating of the emulsions, as described in JP-A-58-113920. Furthermore, as disclosed in U.S. Pat. No. 4,225,666 and JP-A-58-7629, the same compound may be singly added, or in combination with a compound having a different structure, divided, for example, into during a grain formation stage and during or after chemical ripening, or before or during chemical ripening and after chemical ripening. The kinds of compounds added in parts and combinations thereof may be changed.

In the present invention, the sensitizing dye may be used in a desired amount depending on performances such as sensitivity and fog. However, it is used preferably in an amount of $10^{-6}$ mol to 1 mol, and more preferably in an amount of $10^{-4}$ mol to $10^{-1}$ mol, per mol of silver halide of the light-sensitive layer.

In the present invention, the silver halide emulsion and/or the organic silver salt can be protected against formation of additional fog and stabilized against a reduction in sensitivity during storage by addition of an antifoggant, a stabilizer and a stabilizer precursor. Examples of the antifoggants, stabilizers and stabilizer precursors, which may be either alone or in combination, include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazole described in U.S. Pat. No. 3,287,135, sulfocatechol described in U.S. Pat. No. 3,235,652, oximes, nitrones and nitroindazole described in British Patent 623,448, multivalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazine described in U.S. Pat. Nos. 4,128,557, 4,137,079, 4,138,365 and 4,459,350, and phosphorus compounds described in U.S. Pat. No. 4,411,985.

Organic halides are preferably used as the antifoggants in the present invention, and examples thereof include compounds as disclosed in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

The antifoggants used in the present invention may be added in any forms such as solutions, powders or fine solid particle dispersions. The fine solid particles are dispersed by known finely dividing means (for example, ball mills, vibrating ball mills, sand mills, colloid mills, jet mills and roller mills). Further, dispersing aids may be used in dispersing the fine solid particles.

Although not necessary for the practice of the present invention, it is sometimes advantageous to add mercury (II) salts as the antifoggants to the emulsions. The mercury (II) salts preferred for this purpose are mercury acetate and mercury bromide. The amount of mercury used in the present invention is preferably $10^{-9}$ mol to $10^{-3}$ mol, and more preferably $10^{-8}$ mol to $10^{-4}$ mol, per mol of silver coated.

The photothermographic materials of the present invention may also contain benzoic acid derivatives for obtaining high sensitivity and preventing fog.

Any benzoic acid derivatives may be used in the present invention. However, preferred examples thereof include compounds described in U.S. Pat. Nos. 4,784,939 and 4,152,160, Japanese Patent Application Nos. 8-151242, 8-151241 and 8-98051. The benzoic acid derivatives may be added to any sites of the light-sensitive materials. However, they are preferably added to layers on faces having the light-sensitive layers, and more preferably to organic silver salt-containing layers. The benzoic acid derivatives used in the present invention may be added at any stages of the preparation of the coating solutions. When added to the organic silver salt-containing layers, they may be added at any stages from the preparation of the organic silver salts to the preparation of the coating solutions, preferably from after the preparation of the organic silver salts to immediately before coating. The benzoic acid derivatives used in the present invention may be added to the coating solutions in any forms such as solutions, powders or fine solid particle dispersions. Further, they may be added as solutions in which they are mixed with other additives such as sensitizing dyes, reducing agents and color toning agents. The benzoic acid derivatives used in the present invention may be added in any amount, but preferably in an amount of $10^{-6}$ mol to 2 mol, more preferably $10^{-3}$ mol to 0.5 mol, per mol of silver.

In the present invention, the light-sensitive materials may contain mercapto compounds, disulfide compounds or thione compounds for inhibiting or accelerating development, improving the spectral sensitizing efficiency and improving keeping quality before and after development.

When the mercapto compounds are used in the present invention, they may have any structure. However, a compound represented by Ar-SM or Ar-S-S-Ar (wherein M represents a hydrogen atom or an alkali metal atom, and Ar represents an aromatic or condensed aromatic ring having at least one of nitrogen, sulfur, oxygen, selenium and tellurium) is preferably used. An aromatic heterocycle is preferably benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. This aromatic heterocycle may have a substituent group, for example, selected from the group consisting of halogen (for example, Br and Cl), hydroxyl, amino, carboxyl, alkyl (for example, alkyl having at least one carbon atom, preferably 1 to 4 carbon atoms), alkoxyl (for example, alkoxyl having at least one carbon atom, preferably 1 to 4 carbon atoms) and aryl (which may have a substituent group). Mercapto-substituted aromatic heterocyclic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazoline, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, 3-(5-mercaptotetrazole)-sodium benzenesulfonate, N-methyl-N'-[3-(5-mercaptotetrazolyl)phenyl]urea and 2-mercapto-4-phenyloxazole, but the present invention is not limited thereto.

The amount of the mercapto compound added is preferably 0.0001 mol to 1.0 mol, and more preferably 0.001 mol to 0.3 mol, per mol of silver.

In the light-sensitive layers in the present invention, polyhydric alcohols (for example, glycerin and diols described in U.S. Pat. No. 2,960,404), fatty acids or esters described in U.S. Pat. Nos. 2,588,765 and 3,121,060, and silicone resins described in British Patent 955,061 can be used as plasticizers and lubricants.

In the second aspect of the present invention, super hard gradation enhancers can be used for formation of super hard images. For example, hydrazine derivatives described in U.S. Pat. Nos. 5,464,738, 5,496,695, 6,512,411 and 5,536,622, Japanese Patent Application Nos. 7-228627, 8-215822, 8-130842, 8-148113, 8-156378, 8-148111 and 8-148116, quaternary nitrogen atom-containing compounds described in Japanese Patent Application No. 8-83566, and acrylonitrile compounds described in U.S. Pat. No. 5,545,515 can be used. Specific examples of the compounds include compounds 1 to 10 described in U.S. Pat. No. 5,464,738, H-1 to H-28 described in U.S. Pat. No. 5,496,695, I-1 to I-86 described in Japanese Patent Application No. 8-215822, H-1 to H-62 described in Japanese Patent Application No. 8-130842, 1-1 to 1-21 described in Japanese Patent Application No. 8-148113, 1 to 50 described in Japanese Patent Application No. 8-148111, 1 to 40 described in Japanese Patent Application No. 8-148116, P-1 to P-26 and T-1 to T-18 described in Japanese Patent Application No. 8-83566 and CN-1 to CN-13 described in U.S. Pat. No. 5,545,515.

In the present invention, for formation of super hard images, super hard gradation accelerators can be used in combination with the above-mentioned super hard gradation enhancers. For example, amine compounds described in U.S. Pat. No. 5,545,505, specifically, AM-1 to AM-5, hydroxamic acids described in U.S. Pat. No. 5,545,507, specifically, HA-1 to HA-11, acrylonitrile compounds described in U.S. Pat. No. 5,545,507, specifically, CN-1 to CN-13, hydrazine compounds described in U.S. Pat. No. 5,558,983, specifically, CA-1 to CA-6, onium salts described in Japanese Patent Application No. 8-132836, specifically, A-1 to A-42, B-1 to B-27 and C-1 to C-14 can be used.

Synthesis and addition of these super hard gradation enhancers and super hard gradation accelerators can be performed according to the descriptions of the above-mentioned cited patents, and the amounts of the enhancers and the accelerators added can be determined according to them.

The image formation material in the present invention may be provided with a surface protection layer for preventing adhesion of the image formation layer.

Although binders for the surface protection layers used in the present invention may be any polymers, it is preferred that they contain carboxylic acid residue-containing polymers in an amount of 100 mg/m$^2$ to 5 g/m$^2$. The carboxylic acid residue-containing polymers as used herein include natural polymers (gelatin and alginic acid), modified natural polymers (carboxymethyl cellulose and phthalated gelatin) and synthetic polymers (polymethacrylates, polyacrylates, polyalkyl methacrylate/acrylate copolymers and polystyrene/polymethacrylate copolymers). The amount of carboxyl residues contained in said polymer is preferably 10 mmol to 1.4 mol per 100 g of polymer. Further, the carboxylic acid residues may form salts with alkali metal ions, alkaline earth metal ions or organic cations.

Any adhesion preventing materials may be used for the surface protection layers in the present invention. Examples of adhesion preventing materials include wax, silica particles, styrene-containing elastomeric copolymers (such as styrene-butadiene-styrene and styrene-isoprene-styrene), cellulose acetate, cellulose acetate butylate, cellulose propionate and mixtures thereof.

Further, crosslinking agents for crosslinking and surfactants for improving coating properties may be added to the surface protection layers.

In the image formation layers or the protection layers for the image formation layers used in the present invention, photographic elements containing light absorption materials and filter dyes as described in U.S. Pat. Nos. 3,253,921, 2,274,782, 2,527,583 and 2,956,879 can be used. Furthermore, the dyes can be mordanted as described, for example, in U.S. Pat. No. 3,282,699. The filter dyes are used in such an amount as to give an absorbance at an exposure wavelength of preferably 0.1 to 3, more preferably 0.2 to 1.5.

The image formation layers or the protection layers for the image formation layers used in the present invention can contain delustering agents such as starch, titanium dioxide, zinc oxide, silica and polymer beads containing beads of kinds described in U.S. Pat. Nos. 2,992,101 and 2,701,245. The matte degree of emulsion surfaces may be any, as long as no star dust trouble occurs. However, the Beck smoothness is preferably 200 seconds to 10,000 seconds, and particularly preferably 300 seconds to 10,000 seconds.

The photothermographic emulsion or emulsions of the present invention are applied onto a support as one or more layers. The one layer is required to contain the organic silver salt, the silver halide, a developing agent and the binder, and optional additional materials such as the color toning agent, an auxiliary coating agent and other auxiliary agents. For the two layer structure, a first emulsion layer (usually, a layer adjacent to the substrate) is required to contain the organic silver salt and the silver halide, and a second layer or both layers must contain some other components. However, a single emulsion layer containing all components and the two-layer structure comprising a protection top coat is also conceivable. The structure of a multicolor-sensitive photothermographic material may contain a combination of these two layers for each color, or all components in a single layer as described in U.S. Pat. No. 4,708,928. In the case of a multi-dye multicolor-sensitive photothermographic material, respective emulsion layers are generally kept distinguished from each other by using a functional or non-functional barrier layer between respective light-sensitive layers, as described in U.S. Pat. No. 4,460,681.

The light-sensitive layers used in the present invention can contain various kinds of dyes and pigments from the viewpoint of improvement in a color tone and prevention of irradiation. Although any dyes and pigments may be used in the light-sensitive layers of the present invention, for example, dyes and pigments described in Color Index can be used. Specific examples thereof include pyrazoloazole dyes, anthraquinone dyes, azo dyes, azomethine dyes, oxonol dyes, carbocyanine dyes, styryl dyes, triphenylmethane dyes, indoaniline dyes, indophenol dyes, organic pigments including phthalocyanine, and inorganic pigments. Preferred examples of the dyes used in the present invention include anthraquinone dyes (for example, compounds 1 to 9 described in JP-A-5-341441, and compounds 3-6 to 3-18 and 3-23 to 3-38 described in JP-A-5-165147), azomethine dyes (compounds 17 to 47 described in JP-A-5-341441), indoaniline dyes (for example, compounds 11 to 19 described in JP-A-5-289227, compound 47 described in JP-A-5-341441, and compounds 2–10 and 2–11 described in JP-A-5-165147), and azo dyes (compounds 10 to 16 described in JP-A-5-341441). These dyes may be added in any forms such as solutions, emulsions and fine solid particle dispersions, or in state where the dyes are mordanted with polymer mordants. Although the amount of these compounds used is determined depending upon the desired absorbed amount, it is generally preferred that they are used in an amount of 1 $\mu$g to 1 g per m$^2$.

In the present invention, an antihalation layer can be provided on the side far away from a light source with respect to the light-sensitive layer.

The antihalation layer preferably has a maximum absorption of 0.3 to 2 in a desired wavelength range, more preferably has an absorption at an exposure wavelength of 0.5 to 2. Further, the antihalation layer preferably has an absorption of 0.001 to less than 0.5 in a visible region after treatment, and more preferably has an optical density of 0.001 to less than 0.3.

When an antihalation dye is used in the present invention, it may be any compound, as long as it has a desired absorption in the wavelength range, is sufficiently low in absorption in the visible region after treatment, and gives a shape of a preferred absorption spectrum of the above-mentioned antihalation layer. Examples thereof include but are not limited to the following compounds. Examples of independent dyes include compounds described in JP-A-59-56458, JP-A-2-216140, and JP-A-7-13295, JP-A-7-11432, U.S. Pat. No. 5,380,635, JP-A-2-68539, page 13, lower left column, line 1 to page 14, lower left column, line 9 and JP-A-3-24539, page 14, lower left column to page 16, lower right column, and examples of dyes whose color disappears by treatment include compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734, U.S. Pat. Nos. 4,088,497, 4,283,487, 4,548,896 and 5,187,049.

It is preferred that the photothermographic material of the present invention is a so-called single light-sensitive material having at least one silver halide emulsion-containing light-sensitive layer on one side of the support and a back layer on the other side.

In respect to the single light-sensitive material of the present invention, a matte agent may be added to the surface protection layer for the light-sensitive emulsion layer and/or the back layer, or the surface protection layer for the back layer, for improving the transferring properties. The matte agent is generally fine particles of a water-insoluble organic or inorganic compound, and any one can be used. For example, matte agents well known in the art such as organic matte agents described in U.S. Pat. Nos. 1,939,213, 2,701,245, 2,322,037, 3,262,782, 3,539,344 and 3,767,448 and inorganic matte agents described in U.S. Pat. Nos. 1,260,772, 2,192,241, 3,257,206, 3,370,951, 3,523,022 and 3,769,020 can be used. Specific examples of the organic compounds which can be used as the matte agents include water-dispersible vinyl polymers such as polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate and polytetrafluoroethylene, cellulose derivatives such as methyl cellulose, cellulose acetate and cellulose acetate propionate, and starch derivatives such as carboxystarch, carboxynitrophenyl starch and urea-formaldehyde-starch reaction products. Gelatin hardened with a known hardening agent and hardened gelatin formed into fine capsule hollow granules by coacervate hardening can also be preferably used. Preferred examples of the inorganic compounds include silicon dioxide, titanium dioxide, magnesium dioxide, aluminum oxide, barium sulfate, calcium carbonate, silver chloride and silver bromide desensitized by known methods, glass and diatomaceous earth. The above-mentioned matte agents can be used as mixtures with different kinds of substances if necessary. There is no particular limitation on the size and shape of the matte agents, and ones having any particle size can be used. In the practice of the present invention, ones having a particle size of 0.1 μm to 30 μm are preferably used. The particle size distribution of the matte agents may be either narrow or wide. On the other hand, the matte agents significantly influence the haze and surface luster of the light-sensitive materials. It is therefore preferred that the size, shape and particle size distribution are adjusted to required conditions in the preparation of the matte agents or by mixing the plurality of matte agents.

In the present invention, the addition of the matte agents to the back layers is preferred, and as the matte degree of the back layers, it is preferred that the Beck smoothness is 10 seconds to 250 seconds, and more preferably 50 seconds to 180 seconds.

In the present invention, the matte agent is preferably contained in the outermost surface layer, a layer which functions as the outermost layer, or a layer close to the outer surface, of the light-sensitive material, and preferably contained in a layer which functions as the so-called protection layer. The matte degree of the protection layers for the emulsion surfaces may be any, as long as no star dust trouble occurs. However, the Beck smoothness is preferably 500 seconds to 10,000 seconds, and particularly preferably 500 seconds to 2,000 seconds.

A backside resistive heating layer disclosed in U.S. Pat. Nos. 4,460,681 and 4,374,921 can also be used in the photothermographic image system of the present invention.

In the present invention, suitable binders for the back layers are transparent or translucent, and generally colorless. They are natural and synthetic resins (polymers and copolymers) and other film forming media, and examples thereof include gelatin, gum arabic, polyvinyl alcohol, hydroxyethyl cellulose, cellulose acetate, cellulose acetate butylate, polyvinylpyrrolidone, casein, starch, polyacrylic acid, polymethyl methacrylate, polyvinyl chloride, polymethacrylic acid, copoly(styrene-maleic anhydride), copoly(styrene-acrylonitrile), copoly(styrene-butadiene), polyvinyl acetals (for example, polyvinyl formal and polyvinyl butyral), polyesters, polyurethanes, phenoxy resins, polyvinylidene chloride, polyepoxides, polycarbonates, polyvinyl acetate, cellulose esters and polyamides. The binders may be formed from aqueous solutions, organic solvent solutions or emulsions by coating.

In the first aspect of the present invention, it is preferred that the back layer has a maximum absorption of 0.3 to 2.0 in a desired wavelength range. When the desired range is 750 nm to 1,400 nm, the optical density at 360 nm to 750 nm is preferably 0.005 to less than 0.5, and an antihalation layer having an optical density of 0.001 to less than 0.3 is more preferred. When the desired range is less than 750 nm, a halation layer is preferred in which the maximum absorption in a desired range before image formation is 0.3 to 2.0 and the optical density at 360 nm to 750 rim after image formation becomes 0.005 to less than 0.3. There is no particular limitation on a method for reducing the optical density after image formation to the above-mentioned range, and examples thereof include a method of reducing the density according to a dye by color disappearance by heating as described in Belgian Patent 733,706, and a method of reducing the density by color disappearance by light irradiation as described in JP-A-54-17833.

In the second aspect of the present invention, the maximum absorption in a desired wavelength range of the back layer is preferably 0.3 to 2, and more preferably 0.5 to 2, and the absorption in the visible region after treatment is 0.001 to less than 0.5. Further, a layer having an optical density of 0.001 to less than 0.3 is more preferred. Examples of antihalation dyes used in the back layers are the same as described above for the antihalation layers.

A backside resistive heating layer disclosed in U.S. Pat. Nos. 4,460,681 and 4,374,921 can also be used in the photothermographic image system of the present invention.

A hardener may be used in each layer of the light-sensitive layer, the protection layer and the back layer of the present invention. Examples of the hardeners include polyisocyanates described in U.S. Patent 4,281,060 and JP-A-6-208193, epoxy compounds described in U.S. Patent 4,791,042, and vinylsulfone compounds described in JP-A-62-89048.

In the present invention, surfactants may be used for improving the coating property and the antistatic property. As the surfactants, any surfactants such as nonionic, anionic, cationic and fluorine surfactants may be appropriately used. Specific examples thereof include fluorine polymer surfactants described in JP-A-62-170950 and U.S. Pat. No. 5,380,644, fluorine surfactants described in JP-A-60-244945 and JP-A-63-188135, polysiloxane surfactants described in U.S. Pat. No. 3,885,965, and polyalkylene oxides and anionic surfactants described in JP-A-6-301140.

Examples of the solvents used in the present invention are described in *New Pocket Book of Solvents* (Ohm Co., 1994), but the present invention is not limited thereto. The boiling point of the solvents used in the present invention is preferably 40° C. to 180° C.

Examples of the solvents used in the present invention include hexane, cyclohqxane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine and water.

In general, various supports can be coated with the photothermographic emulsions used in the present invention. Typical supports include polyester films, undercoated polyester films, polyethylene terephthalate films, polyethylene naphthalate films, cellulose nitrate films, cellulose ester films, polyvinyl acetal films, polycarbonate films, related or resinous materials, glass, paper and metals. In particular, paper supports partially acetylated or coated with baryta and/or α-olefin polymers, particularly α-olefin polymers each having 2 to 10 carbon atoms such as polyethylene, polypropylene and ethylene-butene copolymers are typically used. Although the supports may be transparent or opaque, they are preferably transparent. Of these, biaxially oriented polyethylene terephthalate films having a thickness of about 75 μm to about 200 μm are particularly preferred.

On the other hand, when a plastic film is passed through a heat developing machine in which the film is treated at a temperature of 80° C. or more, the film expands and contracts in its dimension. When the material after treatment is used for printing plate making, this expansion and contraction introduces a serious problem in conducting precise color printing. In the present invention, therefore, films having reduced dimension changes are preferably used in which internal strains remaining in the films at the time of biaxial orientation have been relaxed to remove heat contraction strains generated during heat development. For example, a polyethylene terephthalate film is preferably used which has been heat treated at a temperature ranging from 100° C. to 210° C. before coating of the photothermographic emulsion. Films high in glass transition temperature are preferred, and polyether ethyl ketone, polystyrene, polysulfone, polyethersulfone, polyarylate and polycarbonate films can be used.

The light-sensitive material of the present invention may have an antistatic or conductive layer such as a layer containing a soluble salt (for example, a chloride or a nitrate), a metal-deposited layer, an ionic polymer-containing layer described in U.S. Pat. Nos. 2,861,056 and 3,206,312, an insoluble inorganic salt-containing layer described in U.S. Pat. No. 3,428,451, or a layer containing fine tin oxide particles described in JP-A-60-252349 and JP-A-57-104931.

Methods for obtaining color images by using the photothermographic materials of the present invention include methods described in JP-A-7-13295, page 10, left column, line 43 to page 11, left column, line 40. Further, examples of stabilizers for color dye images are described in British Patent 1,326,889, U.S. Pat. Nos. 3,432,300, 3,698,909, 3,574,627, 3,573,050, 3,764,337 and 4,042,394.

The photothermographic materials used in the present invention can be applied by various coating operations such as dip coating, air knife coating, flow coating and extrusion coating using a hopper described in U.S. Pat. No. 2,681,294. Two or more layers can be formed at the same time by methods described in U.S. Pat. No. 2,761,791 and British Patent 837,095, if desired.

The photothermographic materials of the present invention can contain additional layers such as dye receiving layers for receiving moving dye images, opaqued layers used in cases where reflection printing is desired, protection top coat layers and primer layers known in the light-heat photographic art. In the light-sensitive material of the present invention, it is preferred that the use of only one sheet of the light-sensitive material permits image formation, not accompanied by another layer having functions necessary for image formation, such as an image receiving layer.

The light-sensitive materials of the present invention may be developed by any methods. However, the light-sensitive materials exposed imagewise are usually developed by elevating the temperature thereof. The developing temperature is preferably 80° C. to 250° C., and more preferably 100° C. to 140° C. The developing time is preferably 1 second to 180 seconds, and more preferably 10 seconds to 90 seconds.

Although the light-sensitive materials of the present invention may be exposed by any methods, laser light sources are preferably used as exposure light sources. Preferred examples of the lasers used in the present invention include gas lasers, YAG lasers, dye lasers and semiconductor lasers. Further, the semiconductor lasers and second harmonic generating elements can also be used in combination.

The light-sensitive materials of the present invention tend to be low in haze in exposure and develop interference fringes. As methods for preventing the interference fringes from being developed, a method of allowing laser light to be obliquely incident upon the light-sensitive material as disclosed in JP-A-5-113548 and a method utilizing a multimode laser disclosed in WO 95/31754 are known, and these methods are preferably used.

When the light-sensitive materials of the present invention are exposed, it is preferred that they are exposed so that laser light overlaps to make scanning lines invisible, as disclosed in *SPIE*, vol. 169, Laser Printing, pages 116 to 128 (1979), JP-A-4-51043 and WO 95/31754.

The present invention will be described in more detail with reference to the following examples, but are not limited thereto.

EXAMPLE 1

<Preparation of Silver Halide Grains>

(Emulsion A)

In 700 ml of water, 11 g of phthalated gelatin, 30 mg of potassium bromide and 10 mg of sodium thiosulfonate were dissolved, and the pH was adjusted to 5.0 at a temperature of 35° C. Thereafter, 159 ml of an aqueous solution containing 18.6 g of silver nitrate and a 1 mol/liter aqueous solution of potassium bromide were added thereto by the controlled double jet method for 6.5 minutes while maintaining the pAg at 7.7. Then, 476 ml of an aqueous solution containing 55.4 g of silver nitrate and an aqueous halide solution containing 1 mol/liter of potassium bromide were added thereto by the controlled double jet method for 30 minutes while maintaining the pAg at 7.7. Thereafter, 1 g of 4-hydroxy-6-methyl-1,3,3a,7-tetraazaindene was added, the pH was further lowered to perform coagulating sedimentation, and the desalting treatment was conducted. Then, 0.1 g of phenoxyethanol was added to adjust the solution to pH 5.9 and pAg 8.2, thereby terminating the preparation of silver bromide grains (cubic grains having a mean grain size of 0.12 μm, a coefficient of variation of projected areas of 8% and a (100) face ratio of 88%).

The temperature of the silver halide grains thus prepared was elevated to 60° C., and 85 μmol of sodium thiosulfonate per mol of silver was added thereto, followed by ripening for 120 minutes. After rapid cooling to 40° C., 100 μmol of dye S-1, 500 μmol of 2-mercapto-5-methylbenzoimidazole, 500 μmol of N-methyl-N'-{3-(mercaptotetrazolyl)phenyl}urea, 500 μmol of compound A and 500 μmol of compound B were added, followed by rapid cooling to 30° C. to prepare silver halide emulsion A.

(Emulsions B to E)

Emulsions B to E were prepared in the same manner as with emulsion A with the exception that metal complexes were added to the aqueous halide solution of emulsion A as shown in Table 24.

(Emulsion F)

In 1000 ml of water, 27 g of phthalated gelatin, 1.8 g of sodium chloride and 10 mg of sodium thiosulfonate were dissolved, and the pH was adjusted to 5.0 at a temperature of 40° C. Thereafter, 120 ml of an aqueous solution containing 60 g of silver nitrate and 120 ml of aqueous halide solution A containing 21.6 g of sodium chloride were added thereto by the controlled double jet method for 4 minutes. Then, 30 ml of an aqueous solution containing 15 g of silver nitrate and 30 ml of aqueous halide solution B containing 4.35 g of sodium chloride and 2.13 g of potassium bromide were added thereto for 2 minutes. Thereafter, 2 g of 4-hydroxy-6-methyl-1,3,3a,7-tetraazaindene was added, the pH was further lowered to perform coagulating sedimentation, and the desalting treatment was conducted. Then, 0.1 g of phenoxyethanol was added to adjust the solution to pH 5.9 and pAg 7.6, thereby terminating the preparation of silver chlorobromide grains (cubic grains having a silver bromide content of 6 mol %, a mean grain size of 0.12 μm and a coefficient of variation of projected areas of 8%).

The temperature of the silver halide grains thus prepared was elevated to 60° C., and 85 μmol of sodium thiosulfate, 11 μmol of 2,3,4,5,6-pentafluorophenyldiphenylphosphine selenide, 15 μmol of a tellurium compound and 120 μmol of chloroauric acid, per mol of silver were added thereto, followed by ripening for 120 minutes. After rapid cooling to 40° C., 100 μmol of dye S-1, 500 μmol of 2-mercapto-5-methylbenzoimidazole, 500 μmol of N-methyl-N'-{3-(5-mercaptotetrazolyl)phenyl}urea, 500 μmol of compound A and 500 μmol of compound B were added, followed by rapid cooling to 30° C. to obtain silver halide emulsion F.

Dye S-1

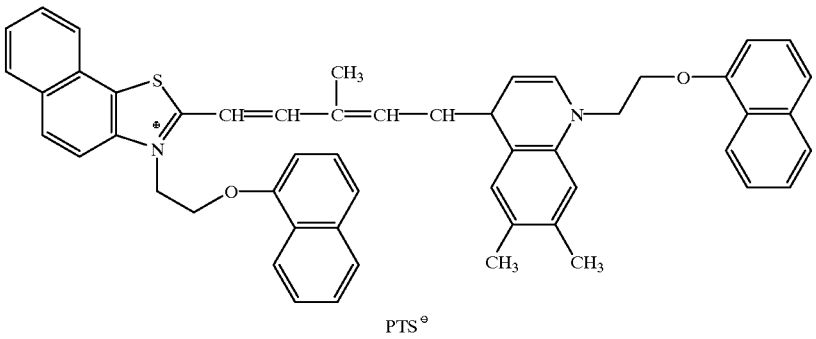

Compound A

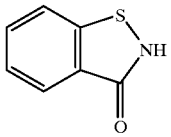

Compound B

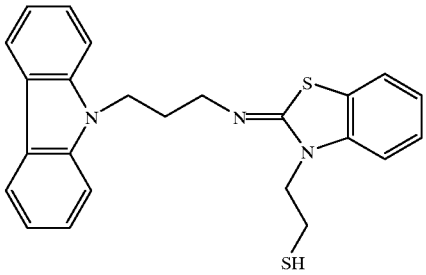

(Emulsions G to T)

In the preparation of emulsion F, the amounts of sodium chloride and potassium bromide contained in aqueous halide solution A and aqueous halide solution B were changed, thereby changing halogen compositions, and metal complexes of the present invention were added to the aqueous halide solutions as shown in Table 24 to form grains, thus obtaining silver halide emulsions G to T. For example, in emulsion G, $K_2RhCl_5(H_2O)$ corresponding to $1\times10^{-5}$ mol per mol of silver was added to the aqueous halide solution when the emulsion was prepared.

<Preparation of Dispersion of Silver Salt of Organic Acid>

103 ml of a 1 N aqueous solution of sodium hydroxide was added to 4.4 g of arachic acid, 39.4 g of behenic acid and 770 ml of water for 60 minutes while stirring them at 85° C., and reacted for 240 minutes. The temperature of the resulting product was lowered to 75° C. Then, 112.5 ml of an aqueous solution of 19.2 g of silver nitrate was added for 45 seconds, and the resulting mixture was allowed to stand as such for 20 minutes. The temperature thereof was lowered to 30° C. Thereafter, solid components were separated by suction filtration, and washed with water until the conductivity of a filtrate reached 30 μS/cm. To the solid components thus obtained, 100 g of a 10% by weight aqueous solution of PVA-205 (polyvinyl alcohol, manufactured by Kuraray Co., Ltd.), and further, water was added to make the total weight 270 g. Then, the resulting mixture was crudely dispersed in an automatic mortar to obtain a crude dispersion of a silver salt of an organic acid. This crude dispersion of the silver salt of the organic acid was dispersed with a Nanomizer (manufactured by Nanomizer Co.) at a pressure on collision of 1000 kg/cm$^2$ to obtain a dispersion of the silver salt of the organic acid. Particles of the silver salt of the organic acid contained in the dispersion of the silver salt of the organic acid thus obtained were needle particles having an average length of the short axis of 0.04 μm, an average length of the long axis of 0.8 μm, and a coefficient of variation of 30%.

<Preparation of Reducing Agent Dispersion>

To 100 g of 1,1-bis(2-hydroxy-3,5-dimethylphenyl)-3,5,5-trimethylhexane and 50 g of hydroxypropyl cellulose, 850 g of water was added, and sufficiently mixed to prepare a slurry. The slurry was placed in a vessel together with 840 g of zirconia beads having an average diameter of 0.5 mm, and dispersed with a dispersing device (a 1/4G sand grinder mill, manufactured by Eimex Co.) for 5 hours to obtain a reducing agent dispersion.

<Preparation of Organic Polyhalide Dispersion>

To 50 g of tribromomethylphenylsulfone and 10 g of hydroxypropylmethyl cellulose, 940 g of water was added, and sufficiently mixed to prepare a slurry. The slurry was placed in a vessel together with 840 g of zirconia beads having an average diameter of 0.5 mm, and dispersed with a dispersing device (a 1/4G sand grinder mill, manufactured by Eimex Co.) for 5 hours to obtain an organic polyhalide dispersion.

<Preparation of Coating Solutions for Emulsion Layers>

To 100 g of the dispersion of the silver salt of the organic acid, 20 g of the reducing agent dispersion and 15 g of the organic polyhalide dispersion obtained above, 20 g of LACSTAR 3307B (SBR latex, manufactured by Dainippon Ink & Chemicals, Inc.), 20 g of a 10% by weight aqueous solution of MP-203 (polyvinyl alcohol, manufactured by Kuraray Co., Ltd.), 20 g of each silver halide emulsion and further, 100 g of water were added, and sufficiently mixed. Thus, respective coating solutions for emulsion layers were prepared.

<Preparation of PET Support Provided with Back/Undercoat Layers>

(1) Support

Using terephthalic acid and ethylene glycol, PET having an IV of 0.66 (measured in phenol/tetrachloroethane (having a weight ratio of 6/4) at 25° C.) was obtained. This was pelletized, and dried at 130° C. for 4 hours. Then, this was melted at 300° C., and extruded through a T die, followed by rapid cooling to prepare an unoriented film having such a thickness as to give a film thickness of 120 μm after heat setting.

This unoriented film was oriented lengthwise 3.3 times by use of rolls different from each other in peripheral speed, and then, crosswise 4.5 times with a tenter. At this time, the temperatures were 110° C. and 130° C., respectively. Then, the oriented film was heat set at 240° C. for 20 seconds, and thereafter relaxed crosswise by 4% at the same temperature. Then, after portions chucked with the tenter was slit off, the knurl treatment was applied to both edges, and the resulting film was taken up at a tension of 4.8 kg/cm$^2$. Thus, a roll having a width of 2.4 m, a length of 3500 m and a thickness of 120 μm was obtained.

| | |
|---|---|
| (2) Undercoat Layer | |
| Undercoat Layer (a) | |
| Polymer Latex (1) Styrene/Butadiene/Hydroxyethyl Methacrylate/Divinylbenzene = 67/30/2.5/0.5 (% by weight) | 160 mg/m$^2$ |
| 2,4-Dichloro-6-hydroxy-s-triazine | 4 mg/m$^2$ |
| Matte Agent (polystyrene, average particle size: 2.4 μm) | 3 mg/m$^2$ |
| Undercoat Layer (b) | |
| Alkali-Treated Gelatin ($Ca^{2+}$ content: 30 ppm, jelly strength: 230 g) | 50 mg/m$^2$ |
| Compound C an amount coated giving an optical density at 780 nm of 0.7 | |
| (3) Conductive Layer | |
| Jurymer ET-410 (manufactured by Nippon Junyaku Co., Ltd.) | 38 mg/m$^2$ |
| $SnO_2$/Sb (having a weight ratio of 9/1, average particle size: 0.25 μm) | 120 mg/m$^2$ |
| Matte Agent (polymethyl methacrylate, average particle size: 5 μm) | 7 mg/m$^2$ |
| Melamine | 13 mg/m$^2$ |
| (4) Protection Layer | |
| Chemipearl S-120 (manufactured by Mitsui Petrochemical Industries, Ltd.) | 500 mg/m$^2$ |
| Snowtex-C (manufactured by Nissan Chemical Industries, Ltd.) | 40 mg/m$^2$ |
| Denacol EX-614B (manufactured by Nagase Kasei Kogyo Co., Ltd.) | 30 mg/m$^2$ |

Both faces of the support were coated in turn with undercoat layer (a) and undercoat layer (b), and each dried at 180° C. for 4 minutes. Then, one face on undercoat layer (a) and undercoat layer (b) was coated in turn with the conductive layer and the protection layer, and each dried at 180° C. for 4 minutes to prepare a PET support provided with the back/undercoat layers.

The PET support provided with the back/undercoat layers thus prepared was transferred at a tension of 3 kg/m$^2$ at a transfer speed of 20 m/minute through a heat treatment zone having the whole length of 200 m and set at 200° C. Then, the support was passed through a zone of 40° C. for 15 seconds, and taken up at a winding tension of 10 kg/m$^2$.

Compound C

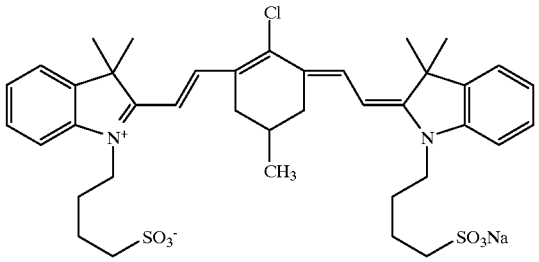

<Preparation of Coating Solution for Emulsion Face Protection Layer>

To 500 g of a 40% polymer latex (methyl methacrylate/styrene/2-ethylhexyl acrylate/2-hydroxyethyl methacrylate/acrylic acid (59/9/26/5/1) copolymer), 262 g of $H_2O$ was added. Then, 14 g of benzyl alcohol, 2.5 g of compound D, 3.6 g of Serozoru 524 (manufactured by Chukyo Yushi Co., Ltd.), 12 g of compound E, 1 g of compound F, 2 g of compound G and 7.5 g of compound H as auxiliary film forming agents, and 3.4 g of fine polymethyl methacrylate particles having an average particle size of 3 $\mu$m as a matte agent were added in turn. $H_2O$ was further added to make the total weight 1000 g, thus preparing a coating solution having a viscosity of 5 cp (25° C.) and a pH of 3.4 (25° C.).

Compound D

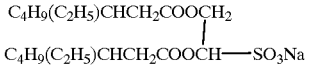

Compound E

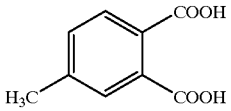

Compound F

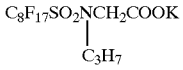

-continued

Compound G

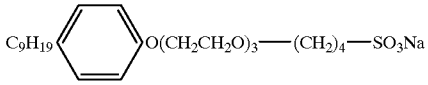

Compound H

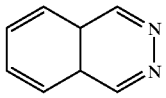

<Preparation of Heat Image Formation Materials>

Each coating solution for the emulsion layer was applied onto the undercoat layer of the above-mentioned PET support provided with the back/undercoat layers so as to give an amount of silver coated of 1.6 g/m$^2$. The above-mentioned coating solution for the emulsion face protection layer was further applied onto it so as to give an amount of the polymer latex coated of 2.0 g/m$^2$. Thus, respective heat image formation materials were prepared.

<Evaluation of Photographic Properties>

The resulting coated samples were exposed to a xenon flush light having an emission time of $10^{-6}$ second through an interference filter having a peak at 780 nm and a step wedge, and then, processed (developed) at 125° C. for 15 seconds. The resulting images were evaluated with a Macbeth densitometer. Results of the measurement were evaluated by Dmin (UV and Vis), sensitivity (the reciprocal of a ratio of an exposure giving a density 3.0 higher than Dmin) and contrast. As to the sensitivity, the sensitivity of photographic material 1 was taken as 100. The contrast was represented by a slope of a line connecting points of density 0.1 and density 3.0, plotting the logarithm of the exposure as abscissa.

For each light-sensitive material, the above-mentioned evaluation was performed. Results thereof are shown in Table 24.

TABLE 24

| No. | Emulsion | Br Content | Dopant | Amount Added (mol/mol AgX) | Sensitivity | Contrast | Dmin (UV) | Dmin (Vis) | Remark |
|---|---|---|---|---|---|---|---|---|---|
| 1 | A | AgBr | Not added | — | 100 (standard) | 5 | 0.24 | 0.10 | |
| 2 | B | AgBr | $[RhCl_5(H_2O)]^{2-}$ | $1 \times 10^{-5}$ | 80 | 5.2 | 0.22 | 0.08 | |
| 3 | C | AgBr | $[RuCl_5(NO)]^{2-}$ | $1 \times 10^{-5}$ | 85 | 5.5 | 0.22 | 0.08 | |
| 4 | D | AgBr | $[IrCl6]^{3-}$ | $1 \times 10^{-5}$ | 90 | 5.8 | 0.22 | 0.08 | |
| 5 | E | AgBr | $[ReCl_5(NS)]^{2-}$ | $1 \times 10^{-5}$ | 85 | 5.5 | 0.22 | 0.08 | |
| 6 | F | $AgBr_{10}Cl_{90}$ | Not added | — | 150 | 4.5 | 0.21 | 0.15 | |
| 7 | G | $AgBr_{10}Cl_{90}$ | $[RhCl_5(H_2O)]^{2-}$ | $1 \times 10^{-5}$ | 110 | 6.5 | 0.14 | 0.09 | Invention |
| 8 | H | $AgBr_{10}Cl_{90}$ | $[RuCl_5(NO)]^{2-}$ | $1 \times 10^{-5}$ | 115 | 7 | 0.14 | 0.08 | Invention |
| 9 | I | $AgBr_{10}Cl_{90}$ | $[IrCl_6]^{3-}$ | $1 \times 10^{-5}$ | 140 | 6.8 | 0.16 | 0.10 | Invention |
| 10 | J | $AgBr_{10}Cl_{90}$ | $[OsCl_6]^{3-}$ | $1 \times 10^{-5}$ | 108 | 6.8 | 0.14 | 0.09 | Invention |
| 11 | K | $AgBr_{10}Cl_{90}$ | $[ReCl_5(NS)]^{2-}$ | $1 \times 10^{-5}$ | 100 | 6.5 | 0.14 | 0.09 | Invention |
| 12 | L | $AgBr_{30}Cl_{70}$ | Not added | — | 160 | 4.7 | 0.19 | 0.12 | |
| 13 | M | $AgBr_{30}Cl_{70}$ | $[RhCl_5(H_2O)]^{2-}$ | $1 \times 10^{-5}$ | 120 | 6.3 | 0.16 | 0.09 | Invention |
| 14 | N | $AgBr_{30}Cl_{70}$ | $[RuCl_5(NO)]^{2-}$ | $1 \times 10^{-5}$ | 125 | 6.7 | 0.16 | 0.08 | Invention |
| 15 | O | $AgBr_{30}Cl_{70}$ | $[IrCl_6]^{3-}$ | $1 \times 10^{-5}$ | 150 | 6.5 | 0.16 | 0.10 | Invention |
| 16 | P | $AgBr_{30}Cl_{70}$ | $[OsCl_6]^{3-}$ | $1 \times 10^{-5}$ | 120 | 6.5 | 0.16 | 0.09 | Invention |

TABLE 24-continued

| No. | Emulsion | Br Content | Dopant | Amount Added (mol/mol AgX) | Sensitivity | Contrast | Dmin (UV) | Dmin (Vis) | Remark |
|---|---|---|---|---|---|---|---|---|---|
| 17 | Q | $AgBr_{30}Cl_{70}$ | $[ReCl_5(NS)]^{2-}$ | $1 \times 10^{-5}$ | 110 | 6.3 | 0.16 | 0.09 | Invention |
| 18 | R | $AgBr_{60}Cl_{40}$ | Not added | — | 155 | 4.6 | 0.22 | 0.11 | |
| 19 | S | $AgBr_{60}Cl_{40}$ | $[RhCl_5(H_2O)]^{2-}$ | $1 \times 10^{-5}$ | 125 | 4.8 | 0.20 | 0.09 | |
| 20 | T | $AgBr_{60}Cl_{40}$ | $[RuCl_5(NO)]^{2-}$ | $1 \times 10^{-5}$ | 130 | 5 | 0.20 | 0.08 | |

The results show that the samples of the present invention give high sensitivity, high contrast and low Dmin (particularly in the UV region).

EXAMPLE 2

N-(2-methoxyphenyl)-N'-formylhydrazine was added to the coating solution for the emulsion layer used in Example 1 so as to give an amount coated of 15 mg/m$^2$ to prepare light-sensitive materials.

The samples were exposed in the same manner as with Example 1, processed (developed) at 120° C. for 25 seconds, and evaluated in the same manner as with Example 1.

Results of evaluation are shown in Table 25.

TABLE 25

| No. | Emulsion | Br Content | Dopant | Amount Added (mol/mol AgX) | Contrast | Dmin (UV) | Dmin (Vis) | Remark |
|---|---|---|---|---|---|---|---|---|
| 1 | A | AgBr | Not added | — | Impossible to evaluate | 2.50 | 2.00 | |
| 2 | B | AgBr | $[RhCl_5(H_2O)]^{2-}$ | $1 \times 10^{-5}$ | 11 | 0.28 | 0.15 | |
| 3 | C | AgBr | $[RuCl_5(NO)]^{2-}$ | $1 \times 10^{-5}$ | 12 | 0.26 | 0.10 | |
| 4 | D | AgBr | $[IrCl6]^{3-}$ | $1 \times 10^{-5}$ | 13 | 0.28 | 0.09 | |
| 5 | E | AgBr | $[ReCl_5(NS)]^{2-}$ | $1 \times 10^{-5}$ | 11 | 0.28 | 0.09 | |
| 6 | F | $AgBr_{10}Cl_{90}$ | Not added | — | Impossible to evaluate | 2.80 | 2.20 | |
| 7 | G | $AgBr_{10}Cl_{90}$ | $[RhCl_5(H_2O)]^{2-}$ | $1 \times 10^{-5}$ | 15 | 0.15 | 0.10 | Invention |
| 8 | H | $AgBr_{10}Cl_{90}$ | $[RuCl_5(NO)]^{2-}$ | $1 \times 10^{-5}$ | 17 | 0.15 | 0.09 | Invention |
| 9 | I | $AgBr_{10}Cl_{90}$ | $[IrCl_6]^{3-}$ | $1 \times 10^{-5}$ | 16 | 0.16 | 0.11 | Invention |
| 10 | J | $AgBr_{10}Cl_{90}$ | $[OsCl_6]^{3-}$ | $1 \times 10^{-5}$ | 16 | 0.15 | 0.10 | Invention |
| 11 | K | $AgBr_{10}Cl_{90}$ | $[ReCl_5(NS)]^{2-}$ | $1 \times 10^{-5}$ | 15 | 0.15 | 0.10 | Invention |
| 12 | L | $AgBr_{30}Cl_{70}$ | Not added | — | Impossible to evaluate | 2.50 | 2.00 | |
| 13 | M | $AgBr_{30}Cl_{70}$ | $[RhCl_5(H_2O)]^{2-}$ | $1 \times 10^{-5}$ | 13 | 0.17 | 0.10 | Invention |
| 14 | N | $AgBr_{30}Cl_{70}$ | $[RuCl_5(NO)]^{2-}$ | $1 \times 10^{-5}$ | 15 | 0.17 | 0.09 | Invention |
| 15 | O | $AgBr_{30}Cl_{70}$ | $[IrCl_6]^{3-}$ | $1 \times 10^{-5}$ | 14 | 0.17 | 0.10 | Invention |
| 16 | P | $AgBr_{30}Cl_{70}$ | $[OsCl_6]^{3-}$ | $1 \times 10^{-5}$ | 13 | 0.17 | 0.10 | Invention |
| 17 | Q | $AgBr_{30}Cl_{70}$ | $[ReCl_5(NS)]^{2-}$ | $1 \times 10^{-5}$ | 15 | 0.17 | 0.09 | Invention |
| 18 | R | $AgBr_{60}Cl_{40}$ | Not added | — | Impossible to evaluate | 2.20 | 1.90 | |
| 19 | S | $AgBr_{60}Cl_{40}$ | $[RhCl_5(H_2O)]^{2-}$ | $1 \times 10^{-5}$ | 12 | 0.21 | 0.10 | |
| 20 | T | $AgBr_{60}Cl_{40}$ | $[RuCl_5(NO)]^{2-}$ | $1 \times 10^{-5}$ | 12 | 0.22 | 0.10 | |

The results show that the samples of the present invention are low in Dmin and high in contrast, giving good performance.

EXAMPLE 3

<Preparation of Silver Halide Grains A'>

In 700 ml of water, 11 g of phthalated gelatin, 30 mg of potassium bromide and 10 mg of sodium benzenethiosulfonate were dissolved, and the pH was adjusted to 5.0 at a temperature of 40° C. Thereafter, 159 ml of an aqueous solution containing 18.6 g of silver nitrate and an aqueous solution of potassium bromide were added thereto by the controlled double jet method for 10 minutes while maintaining the pAg at 7.7. Then, 476 ml of an aqueous solution containing 55.4 g of silver nitrate and an aqueous solution of potassium bromide were added thereto by the controlled double jet method for 30 minutes while maintaining the pAg at 7.7. Thereafter, the pH was lowered to perform coagulating sedimentation, and the desalting treatment was conducted. Then, 1.75 g of phenoxyethanol was added to adjust the solution to pH 5.9 and pAg 8.0.

The resulting grains are cubic grains having a mean grain size of 0.07 $\mu$m, a coefficient of variation of projected area diameters of 8% and a (100) face ratio of 86%.

The temperature of the silver halide grains thus prepared was elevated to 60° C., and 76 $\mu$mol of sodium benzenethiosulfonate per mol of silver was added thereto. After 3 minutes, 154 $\mu$mol of sodium thiosulfate was added, followed by ripening for 100 minutes.

Then, the temperature was maintained at 40° C., and $6.7 \times 10^{-4}$ mol based on silver halide of the following sensitizing dye A and $6.9 \times 10^{-3}$ mol based on silver halide of compound B were added with stirring. After 20 minutes, the resulting product was rapidly cooled to 30° C. to terminate the preparation of silver halide grains A'.

<Preparation of Silver Halide Grains B'>

In 900 ml of water, 15 g of phthalated gelatin, 1.35 g of sodium chloride and 6.5 mg of sodium benzenethiosulfonate were dissolved, and the pH was adjusted to 5.0 at a temperature of 30° C. Thereafter, 120 ml of an aqueous solution containing 60 g of silver nitrate and 120 ml of an aqueous solution containing 21.6 g of sodium chloride were added thereto by the controlled double jet method for 2 minutes and 48 seconds. Then, 30 ml of an aqueous solution containing 15 g of silver nitrate and 30 ml of an aqueous solution containing 5.4 g of sodium chloride were added thereto by the controlled double jet method for 48 seconds. Thereafter, 2 g of 4-hydroxy-6-methyl-1,3,3a,7-tetraazaindene was added. After 3 minutes, the pH was lowered to perform coagulating sedimentation, and the desalting treatment was conducted. Then, 34 mg of compound A was added to adjust the solution to pH 5.9 and pAg 7.5.

The resulting grains are cubic grains having a mean grain size of 0.06 μm, a coefficient of variation of projected area diameters of 10% and a (100) face ratio of 95%.

The temperature of the silver halide grains thus prepared was elevated to 60° C., and 92 μmol of sodium benzenethiosulfonate per mol of silver was added thereto. After 2 minutes, 164 μmol of sodium thiosulfate was added, and 5 minutes after that, 98.5 μmol of chloroauric acid was further added, followed by ripening for 65 minutes. Two minutes after that, the temperature was-lowered to 40° C.

Then, the temperature was maintained at 40° C., and $6.7\times10^{-4}$ mol based on silver halide of the following sensitizing dye A and $6.9\times10^{-3}$ mol based on silver halide of compound B were added with stirring. After 20 minutes, the resulting product was rapidly cooled to 30° C. to terminate the preparation of silver halide grains B'.

<Preparation of Silver Halide Grains C'>

Silver halide grains C' were prepared in the same manner as with silver halide grains A' with the exception that potassium bromide used in silver halide grains A' was partly replaced by sodium chloride, the pAg and the temperature were appropriately adjusted, and the silver chloride content of the grains was changed to 20 mol %.

<Preparation of Silver Halide Grains D' to F'>

Silver halide grains D', E' and F' were prepared in the same manner as with silver halide grains B' with the exception that potassium bromide used in silver halide grains B' was partly replaced by sodium chloride, the pAg and the temperature were appropriately adjusted, and the silver chloride content of the grains was changed to 96 mol %, 80 mol % and 60 mol %.

<Preparation of Silver Halide Grains G'>

In 900 ml of water, 15 g of phthalated gelatin, 1.35 g of sodium chloride and 6.5 mg of sodium benzenethiosulfonate were dissolved, and the pH was adjusted to 5.0 at a temperature of 30° C. Thereafter, 120 ml of an aqueous solution containing 60 g of silver nitrate and 120 ml of an aqueous solution containing 21.6 g of sodium chloride were added thereto by the controlled double jet method for 2 minutes and 48 seconds. Then, 30 ml of an aqueous solution containing 15 g of silver nitrate and 30 ml of an aqueous solution containing 5.4 g of sodium chloride were added thereto by the controlled double jet method for 48 seconds, and in the course of the addition, fine silver bromide grains having a grain size of 0.05 μm were added in an amount of 9 mol % per mol of completed silver halide. Thereafter, 2 g of 4-hydroxy-6-methyl-1,3,3a,7-tetraazaindene was added. After 3 minutes, the pH was lowered to perform coagulating sedimentation, and the desalting treatment was conducted. Then, 34 mg of compound A was added to adjust the solution to pH 5.9 and pAg 7.5. After that, silver halide grains G' were prepared in the same manner as with silver halide grains B'.

The resulting grains are cubic grains having a mean grain size of 0.06 μm, a coefficient of variation of projected area diameters of 10% and a (100) face ratio of 95%.

The temperature of the silver halide grains thus obtained was elevated to 60° C., and 92 μmol of sodium benzenethiosulfonate per mol of silver was added thereto. After 2 minutes, 164 μmol of sodium thiosulfate was added, and 5 minutes after that, 98.5 μmol of chloroauric acid was further added, followed by ripening for 65 minutes. Then, 725 μmol of 4-hydroxy-6-methyl-1,3,3a,7-tetraazaindene was added, and 2 minutes after that, the temperature was lowered to 40° C.

Then, the temperature was maintained at 40° C., and $6.7\times10^{-4}$ mol based on silver halide of the following sensitizing dye A and $6.9\times10^{-3}$ mol based on silver halide of compound B were added with stirring. After 20 minutes, the resulting product was rapidly cooled to 30° C. to terminate the preparation of silver halide grains G'.

<Preparation of Silver Halide Grains H'>

In 900 ml of water, 15 g of phthalated gelatin, 1.35 g of sodium chloride and 6.5 mg of sodium benzenethiosulfonate were dissolved, and the pH was adjusted to 5.0 at a temperature of 30° C. Thereafter, 120 ml of an aqueous solution containing 60 g of silver nitrate and 120 ml of an aqueous solution containing 21.6 g of sodium chloride were added thereto by the controlled double jet method for 2 minutes and 48 seconds. Then, 30 ml of an aqueous solution containing 15 g of silver nitrate and 30 ml of an aqueous solution containing 4.32 g of sodium chloride and 2.19 g of potassium bromide were added thereto by the controlled double jet method for 48 seconds. Thereafter, 2 g of 4-hydroxy-6-methyl-1,3,3a,7-tetraazaindene was added. After 3 minutes, the pH was lowered to perform coagulating sedimentation, and the desalting treatment was conducted. Then, 34 mg of compound A was added to adjust the solution to pH 5.9 and pAg 7.5.

The resulting grains are cubic grains having a mean grain size of 0.06 μm, a coefficient of variation of projected area diameters of 11% and a (100) face ratio of 95%. After that, silver halide grains H' were prepared in the same manner as with silver halide grains B'. <Preparation of Silver Halide Grains I' to L'>

Silver halide grains I', J', K' and L' were prepared in the same manner as with silver halide grains A', B', G' and H', respectively, with the exception that the grain formation temperature of silver halide grains A', B', G' and H' was changed to vary the grain size to 0.11 μm.

Sensitizing Dye A

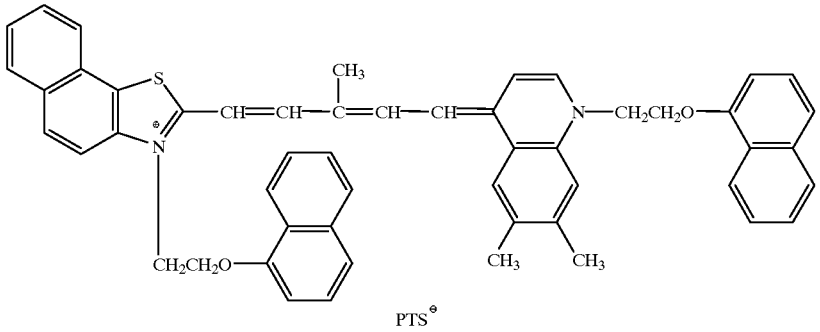

Compound A

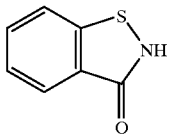

Compound B

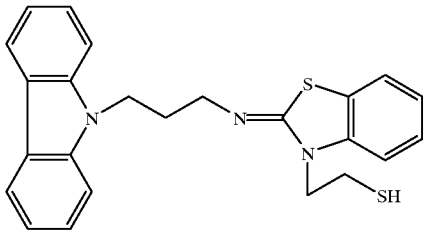

<Preparation of Dispersion of Silver Salt of Organic Acid>

103 ml of a 1 N aqueous solution of sodium hydroxide was added to 4.4 g of arachic acid, 39.4 g of behenic acid and 770 ml of water for 60 minutes while stirring them at 85° C., and reacted for 240 minutes. The temperature of the resulting product was lowered to 75° C. Then, 112.5 ml of an aqueous solution of 19.2 g of silver nitrate was added for 45 seconds, and the resulting mixture was allowed to stand as such for 20 minutes. The temperature thereof was lowered to 30° C. Thereafter, solid components were separated by suction filtration, and washed with water until the conductivity of a filtrate reached 30 $\mu$S/cm.

The solid components thus obtained were handled as a wet cake without drying. To the wet cake corresponding to 100 g of dried solid components, 10 g of polyvinyl alcohol (PVA-205, manufactured by Kuraray Co., Ltd.) and water were added to make the total weight 500 g, and the resulting mixture was preliminary dispersed with a homomixer.

Then, the original fluid preliminary dispersed was treated three times with a dispersing device (trade name: Microfluidizer M-110 S-EH, manufactured by Microfluidex International Corporation, using a G10Z interaction chamber), adjusting its pressure to 1750 kg/cm$^2$. Thus, a fine crystal dispersion of a silver salt of an organic acid having a volume weighted mean diameter of 0.39 $\mu$m was prepared. The particle size was measured with a Master Sizer X manufactured by Malvern Instruments Ltd. Coiled heat exchangers were each mounted in front of and behind the interaction chamber, and the temperature of a refrigerant was controlled thereby to set the dispersing temperature to a desired temperature.

<Preparation of Fine Solid Material Particle Dispersions>

For 1,1-bis(2-hydroxy-3,5-dimethylphenyl)-3,5,5-trimethylhexane and tribromomethylphenyl-sulfone, fine solid particle dispersions were prepared. To tribromomethylphenylsulfone, 0.81 g of hydroxypropylmethyl cellulose and 94.2 ml of water were added, and the resulting mixture was sufficiently stirred to prepare a slurry, followed by standing for 10 hours. Then, the slurry was placed in a vessel together with 100 ml of zirconia beads having an average diameter of 0.5 mm, and dispersed with the dispersing device used in the preparation of the dispersion of the silver salt of the organic acid for 5 hours to obtain a fine solid particle dispersion of tribromomethylphenylsulfone. The particle size of 70% by weight of the particles was 1.0 $\mu$m or less. For other materials, the amount of dispersing agents used and the dispersing time for obtaining desired average particle size were appropriately changed to obtain fine solid particle dispersions of the respective materials.

<Preparation of Coating Solutions for Emulsion Layers>

Based on the dispersion of the silver salt of the organic acid (corresponding to silver/mol) prepared above, each silver halide corresponding to 12 mol %/silver salt of organic acid, and the following binder and materials for development were used.

Binder: LACSTAR 3307B (SBR latex, manufactured by Dainippon Ink & Chemicals, Inc., glass transition termperature: 17° C.)

470 g as solid component 1,1-Bis(2-hydroxy-3,5-dimethylphenyl)-3,5,5-trimethylhexane 110 g as a solid component Tribromomethylphenylsulfone 25 g as a solid component 3,4-Dihydro-4-oxo-1,2,3-benzotriazine 5.2 g as a solid component Thus, respective coating solutions for emulsion layers were prepared.

<Preparation of Coating Solution for Emulsion Face Protection Layer>

A coating solution for an emulsion face protection layer having the following composition:

| | |
|---|---|
| Inert Gelatin | 14.4 g |
| N-perfluorooctylsulfonyl-N-propylalanine Potassium Salt | 0.37 g |
| Sodium Dodecylbenzenesulfonate | 0.13 g |
| Fine Polymethyl Methacrylate Particles (average particle size: 2.5 μm) - | 0.30 g |
| Phthalazine | 0.70 g |
| 4-Methylphthalic Acid | 1.27 g |
| Sulfuric Acid (1 N) | 7 cc |
| Water to make | 300 cc |

<Preparation of Undercoated Support>

To 880 ml of water, 100 ml of a styrene-butadiene copolymer latex (concentration: 30% by weight, average particle size: 110 nm, styrene/butadiene/acrylic acid=68/29/3 (weight ratio), 1.0 g of fine polymethyl methacrylate particles (average particle size: 2.5 μm), 0.5 g of fine polystyrene particles (average particle size: 2.5 μm) and 20 ml of surfactant B (1% by weight) were added to prepare a coating solution for undercoat.

The above-mentioned coating solution for undercoat was applied onto one face of a biaxial oriented polyethylene terephthalate support with a bar coater so as to give a dried film thickness of 0.3 μm (a wet amount coated of 10 cc/$M^2$), and dried at 180° C. for 5 minutes to prepare a undercoated support.

Then, the support was passed through a heat treatment zone of 200° C. at a tension of 3 kg/$cm^2$.

<Preparation of Photothermographic Materials>

Each the above-mentioned coating solutions for the emulsion layers was applied onto the above-mentioned undercoated support so as to give an amount of silver coated of 1.6 g/$m^2$. The coating solution for the emulsion face protection layer was further applied onto it so as to give an amount of gelatin coated of 1.7 g/$m^2$. Thus, photothermographic materials 1' to 12' were prepared.

<Evaluation of Density (Dmin) of Unexposed Areas>

The above-mentioned photothermographic materials unexposed were developed with a heat developing machine shown in FIG. 1 at 115° C. for 10 seconds, and the visible density (about 560 nm) and the UV density (about 360 nm) were measured with a Macbeth TD904 densitometer. Results obtained are shown in Table 23'.

TABLE 23'

| Photo-thermographic Material No. | Silver Halide Particles Name | Halogen Composition | Particle Size (μm) | Dmin (Visible Density) | Dmin (UV Density) |
|---|---|---|---|---|---|
| 1' | A' | AgBr | 0.07 | 0.12 | 0.26 |
| 2' (Invention) | B' | AgCl | 0.06 | 0.10 | 0.17 |
| 3' | C' | Cl = 20 mol % | 0.07 | 0.11 | 0.23 |
| 4' (Invention) | D' | Cl = 96 mol % | 0.06 | 0.10 | 0.17 |
| 5' (Invention) | E' | Cl = 80 mol % | 0.006 | 0.10 | 0.18 |
| 6' | F' | Cl = 60 mol % | 0.006 | 0.11 | 0.22 |
| 7' (Invention) | G' | Cl = 91 mol % | 0.006 | 0.10 | 0.18 |
| 8' (Invention) | H' | Cl = 96 mol % | 0.006 | 0.10 | 0.17 |
| 9' | I' | AgBr | 0.11 | 0.12 | 0.28 |
| 10' (Invention) | J' | AgCl | 0.11 | 0.10 | 0.18 |

TABLE 23'-continued

| Photo-thermographic Material No. | Silver Halide Particles Name | Halogen Composition | Particle Size (μm) | Dmin (Visible Density) | Dmin (UV Density) |
|---|---|---|---|---|---|
| 11' (Invention) | K' | Cl = 91 mol % | 0.11 | 0.10 | 0.18 |
| 12' (iNVENTION) | L' | Cl = 96 mol % | 0.11 | 0.10 | 0.18 |

It is apparent from Table 23' that photothermographic materials 2', 4', 5', 7', 8' and 10' to 12' of the present invention in which silver halide particles having a silver chloride content of 80 mol % or more are used are excellent in Dmin (UV density).

FIG. 1 is a side view showing the heat developing machine used in the present invention.

EXAMPLE 4

<Preparation of Silver Halide Grains M'>

Silver halide grains M' were prepared in the same manner as with silver halide grains A' with the exception that 5 minutes after addition of 154 μmol of sodium thiosulfate, 92.5 μmol of chloroauric acid was added, followed by ripening for 100 minutes.

<Preparation of Silver Halide Grains N'>

Silver halide grains N' were prepared in the same manner as with silver halide grains A' with the exception that after adjustment of the pH and pAg, the temperature was elevated to 60° C.; 92 μmol of sodium benzenethiosulfonate per mol of silver was added thereto; after 2 minutes, 164 μmol of sodium thiosulfate was added; 5 minutes after that, 98.5 μmol of chloroauric acid was further added, followed by ripening for 65 minutes; then, 725 μmol of 4-hydroxy-6-methyl-1,3,3a,7-tetraazaindene was added; and 2 minutes after that, the temperature was lowered to 40° C.

<Preparation of Silver Halide Grains O'>

Silver halide grains O' were prepared in the same manner as with silver halide grains H' with the exception that after addition of 164 μmol of sodium thiosulfate, ripening was conducted for 65 minuets, followed by addition of 725 μmol of 4-hydroxy-6-methyl-1,3,3a,7-tetraazaindene.

<Preparation of Silver Halide Grains P' and Q'>

Silver halide grains P' and Q' were prepared in the same manner as with silver halide grains G' with the exception that the fine silver bromide grains were added in amounts of 4.5 mol % and 13.5 mol % per mol of completed silver halide.

<Preparation of Photothermographic Materials>

For silver halide grains M' to Q', coating was performed in the same manner as with Example 3 to prepare photothermographic materials 13' to 17'.

<Evaluation of Photographic Properties>

The resulting photothermographic materials were exposed to a xenon flush light having an emission time of $10^{-6}$ second through an interference filter having a peak at 780 nm and a step wedge, and then, processed (developed) with the heat developing machine used in Example 1 at 115° C. for 20 seconds. The resulting images were evaluated with a Macbeth TD904 densitometer. Results of the measurement were evaluated by Dmin (visible and UV density) and sensitivity (the reciprocal of a ratio of an exposure giving a density 1.0 higher than Dmin). As to the sensitivity, the sensitivity of photographic material 1' was taken as 100. Results obtained are shown in Table 24'.

TABLE 24'

| Photo-thermographic Material No. | Silver Halide Grains Name | Halogen Composition | Gold Sensitization | Particle Size (μm) | Sensitivity | Dmin (visible) | Dmin (UV) |
|---|---|---|---|---|---|---|---|
| 1' | A' | AgBr | Not applied | 0.07 | 100 | 0.13 | 0.27 |
| 13' | M' | AgBr | Applied | 0.07 | 141 | 0.25 | 0.39 |
| 14' | N' | AgBr | Applied | 0.07 | 126 | 0.21 | 0.35 |
| 8' (Invention) | H' | Cl = 96 mol % | Applied | 0.06 | 158 | 0.11 | 0.18 |
| 15' | O' | Cl = 96 mol % | Not applied | 0.06 | 79 | 0.09 | 0.16 |
| 16' (Invention) | P' | Cl = 95.5 mol % | Applied | 0.06 | 151 | 0.11 | 0.19 |
| 17' (Invention) | Q' | Cl = 86.5 mol % | Applied | 0.06 | 155 | 0.10 | 0.17 |
| 4' (Invention) | D' | Cl = 96 mol % | Applied | 0.06 | 105 | 0.13 | 0.19 |
| 5' (Invention) | E' | Cl = 80 mol % | Applied | 0.06 | 151 | 0.11 | 0.19 |

Table 24' reveals that gold sensitization to silver bromide significantly increases Dmin, whereas in the particles of the present invention having a silver chloride content of 80 mol % or more, an increase in Dmin is relatively small, which makes it possible to improve the sensitivity. It is therefore apparent that the present invention is effective.

Further, a comparison of photothermographic material 4' in which the halogen composition of the silver halide grains is uniform (Cl=96 mol %) and photothermographic materials 8' and 16' in which the silver halide grains having localized phases of silver bromide on their surfaces are used shows that photothermographic materials 8' and 16' more excellent than photothermographic material 4', from the viewpoint of the sensitivity and the Dmin.

EXAMPLE 5

<Preparation of Photothermographic Materials>

Photothermographic materials 18' to 20' were prepared in the same manner as with Example 3 with the exception that the amount of the silver halides contained in the coating solutions for the emulsion layers of photothermographic materials 10' to 12' of Example 3 was changed to an amount corresponding to 5 mol %/silver salt of organic acid, N-(2-methoxyphenyl)-N'-formylhydrazine was added to the coating solutions so as to give an amount coated of 20 mg/m$^2$, and silver halide particles shown in Table 25' were used.

<Evaluation of Photographic Properties>

Evaluation was made in the same manner as with Example 4. The contrast was represented by a slope of a line connecting points of density 0.1 and density 3.0, plotting the logarithm of the exposure as abscissa. As to the sensitivity, the sensitivity of photothermographic material 12' of Example 3 was taken as 100.

Results obtained are shown in Table 25'.

Table 25' reveals that the use of hydrazine compounds in the present invention improves the sensitivity and the contrast. Further, Table 25' shows that photothermographic materials 19' and 20' having localized phases of silver bromide are more excellent in sensitivity, contrast and Dmin than photothermographic material 18' using silver chloride.

EXAMPLE 6

Photothermographic materials 21' to 23' were prepared in the same manner as with photothermographic materials 18' to 20' of Example 5 with the exception that the undercoated supports and emulsion face protection layers were replaced by the following.

For these materials, the photographic properties were evaluated in the same manner as with Example 5. Consequently, results similar to those of Example 5 were obtained.

<Preparation of PET Support Provided with Back/Undercoat Layers>

(1) Support

Using terephthalic acid and ethylene glycol, PET having an IV of 0.66 (measured in phenol/tetrachloroethane (having a weight ratio of 6/4) at 25° C.) was obtained. This was pelletized, and dried at 130° C. for 4 hours. Then, this was melted at 300° C., and extruded through a T die, followed by rapid cooling to prepare an unoriented film having such a thickness as to give a film thickness of 120 μm after heat setting.

This unoriented film was oriented lengthwise 3.3 times by use of rolls different from each other in peripheral speed, and then, crosswise 4.5 times with a tenter. At this time, the temperatures were 110° C. and 130° C., respectively. Then, the oriented film was heat set at 240° C. for 20 seconds, and thereafter relaxed crosswise by 4% at the same temperature. Then, after portions chucked with the tenter was slit off, the

TABLE 25'

| Photo-thermographic Material No. | Silver Halide Grains Name | Halogen Composition | Particle (μm) | Sensitivity | Contrast | Dmin (Visible) | Dmin (UV) |
|---|---|---|---|---|---|---|---|
| 18' (Invention) | J' | AgBr | 0.11 | 191 | 10 | 0.13 | 0.20 |
| 19' (Invention) | K' | Cl = 91 mol % | 0.11 | 316 | 13 | 0.08 | 0.15 |
| 20' (Invention) | L' | Cl = 96 mol % | 0.11 | 309 | 13 | 0.09 | 0.16 |
| 12' (Invention) | L' | Cl = 96 mol % | 0.11 | 100 | Impossible to evaluate | 0.08 | 0.14 |

knurl treatment was applied to both edges, and the resulting film was taken up at a tension of 4.8 kg/cm$^2$. Thus, a roll having a width of 2.4 m, a length of 3500 m and a thickness of 120 $\mu$m was obtained.

| | |
|---|---|
| (2) Undercoat Layer | |
| Undercoat Layer (a) | |
| Polymer Latex (1) | |
| Styrene/Butadiene/Hydroxyethyl Methacrylate/Di-vinylbenzene = 67/30/2.5/0.5 (% by weight) | 160 mg/m$^2$ |
| 2,4-Dichloro-6-hydroxy-s-triazine | 4 mg/m$^2$ |
| Matte Agent (polystyrene, average particle size: 2.4 $\mu$m) | 3 mg/m$^2$ |
| Undercoat Layer (b) | |
| Alkali-Treated Gelatin (Ca++ content: 30 ppm, jelly strength: 230 g) | 50 mg/m$^2$ |
| Compound C | an amount coated giving an optical density at 780 nm of 0.7 |

Compound C

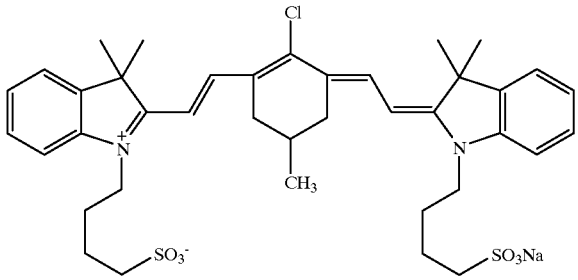

| | |
|---|---|
| (3) Conductive Layer | |
| Jurymer ET-410 (manufactured by Nippon Junyaku Co., Ltd.) | 38 mg/m$^2$ |
| $SnO_2$/Sb (having a weight ratio of 9/1, average particle size: 0.25 $\mu$m) | 120 mg/m$^2$ |
| Matte Agent (polymethyl methacrylate, average particle size: 5 $\mu$m) | 7 mg/m$^2$ |
| Melamine | 13 mg/m$^2$ |
| (4) Protection Layer | |
| Chemipearl S-120 (manufactured by Mitsui Petro-chemical Industries, Ltd.) | 500 mg/m$^2$ |
| Snowtex-C (manufactured by Nissan Chemical Industries, Ltd.) | 40 mg/m$^2$ |
| Denacol EX-614B (manufactured by Nagase Kasei Kogyo Co., Ltd.) | 30 mg/m$^2$ |

Both faces of the support were coated in turn with undercoat layer (a) and undercoat layer (b), and each dried at 180° C. for 4 minutes. Then, one face on undercoat layer (a) and undercoat layer (b) was coated in turn with the conductive layer and the protection layer, and each dried at 180° C. for 4 minutes to prepare a PET support provided with the back/undercoat layers.

The PET support provided with the back/undercoat layers thus prepared was transferred at a tension of 3 kg/m$^2$ at a transfer speed of 20 m/minute through a heat treatment zone having the whole length of 200 m and set at 200° C. Then, the support was passed through a zone of 40° C. for 15 seconds, and taken up at a winding tension of 10 kg/m$^2$.

<Preparation of Coating Solution for Emulsion Face Protection Layer>

To 500 g of a 40% polymer latex (methyl methacrylate/styrene/2-ethylhexyl acrylate/2-hydroxyethyl methacrylate/methacrylic acid (59/9/26/5/1) copolymer), 262 g of $H_2O$ was added. Then, 14 g of benzyl alcohol, 2.5 g of compound D, 3.6 g of Serozoru 524 (manufactured by Chukyo Yushi Co., Ltd.), 12 g of compound E, 1 g of compound F, 2 g of compound G and 7.5 g of compound H as auxiliary film forming agents, and 3.4 g of fine polymethyl methacrylate particles having an average particle size of 3 $\mu$m as a matte agent were added in turn. $H_2O$ was further added to make the total weight 1000 g, thus preparing a coating solution having a viscosity of 5 cp (25° C.) and a pH of 3.4 (25° C.).

Compound D

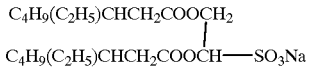

Compound E

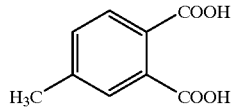

Compound F

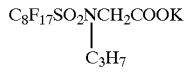

-continued

Compound G

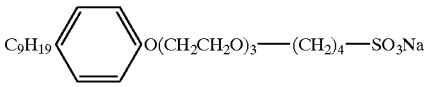

Compound H

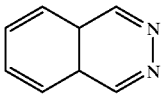

<Preparation of Photothermographic Materials>

Each coating solution for the emulsion layer of Example 5 was applied onto the undercoat layer of the above-mentioned PET support provided with the back/undercoat layers so as to give an amount of silver coated of 1.6 g/m$^2$. The above-mentioned coating solution for the emulsion face protection layer was further applied onto it so as to give an amount of the polymer latex coated of 2.0 g/m$^2$. Thus, photothermographic materials 21' to 23' were prepared.

EXAMPLE 7

Photothermographic materials 24' to 32' were prepared in the same manner as with photothermographic material 20' with the exception that LACSTAR 3307B, a main binder, contained in the coating solution for the emulsion layer of photothermographic material 20' used in Example 5 was replaced by binders shown in Table 26'. The photographic properties were evaluated in the same manner as with Example 5. As to the sensitivity, the sensitivity of photothermographic material 20' of Example 5 was taken as 100. Results obtained are shown in Table 26'.

TABLE 26'

| Photothermographic Material No. | Kind of Polymer Latex of Image Formation Layer | Glass Transision Temperature (Tg)* (° C.) | Sensitivity | Contrast | Dmin (Visible) | Dmin (UV) |
|---|---|---|---|---|---|---|
| 24' (Invention) | Ethyl Acrylate (particle size: 80 nm) | −13—16 | 110 | 14 | 0.12 | 0.19 |
| 25' (Invention) | Nipol LX110 (manufactured by Nippon Zeon Co., Ltd. | −52 | 117 | 8 | 0.18 | 0.25 |
| 26' (Invention) | Nipol LX435 (manufactured by Nippon Zeon Co., Ltd. | −17—19 | 112 | 11 | 0.13 | 0.20 |
| 27' (Invention) | Nipol LX430 (manufactured by Nippon Zeon Co., Ltd. | 4 | 107 | 12 | 0.10 | 0.17 |
| 28' | Nipol LX416 (manufactured by Nippon Zeon Co., Ltd. | 47 | 79 | 7 | 0.17** | 0.25** |
| 29' (Invention) | HYDRAN AP10 (manufactured by Dainippon Ink & Chemicals, Inc. | 22–37 | 110 | 11 | 0.11 | 0.18 |
| 30' (Invention) | SBR (particle size: 115 nm) | 30 | 91 | 11 | 0.12 | 0.19 |
| 31' | SBR (particle size: 115 nm) | 50 | 56 | 6 | 0.19** | 0.30** |
| 32' (Invention) | SBR (particle size: 115 nm) | 60 | 52 | 5 | 0.28** | 0.39** |
| 20' (Invention) | LACSTAR 3307B (manufactured by Dainippon Ink & Chemicals, Inc. | 17 | 100 | 13 | 0.09 | 0.16 |

*Measured values by DSC
**Cloudy and low in transparency

Table 26' reveals that the photothermographic materials of the present invention using polymer latexes having a glass transition temperature of 40° C. or less are excellent in sensitivity, contrast and Dmin. Further, it shows that too low a glass transition temperature (photothermographic material 25') results in deterioration of sensitivity and Dmin. From the above, the effectiveness of the present invention is apparent.

FIG. 1 is a side view showing the heat developing machine used in Examples. A halogen lamp 1 is contained in a cylindrical heat drum 2 as a heat source for a heating means, and a transferring endless belt 4 belted around a plurality of feed rolls 3 is pressed on a peripheral surface of the heat drum 2. A sample 5 is put between the endless belt 4 and the heat drum 2 and transferred. The sample 5 is heated to a developing temperature during transfer, and heat developed. In the drum type heat developing machine, the light distribution of the lamp is optimized to adjust the crosswise temperature accuracy within ±1° C. A correcting guide 7 for flatly correcting the sample 5 released from a curvature of the peripheral surface of the heat drum 2 is provided in the vicinity of an outlet 6 through which the sample 5 is sent out from between the heat drum 2 and the endless belt 4. The atmospheric temperature is controlled so that the temperature of the sample 5 is not lowered to 90° C. or less in the vicinity of this correcting guide 7. A pair of feed rolls 8 for feeding the sample 5 are mounted downstream from the outlet 6, and a pair of flat guides 9 for guiding the sample while maintaining it flat are installed downstream therefrom. Further, another pair of feed rolls 10 are mounted downstream therefrom adjacent to the flat guide plates 9. The flat guide plates 9 have such a length that the sample 5 is cooled while the sample 5 is transferred therebetween. That is to say, the sample 5 is cooled in the meantime until the temperature thereof reaches 30° C. or less. As a cooling means for this, a cooling fun 11 is installed.

What is claimed is:

1. A photothermographic material comprising a support having provided thereon a light-insensitive organic silver salt, a light-sensitive silver halide formed independently of the light-insensitive organic silver salt, and a binder, wherein the main binder of an image formation layer containing the light-sensitive silver halide is a synthetic polymer latex having a glass transition temperature of 40° C or less, said image formation layer is formed by applying a coating solution in which 60% by weight or more of a solvent is water, and the light-sensitive silver halide is gold-sensitized silver halide grains having a silver chloride content of 80 mol % or more per silver halide.

2. The photothermographic material according to claim 1, wherein the image formation layer or a layer adjacent thereto contains a hydrazine compound.

3. The photothermographic material of claim 2, wherein said hydrazine is a compound of the formula (H):

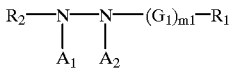

(H)

wherein $R_1$ represents a hydrogen atom or a block group; $R_2$ represents an aliphatic group, an aromatic group or a heterocyclic group; $G_1$ represents —CO—, —COCO—, —C═S—, —$SO_2$—, —SO—, PO($R_3$)— (wherein $R_3$ is selected from the same groups as defined for $R_1$ and may be the same or different from $R_1$), a thiocarbonyl group or an iminomethylene group; $A_1$ and $A_2$ are both hydrogen atoms or one represents a hydrogen atom and the other represents a substituted or unsubstituted alkylsulfonyl group, a substituted or unsubstituted arylsulfonyl group, or a substituted or unsubstituted acyl group; ml is 0 or 1; and when $m_1$ is 0, $R_1$ represents an aliphatic group, an aromatic group or a heterocylic group.

4. The photothermographic material of claim 1, wherein the silver halide grains are tabular or cubic.

5. The photothermographic material of claim 1, wherein said silver halide grains further contain metal atoms selected from the group consisting of cobalt, iron, nickel, chromium, palladium, platinum, gold, thallium, copper and lead.

6. The photothermographic material of claim 1, wherein said synthetic polymer latex is selected from the group consisting of acrylic resins, vinyl acetate resins, polyester resins, polyurethane resins, rubber resins, vinyl chloride resins, vinylidene chloride resins, polyolefin resins and copolymers thereof.

7. A photothermographic material comprising a support having provided thereon a light-insensitive organic silver salt, a light-sensitive silver halide formed independently of the light-insensitive organic silver salt, and a binder, wherein the main binder of an image formation layer containing the light-sensitive silver halide is a synthetic polymer latex having a glass transition temperature of 40° C. or less, said image formation layer is formed by applying a coating solution in which 60% by weight or more of a solvent is water, and the light-sensitive silver halide is silver halide grains having a silver chloride content of 80 mol % or more per silver halide and having localized phases of silver bromide on surfaces thereof.

8. The photothermographic material according to claim 7, wherein the light-sensitive silver halide is gold sensitized.

9. The photothermographic material according to claim 7, wherein the image formation layer or a layer adjacent thereto contains a hydrazine compound.

10. The photothermographic material of claim 7, wherein the localized phases of silver bromide have a silver bromide content of from 10 mol % to 95 mol %.

11. The photothermographic material of claim 7, wherein the localized phases of silver bromide are 0.03 mol % to 20 mol % of the total silver halide grains.

12. A photothermographic material comprising a support having provided thereon a light-insensitive organic silver salt, a light-sensitive silver halide formed independently of the light-insensitive organic silver salt, and a binder, wherein the main binder of an image formation layer containing the light-sensitive silver halide is a synthetic polymer latex having a glass transition temperature of 40° C. or less, said image formation layer is formed by applying a coating solution in which 60% by weight or more of a solvent is water, the light-sensitive silver halide is added in preparing the coating solution and is silver halide grains having a silver chloride content of 50 mol % or more per silver halide, and at least one metal or metal complex belonging to group VII or VIII in the periodic table is contained in said silver halide grains.

13. The photothermographic material according to claim 12, wherein said metal or metal complex contained in the light-sensitive silver halide is selected from the group consisting of rhodium, rhenium, ruthenium, osmium, iridium and complexes thereof.

14. The photothermographic material of claim 13, wherein said metal or metal complex is present in an amount of $10^{-9}$ mol to $10^{-3}$ mol per mol of silver.

15. The photothermographic material according to claim 12, wherein the silver chloride content is 70 mol % or more per light-sensitive silver halide.

16. The photothermographic material according to claim 12, wherein the light-sensitive silver halide is chemically sensitized.

17. The photothermographic material according to claim 12, wherein the image formation layer or another layer adjacent thereto contains a hydrazine compound.

* * * * *